US012465097B2

(12) United States Patent
Song et al.

(10) Patent No.: US 12,465,097 B2
(45) Date of Patent: Nov. 11, 2025

(54) ISOLATION GOWN WITH ADJUSTABLE NECK CLOSURE

(71) Applicant: CHILDREN'S NATIONAL MEDICAL CENTER, Washington, DC (US)

(72) Inventors: Xiaoyan Song, Washington, DC (US); Jules Sherman, Washington, DC (US); Rahul K. Shah, Washington, DC (US)

(73) Assignee: CHILDREN'S NATIONAL MEDICAL CENTER, Washington, DC (US)

( * ) Notice: Subject to any disclaimer, the term of this patent is extended or adjusted under 35 U.S.C. 154(b) by 33 days.

(21) Appl. No.: 18/553,691

(22) PCT Filed: Mar. 30, 2022

(86) PCT No.: PCT/US2022/022578
§ 371 (c)(1),
(2) Date: Oct. 2, 2023

(87) PCT Pub. No.: WO2022/212528
PCT Pub. Date: Oct. 6, 2022

(65) Prior Publication Data

US 2024/0188657 A1 Jun. 13, 2024

Related U.S. Application Data

(60) Provisional application No. 63/170,252, filed on Apr. 2, 2021.

(51) Int. Cl.
*A41D 13/12* (2006.01)

(52) U.S. Cl.
CPC ..... *A41D 13/1209* (2013.01); *A41D 13/129* (2013.01); *A41D 2300/30* (2013.01)

(58) Field of Classification Search
CPC ..... A41D 13/1209; A41D 13/12; A41D 13/1236; A41D 13/1245; A41D 13/1218;
(Continued)

(56) References Cited

U.S. PATENT DOCUMENTS 2,668,294 A * 2/1954 Gilpin ..... A41D 13/1209 2/76
2,719,981 A * 10/1955 Walter ..... A41F 19/005 2/269

(Continued)

FOREIGN PATENT DOCUMENTS

CN 110215000 A * 9/2019 ..... A41D 13/12
IE 41760 B1 * 3/1980

(Continued)

OTHER PUBLICATIONS

International Search and Written Opinion Report Issued Jun. 29, 2022, in PCT/US2022/022578, filed on Mar. 30, 2022, 9 pages.

*Primary Examiner* — Amy Vanatta
(74) *Attorney, Agent, or Firm* — Oblon, McClelland, Maier & Neustadt, L.L.P.

(57) ABSTRACT

The present disclosure relates to an isolation gown. In particular, the present disclosure relates to an isolation gown, comprising a garment body including opening running a length of the garment body and terminating at a neck opening, the garment body having a first side and a second side and being configured to permit a wearer to don the medical gown, sleeves extending distally from the garment body, and one or more restraining mechanisms configured to secure the garment body, the sleeves, or a combination thereof, to a body of the wearer, wherein the one or more restraining mechanisms including an actuatable portion utilizing friction to allow the neck opening of the garment body
(Continued)

to be contracted to a size of a neck of the wearer, and expanded to be larger than a shoulder width of the wearer.

20 Claims, 35 Drawing Sheets

(58) Field of Classification Search
CPC ..... A41D 13/1227; A41D 13/129; A41D 13/1263; A41D 3/00; A41D 3/02; A41D 2300/30; A41D 2300/33; A41D 2300/332
USPC ..... 2/51, 52, 114
See application file for complete search history.

(56) References Cited

U.S. PATENT DOCUMENTS 2,846,686 A 8/1958 Tames
3,011,172 A * 12/1961 Tames ..... A41D 13/1209 2/114
3,218,649 A * 11/1965 Ricter ..... A41D 13/1209 2/48
3,470,568 A * 10/1969 Belkin ..... A41D 13/1209 2/114
3,729,747 A * 5/1973 Belkin ..... A41D 13/1209 2/114
3,935,596 A * 2/1976 Allen, Jr. ..... A41D 13/1209 2/114
4,477,928 A * 10/1984 Graff ..... D04B 1/18 2/221
4,951,318 A * 8/1990 Harreld ..... A41D 13/1209 2/48
5,414,867 A * 5/1995 Bowling ..... A41D 13/1209 2/46
5,829,056 A * 11/1998 Hubert ..... A41D 13/04 2/243.1
6,138,278 A 10/2000 Taylor et al.
6,687,919 B2 2/2004 Dilworth, Jr. et al.
8,037,544 B2 * 10/2011 Kemper ..... A41F 9/007 2/51
2005/0044608 A1 * 3/2005 Ambrose ..... A41D 13/1209 2/114
2012/0174296 A1 7/2012 Martin
2013/0036526 A1 * 2/2013 Rashman ..... A41D 13/1245 2/114
2013/0091615 A1 4/2013 Pasko et al.
2014/0189931 A1 * 7/2014 Fredrickson ..... A41D 27/205 2/114
2015/0257463 A1 9/2015 Trimble et al.
2016/0345644 A1 * 12/2016 Reese ..... A41D 13/1209
2018/0325195 A1 * 11/2018 Emoff ..... A41D 13/1236
2019/0297967 A1 * 10/2019 Buffalini ..... A41D 13/1209
2022/0030983 A1 * 2/2022 Levine ..... A41D 13/129
2022/0047018 A1 * 2/2022 Koos ..... A41D 13/0562
2023/0292861 A1 * 9/2023 Brink ..... A41D 13/1209 2/265
2024/0245152 A1 * 7/2024 Justice ..... A41D 13/129

FOREIGN PATENT DOCUMENTS

KR 101261593 B1 * 5/2013
KR 20220055443 A * 5/2022

* cited by examiner

ISOLATION GOWN WITH ADJUSTABLE NECK CLOSURE

CROSS-REFERENCE TO RELATED APPLICATIONS

The present application claims priority to U.S. Provisional Application No. 63/170,252, filed Apr. 2, 2021, the entire content of which is incorporated by reference herein in its entirety for all purposes.

BACKGROUND

Field of the Disclosure

The present disclosure relates, generally, to medical gowns and minimizing risks of cross-contamination during donning and doffing of a medical gown.

DESCRIPTION OF THE RELATED ART

When medical professionals are called on duty to treat a patient with a potentially infectious disease, it is crucial to protect the health of the medical professionals and to prevent cross-contamination. For example, where a doctor is treating a patient with COVID-19, the doctor must make sure not to become infected with the virus, themselves, and not to function as a vector for the disease when visiting other patients and colleagues.

As such, a medical gown, or "isolation gown", is an essential tool in the personal protective equipment toolbox and is used universally. Surgeons and medical specialists also wear a gown to protect themselves from exposure to a patient's bodily fluids, open wounds, and/or internal organs. Collectively, hospitals can consume an average of 100 isolation gowns a day for each patient bed it operates. After caring for the patient and when doffing the gown, medical providers must pay meticulous attention to ensuring that no pathogenic microorganisms from the sick patient or contaminated surfaces have attached to their clothing, hair, and/or exposed skin, thus putting themselves and others at risk of contracting and/or spreading an infection. To ensure the safety of medical providers, international and national standards have been developed to regulate its design and ensure it delivers the protective features it is intended for. Specifically, the isolation gown is required to provide the wearer a full-scale (360°) coverage One problem associated with conventional isolation gowns is that they can be cumbersome and slow to put on and take off. For instance, it is often the case that, in order to avoid risks of contamination to the wearer, a second person is required to aid in the removal (e.g., untying of a knot) of the medical gown. Moreover, a busy medical provider treating hundreds of patients in a given day cannot afford to dedicate excessive time donning or doffing a medical gown, as this will inevitably reduce the number of patients that can be treated. Further, delays in donning or doffing have been shown to potentially affect care, as medical professionals are not able to immediately respond to an evolving patient care situation.

Thus, there is a need for an improved medical gown that is quick and simple to don and doff.

SUMMARY

The present disclosure relates to an isolation gown.

According to an embodiment, the present disclosure further relates to an isolation gown. In particular, the present disclosure relates to an isolation gown, comprising a garment body including opening running a length of the garment body and terminating at a neck opening, the garment body having a first side and a second side and being configured to permit a wearer to don the medical gown, sleeves extending distally from the garment body, and one or more restraining mechanisms configured to secure the garment body, the sleeves, or a combination thereof, to a body of the wearer, wherein the one or more restraining mechanisms include an actuatable portion utilizing friction to allow the neck opening of the garment body to be contracted to a size of a neck of the wearer and expanded to be larger than a shoulder width of the wearer.

The foregoing paragraphs have been provided by way of general introduction, and are not intended to limit the scope of the following claims. The described embodiments, together with further advantages, will be best understood by reference to the following detailed description taken in conjunction with the accompanying drawings.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION

Figure 1A:
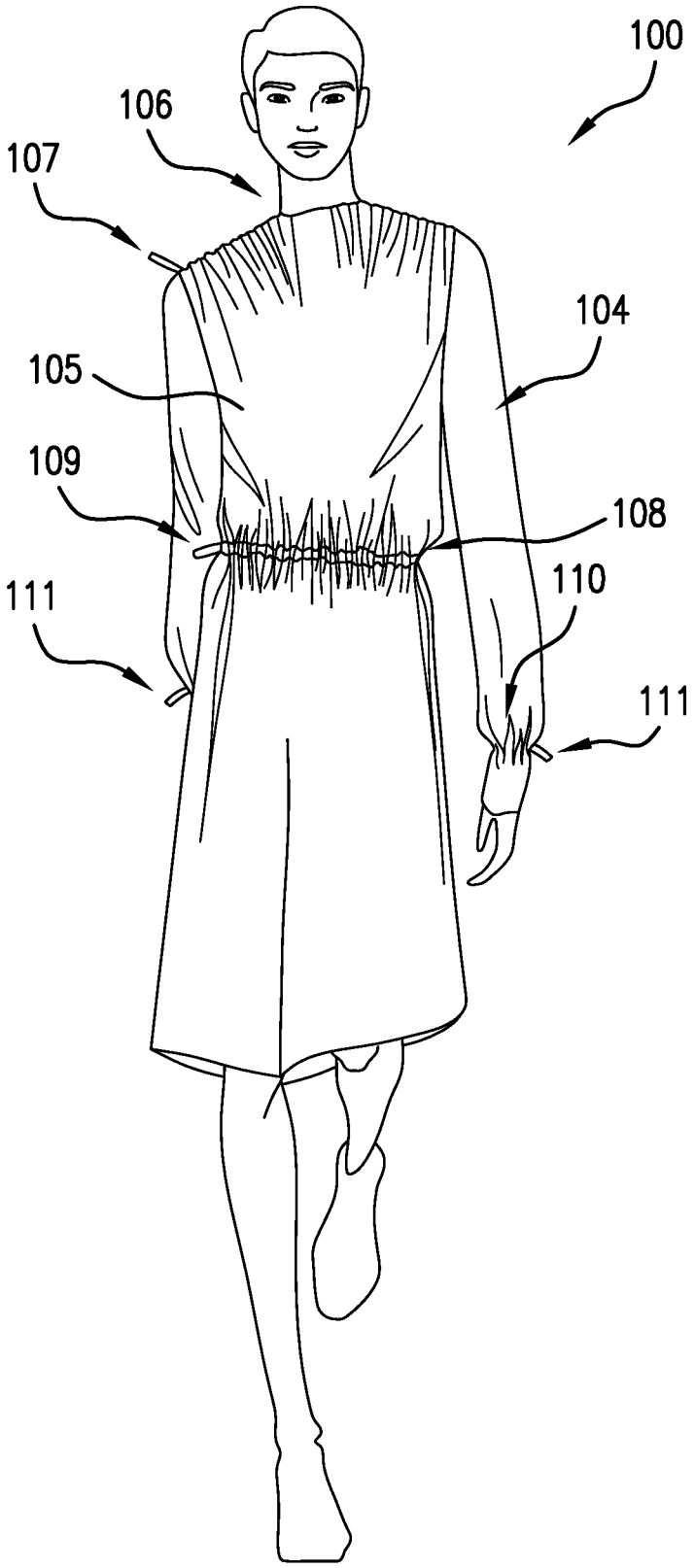
FIG. 1A is a stylized illustration of a wearer having donned a medical gown, according to an exemplary embodiment of the present disclosure.
Figure 1B:
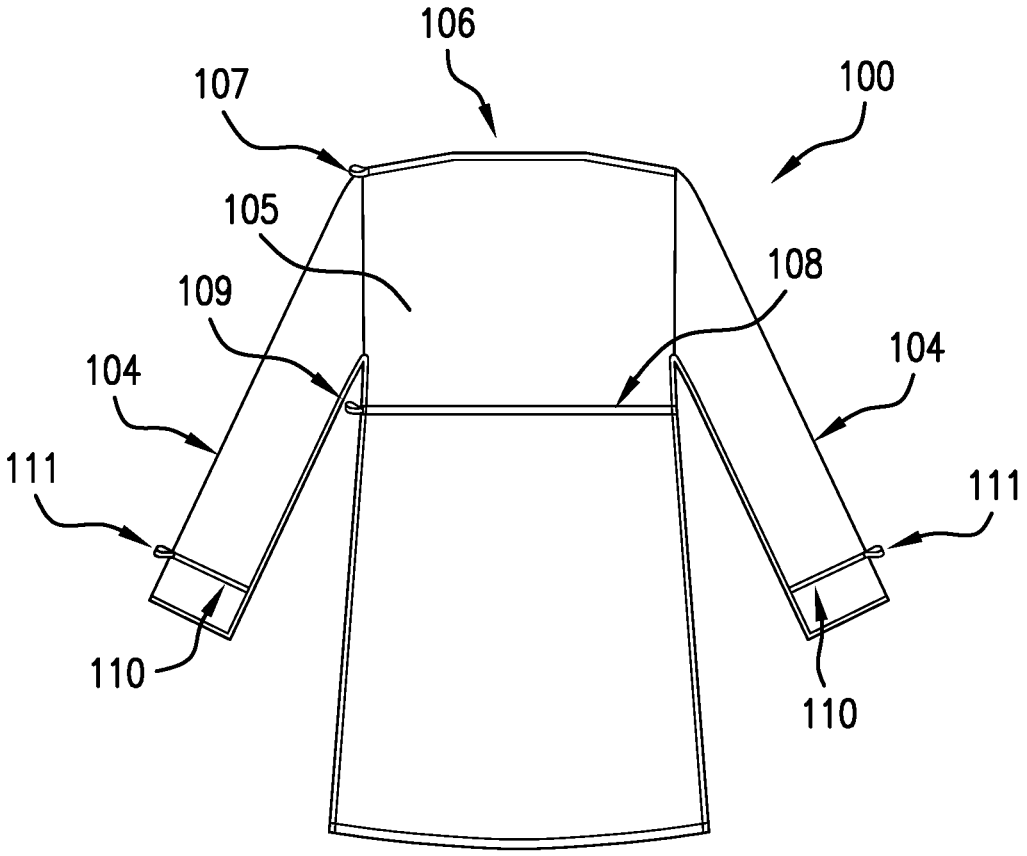
FIG. 1B is an illustration of a front view of a medical gown, according to an exemplary embodiment of the present disclosure.

The terms "a" or "an", as used herein, are defined as one or more than one. The term "plurality", as used herein, is defined as two or more than two. The term "another", as used herein, is defined as at least a second or more. The terms "including" and/or "having", as used herein, are defined as comprising (i.e., open language). Reference throughout this document to "one embodiment", "certain embodiments", "an embodiment", "an implementation", "an example" or similar terms means that a particular feature, structure, or characteristic described in connection with the embodiment is included in at least one embodiment of the present disclosure. Thus, the appearances of such phrases or in various places throughout this specification are not necessarily all referring to the same embodiment. Furthermore, the particular features, structures, or characteristics may be combined in any suitable manner in one or more embodiments without limitation.

Embodiments of the present invention provide a medical gown, which can be used in practice, in one embodiment, as an isolation gown. Additionally, the medical gown of the present invention can be used as a general purpose medical gown. Embodiments of the invention are capable of being quickly donned and quickly doffed by a medical care provider.

A medical gown, or isolation gown, is an essential piece of personal protective equipment that is used in healthcare settings around the globe. At current consumption rates, an average hospital consumes thousands of medical gowns in a given day. To ensure the safety of healthcare providers, international and national standards have been developed to regulate medical gown design and to ensure each medical gown delivers personal protection to the wearer. In particular, an isolation gown is required to provide the wearer 360° coverage.

To that end, current isolation gowns are open in the back and can be secured to the wearer by ties around the neck and the waist. From an infection prevention perspective, this design is cumbersome and difficult to secure and unsecure in order to release the isolation gown. To safely untie the isolation gown without contaminating a wearer's garment or skin, it may require a second provider to assist. Without assistance, the wearer is at risk of being contaminated when trying to find the knot to untie the isolation gown.

In an effort to reduce contamination risks, several approaches have been developed. For instance, in order to address the issue of being able to untie the knot and release the isolation gown, one approach includes an opening for the head to fit through. This one-size-fits-all design, however, fails to accommodate the range of healthcare providers that may require the protection. In an example, a healthcare provider having a larger figure or lots of hair may rip the opening when trying to fit their head through it. In another example, a healthcare provider having a smaller frame may have skin or personal garments exposed as the opening is too large relative to the size of the wearer.

Accordingly, the present disclosure describes an isolation gown having an adjustable neck opening and waist band that allows for rapid donning and doffing.

In an embodiment, the isolation gown of the present disclosure includes an adjustable closing mechanism at the neck opening and at the waist. The adjustable closure mechanism may be a drawstring closure, in an example. As a result, a wearer is provided with flexibility in fitting the neckline of the isolation gown to the physical dimensions of the wearer when donning the isolation gown.

In an embodiment, when removing the isolation gown, the neck opening can be enlarged so that the isolation gown can be easily lifted over a head of the wearer and discarded.

In an embodiment, when removing the isolation gown, the neck opening can be enlarged so that the isolation gown easily slips down the body of the wearer for disposal. This is not only simple but also meets infection control principles and enforces the "clean-to-dirty" one direction flow. In other words, the "drop-down" design of the isolation gown of the present disclosure, from top to bottom, and from donning to doffing, prevents contamination.

In an embodiment, the isolation gown of the present disclosure provides 360° protection without requiring seam lines.

In an embodiment, the isolation gown of the present disclosure may include a side-opening to allow for movement.

It can be appreciated that the isolation gown described herein is relevant for healthcare providers in any type of healthcare setting, first-responders, and the like.

In an embodiment, the isolation gown of the present disclosure includes a garment having one or a plurality of transparent windows affixed over a surface of the garment for viewing and interacting with electronic devices or printed materials. The plurality of transparent windows may include an opening such that the electronic devices or printed materials may be retained within a slot behind the transparent windows.

According to an embodiment, the isolation gown of the present disclosure is directed to a garment having a garment body, a pair of sleeves affixed to the garment body, a plurality of openings disposed on the garment body, the sleeves, or a combination thereof, and one or more restraining mechanisms that radially secure the isolation gown to the body of the wearer. In an embodiment, the plurality of openings disposed on the garment body include a neck opening and the one or more restraining mechanisms may include adjustable contracting mechanisms that can be operated to reduce or enlarge a size of a hole of the neck opening.

In an example, the adjustable contracting mechanism may be a drawstring that is threaded through a hem, a casing, or eyelids and can be actuated to reduce or enlarge the size of the hole of the neck opening. The drawstring may include a cordlock that allows the drawstring to be fixed in order to maintain the neck opening at a specific size. The cordlock can then be released in order to doff the isolation gown. In one embodiment, a portion of the drawstring can be looped through the barrel of the cordlock. The length of the loop can be adjusted to reduce or enlarge the size of the hole of the neck opening.

In another example, the adjustable contracting mechanism may be a drawstring that is threaded through a hem, a casing, or eyelids and may be designed to include a certain imprint or a certain roughness, or fabricated from a certain material, such that contact between the drawstring and the hem, the casing, or the eyelids (e.g., frictional resistance, surface tension) causes the drawstring to remain in place. Thus, the drawstring can remain in place after reducing a size of a hole of the neck opening due to friction between/among embossed, molded, stamped, or carved surfaces (i.e., the adjustable contracting mechanism comprises the resistance that one surface or object encounters when moving over another). Accordingly, when donning the isolation gown, adjusting the drawstring may generate friction between the drawstring and the hem and allow the neck opening to be reduced in size. When doffing the isolation gown, force may be applied to the drawstring to tear the drawstring or to cause the drawstring to slip through the hem and become loose, thereby permitting expansion of the neck opening and removal of the isolation gown, either over the shoulders and to the ground or lifted above the head.

According to an embodiment, a dimensional value of the hole of the neck opening of the isolation gown may be, in an expanded state, larger than a dimensional value of shoulders of the wearer and, in a contracted state, larger than a dimensional value of a neck of the wearer (e.g., diameter). In an embodiment, the hole of the neck opening may be circular, rectangular, square, ellipsoidal, or another geometric shape appropriate for a given wearer. In the end, the size of the hole of the neck opening is configured to be, in an expanded state, large enough to slip down past the shoulders of the wearer and, in a contracted state, secured relative to the neck of the wearer such that exposure to environment contaminants is minimized. In an alternative embodiment, the expanded state and the contracted state could be achieved through the use of an elastic material. The elastic material could be used for one or more aspects of the contraction/expansion or in combination with frictional methods and/or a drawstring technique.

In another embodiment, a dimensional value of the hole of the neck opening of the isolation gown may be, in an expanded state, smaller than a dimensional value of shoulders of the wearer and, in a contracted state, larger than a dimensional value of a neck of the wearer (e.g., diameter). In an embodiment, the hole of the neck opening may be circular, rectangular, square, ellipsoidal, or another geometric shape appropriate for a given wearer. In the end, the size of the hole of the neck opening is configured to be, in an expanded state, large enough to be lifted above and off the head of the wearer and, in a contracted state, secured relative to the neck of the wearer such that exposure to environment contaminants is minimized.

In an embodiment, the position of the drawstring relative to the neck opening of the isolation gown may be arranged as appropriate for actuating the necessary change in size of the hole of the neck opening and for providing contaminant defense. In an example, the drawstring may be at least partially housed within a hem at a collar of the neck opening. In one instance, the drawstring may be substantially housed within the hem at the collar of the neck opening, an actuatable portion of the drawstring being accessible from outside of the isolation gown. In another instance, the drawstring may be partially housed in the hem at the collar of the neck opening and partially housed along a hem that extends along an axis defined by the shoulders. In this instance, the drawstring may include an actuatable portion of the drawstring that is accessible from outside the isolation gown in order to expand and contract the hole of the neck opening. The expansion of the hole of the neck opening may be, in particular, large enough to allow the isolation gown to be lifted above the head and off the wearer or to be slid down over the shoulders of the wearer and to the floor.

In an embodiment, the actuatable portion of the drawstring can be accessible from an anterior position of the isolation gown, a posterior position of the isolation gown, or a lateral position of the isolation gown. In an example, the actuatable portion of the drawstring is accessible from one shoulder of the isolation gown.

According to an embodiment, the one or more restraining mechanisms may include an adjustable contracting mechanism arranged around a portion of the garment body corresponding to a midsection of the wearer. The adjustable contracting mechanism may allow the isolation gown to be fixed to a waist of the wearer in order to permit motion. In an example, the adjustable contracting mechanism may be a drawstring that is threaded through a hem, a casing, or eyelids and can be actuated to reduce or enlarge a dimensional value of a midsection of the garment body. The drawstring may include a cordlock that allows the drawstring to be fixed in order to maintain a dimensional value of the midsection of the garment body. The cordlock can then be released in order to doff the isolation gown.

According to an embodiment, the pair of sleeves affixed to the garment body may include, proximate to a distal end of each sleeve, an opening configured to receive a thumb of a hand of the wearer. The opening configured to receive the thumb of the hand of the wearer may be adjacent to a hole of the respective sleeve through which the remaining digits of the hand protrude. It can be appreciated that the thumb opening provides improved contamination protection and positional stability of the sleeve of the isolation gown while allowing for donning of medical gloves.

According to an embodiment, the one or more restraining mechanisms may include an adjustable contracting mechanism arranged at the distal end of each sleeve and configured to secure the sleeve to the arm of the wearer. The adjustable contracting mechanism may allow the sleeve of the isolation gown to be fixed to a wrist portion of the wearer. In an example, the adjustable contracting mechanism may be a drawstring that is threaded through a hem, a casing, or eyelids and can be actuated to reduce or enlarge a dimensional value of a distal end of the sleeve. The drawstring may include a cordlock that allows the drawstring to be fixed in order to maintain a dimensional value of the distal end of the sleeve of the isolation gown. The cordlock can then be released in order to doff the isolation gown.

With reference now to the Drawings, FIG. 1A through FIG. 1E describe a first embodiment of an isolation gown, according to an exemplary embodiment of the present disclosure.

FIG. 1A, FIG. 1B, FIG. 1C, and FIG. 1D provide illustrations of an isolation gown 100, according to an exemplary embodiment of the present disclosure. A body covering portion of the isolation gown 100, including a garment body 105 and sleeves 104, is configured to wrap about the torso of a wearer. In one embodiment, the medical gown 100 is manufactured from a non-woven fabric, a woven fabric, a non-woven synthetic, or a woven synthetic. The fabric can be a disposable material and, optionally, can include a fluid resistant lining that prevents the passage of fluids, such as water, bodily fluids, and the like, through the garment body 105 and/or the sleeves 104. In an embodiment, a length of the isolation gown 100 is configured to extend from a wearer's shoulders to below their knees.

In an embodiment, the fabric is a non-woven fabric configured to be tearable by a wearer. For example, the non-woven fabric may have a tensile strength of between four and ten pounds. Thus, if the wearer were to grasp opposing sides of a section of the non-woven fabric, and then pull with a force of between four and ten pounds, the fabric would tear. In one embodiment, a pulling force of greater than ten pounds can also tear the fabric.

In an embodiment, the sleeves 104 extend distally from the garment body 105 and are configured to receive wearer's arms when the isolation gown 100 is donned. As in FIG. 1A, the sleeves 104 are illustrated as long sleeves, though it can be appreciated that any length sleeve can be used so long as required protection is provided.

In an embodiment, the isolation gown 100 may optionally include pockets or other surface features. For instance, a transparent covering may be affixed to a pocket on a surface of the isolation gown 100. The transparent covering, described with respect to FIG. 3A through FIG. 3D, allows for viewing of printable material, such as a name tag or a mobile device, such as a smartphone.

In the illustrative embodiment of FIG. 1A, the garment body 105 includes, at a lower end, a body opening through which the body of the wearer can be introduced. In an embodiment, the body opening can be configured with a slit that runs a portion of a length of the garment body 105.

Figure 1C:
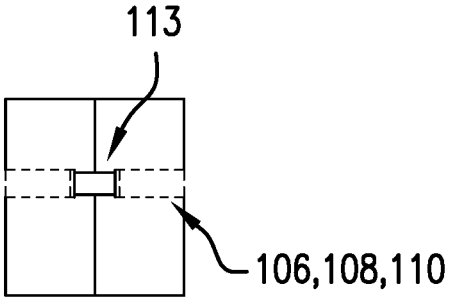
FIG. 1C is an illustration of an aspect of a medical gown, according to an exemplary embodiment of the present disclosure.
Figure 1D:
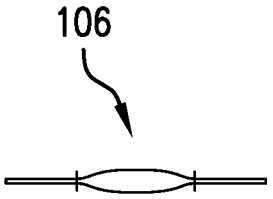
FIG. 1D is an illustration of a neck opening of a medical gown, according to an exemplary embodiment of the present disclosure.

In an embodiment, the isolation gown 100 is retained about the neck of the wearer by one or more restraining mechanisms 106, as particularly shown in FIG. 1D. The one or more restraining mechanisms 106 may include an adjustable contracting mechanism having at least one actuatable portion 107 that allows for adjusting the one or more restraining mechanisms 106 between a contracted state that secures a neck opening of the isolation gown 100 to the neck of the wearer and an expanded state wherein the neck opening of the isolation gown 100 is large enough to allow the isolation gown 100 to be removed, either by being lifted above the head of the wearer or slipped to the floor around the body of the wearer. In an embodiment, the adjustable contracting mechanism may be a drawstring mechanism, a hook and loop mechanism, a button mechanism, a buckle mechanism, an elastic mechanism, and the like. In another embodiment, the adjustable contracting mechanism may be integrated with a powered air-purifying respirator (PAPR) system, and the contracted state and the expanded state of the adjustable contracting mechanism may be controlled by an amount of fluid from the PAPR system and within the one or more restraining mechanisms 106. In another embodiment, the adjustable contracting mechanism may include snap/press studs, safety pins, cuff links, brooches, zippers, metal hooks and eye, frog fasteners, toggle fasteners, snap hooks/clasps, grommets/eyelets, glass studs, cords and ropes, sliders, adhesives, clasps, squeeze buckles, and G-hooks, among others. In one example, the adjustable contracting mechanism may be a ball and loop closure.

In an example, the adjustable contracting mechanism may be a drawstring. The drawstring may include a cordlock in order to secure the neck opening in both of a contracted state and an expanded state. The drawstring may, alternatively, include imprints or depressions to allow for frictional securing of the drawstring within a hem of the neck opening in a contracted state and an expanded state. In another embodiment, the adjustable contracting mechanism may be a drawstring comprising elastic materials to allow the neck opening, without the aid of a locking mechanism, to be secured to the wearer in a contracted state and easily released from the wearer by expansion to an expanded state.

In an embodiment, the at least one actuatable portion 107 of the adjustable contracting mechanism of the one or more restraining mechanisms 106 may be positioned along a shoulder line of the wearer and proximate a glenohumeral joint of the wearer. In other embodiments, the at least one actuatable portion 107 may be arranged at another position accessible to the wearer. The position of the at least one actuatable portion 107 as close to the glenohumeral joint ensures that the wearer may access the actuatable portion without comprising sterility of the neck opening. Moreover, positioning the at least one actuatable portion 107 as close to the glenohumeral joint allows the wearer to ensure, via proprioception and/or vision, that the expanded state of the one or more restraining mechanisms 106 is in a determined positioned relative to an edge of the shoulders.

In other embodiments, the at least one actuatable portion 107 may be more than one actuatable portion.

In an embodiment, the isolation gown 100 is retained about a midsection of the wearer by one or more restraining mechanisms 108. The one or more restraining mechanisms 108 may include an adjustable contracting mechanism having at least one actuatable portion 109 that allows for adjusting the one or more restraining mechanisms 108 between a contracted state that secures the garment body 105 of the isolation gown 100 to the midsection of the wearer and an expanded state wherein an area of the garment body 105 of the isolation gown 100 is large enough to allow the isolation gown 100 to be lifted above the shoulders and the head of the wearer or slipped to the floor around the body of the wearer. In an embodiment, the adjustable contracting mechanism may be a drawstring mechanism, a hook and loop mechanism, a button mechanism, a buckle mechanism, an elastic mechanism, and the like. In another embodiment, the adjustable contracting mechanism may include snap/press studs, safety pins, cuff links, brooches, zippers, metal hooks and eye, frog fasteners, toggle fasteners, snap hooks/clasps, grommets/eyelets, glass studs, cords and ropes, sliders, adhesives, clasps, squeeze buckles, and G-hooks, among others.

In an example, the adjustable contracting mechanism may be a drawstring. The drawstring may include a cordlock in order to secure a midsection of the garment body in both of a contracted state and an expanded state. The drawstring may, alternatively, include imprints or depressions to allow for frictional securing of the drawstring within a hem of the midsection of the garment body in a contracted state and an expanded state. In another embodiment, the adjustable contracting mechanism may be a drawstring comprising elastic materials to allow the midsection of the garment body, without the aid of a locking mechanism, to be secured to the wearer in a contracted state and easily released from the wearer by expansion to an expanded state.

In an embodiment, the at least one actuatable portion 109 of the adjustable contracting mechanism of the one or more restraining mechanisms 108 may be positioned at a hip of the wearer. In other embodiments, the at least one actuatable portion 109 may be arranged at another position accessible to the wearer. The position of the at least one actuatable portion 109 as close to the hip ensures that the at least one actuatable portion 109 is accessible without interfering with a task that is front of the wearer. Moreover, positioning the at least one actuatable portion 109 as close to the hip allows the wearer to ensure, via proprioception and/or vision, that the expanded state of the one or more restraining mechanisms 108 is sufficient to allow the isolation gown 100 to be lifted above the shoulders and head the wearer or to be slipped to the floor during doffing.

In other embodiments, the at least one actuatable portion 109 may be more than one actuatable portion.

In an embodiment, the isolation gown 100 is retained about arms of the wearer by one or more restraining mechanisms 110. The one or more restraining mechanisms 110 may include an adjustable contracting mechanism having at least one actuatable portion 111 that allows for adjusting the one or more restraining mechanisms 110 between a contracted state that secures the sleeves 104 of the isolation gown 100 to the arms of the wearer and an expanded state wherein an opening of a distal end of the sleeves 104 of the isolation gown 100 is large enough to allow the sleeves 104 to slip over hands of the wearer. In an embodiment, the adjustable contracting mechanism may be a drawstring mechanism, a hook and loop mechanism, a button mechanism, a buckle mechanism, an elastic mechanism, and the like. In another embodiment, the adjustable contracting mechanism may include snap/press studs, safety pins, cuff links, brooches, zippers, metal hooks and eye, frog fasteners, toggle fasteners, snap hooks/clasps, grommets/eyelets, glass studs, cords and ropes, sliders, adhesives, clasps, squeeze buckles, and G-hooks, among others. In an example, the adjustable contracting mechanism may be a drawstring. The drawstring may include a cordlock in order to secure the sleeve opening in both of a contracted state and an expanded state. The drawstring may, alternatively, include imprints or depressions to allow for frictional securing of the drawstring within a hem of the sleeve opening in a contracted state and an expanded state. In another embodiment, the adjustable contracting mechanism may be a drawstring comprising elastic materials to allow the sleeve opening, without the aid of a locking mechanism, to be secured to the wearer in a contracted state and easily released from the wearer by expansion to an expanded state.

In an embodiment, the at least one actuatable portion 111 of the adjustable contracting mechanism of the one or more restraining mechanisms 110 may be positioned at wrists of the wearer. In other embodiments, the at least one actuatable portion 111 may be arranged at another position accessible to the wearer. The position of the at least one actuatable portion 111 as close to the wrists ensures that the one or more restraining mechanisms 110 are secured to the arms of the wearer such that contamination via the sleeves 104 is improbable.

In other embodiments, the at least one actuatable portion 111 may be more than one actuatable portion.

Figure 1E:
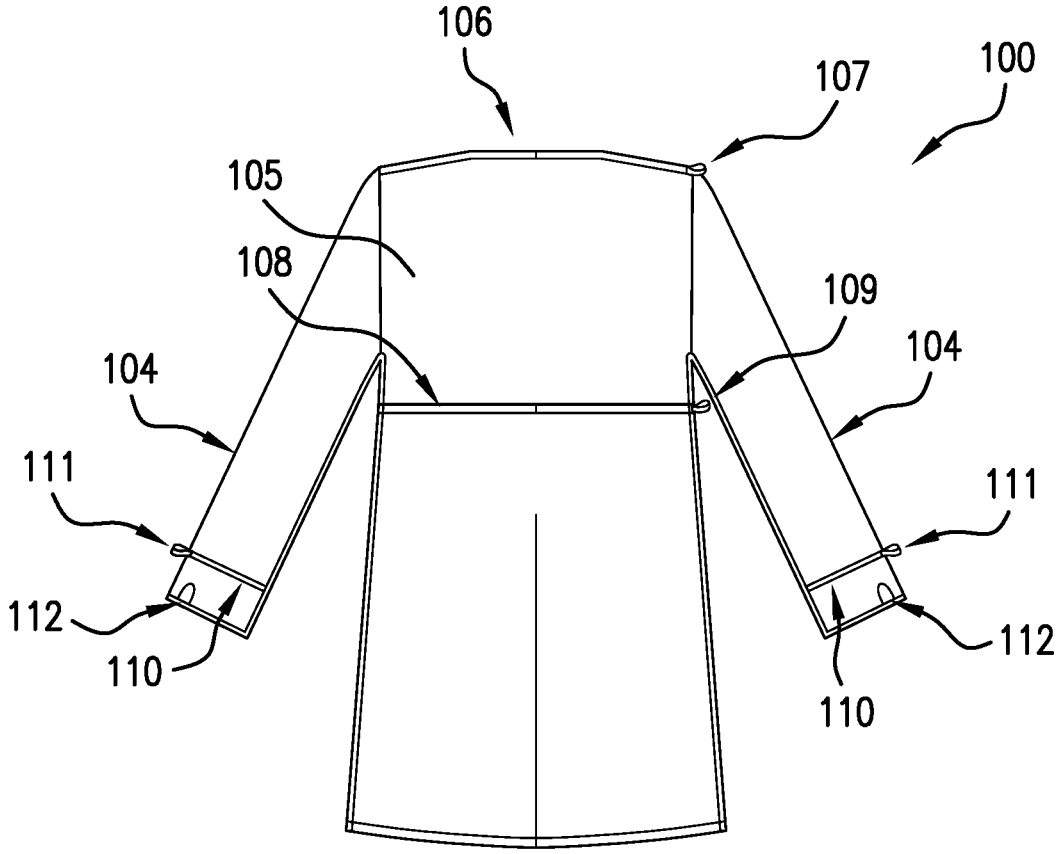
FIG. 1E is an illustration of a rear view of a medical gown, according to an exemplary embodiment of the present disclosure.

According to an embodiment, and with particular reference to FIG. 1E, the sleeves 104 may include, at a distal end, one or more openings. An opening 112 of the one or more openings of the sleeves 104 may be configured to receive a thumb of the wearer. The opening 112, arranged at a distal end of the sleeves 104, secures the sleeves 104 relative to a hand of the wearer. As described above with regard to the one or more restraining mechanisms 110, the opening 112 improves contamination prevention.

According to an embodiment, each of the adjustable contracting mechanisms of the one or more restraining mechanisms 106, 108, 110, may be a drawstring tape paper as shown in FIG. 1C. The drawstring tape paper may have an actuatable portion 113 that allows the drawstring tape paper to move from an expanded state to a contracted state, and vice versa. The actuatable portion 113 may be arranged on a right waist of the wearer and may be actuated by a digit of the wearer. According to another embodiment, each of the adjustable contracting mechanisms of the one or more restraining mechanisms 106, 108, 110 may be a self-adhesive tape.

Figure 2A:
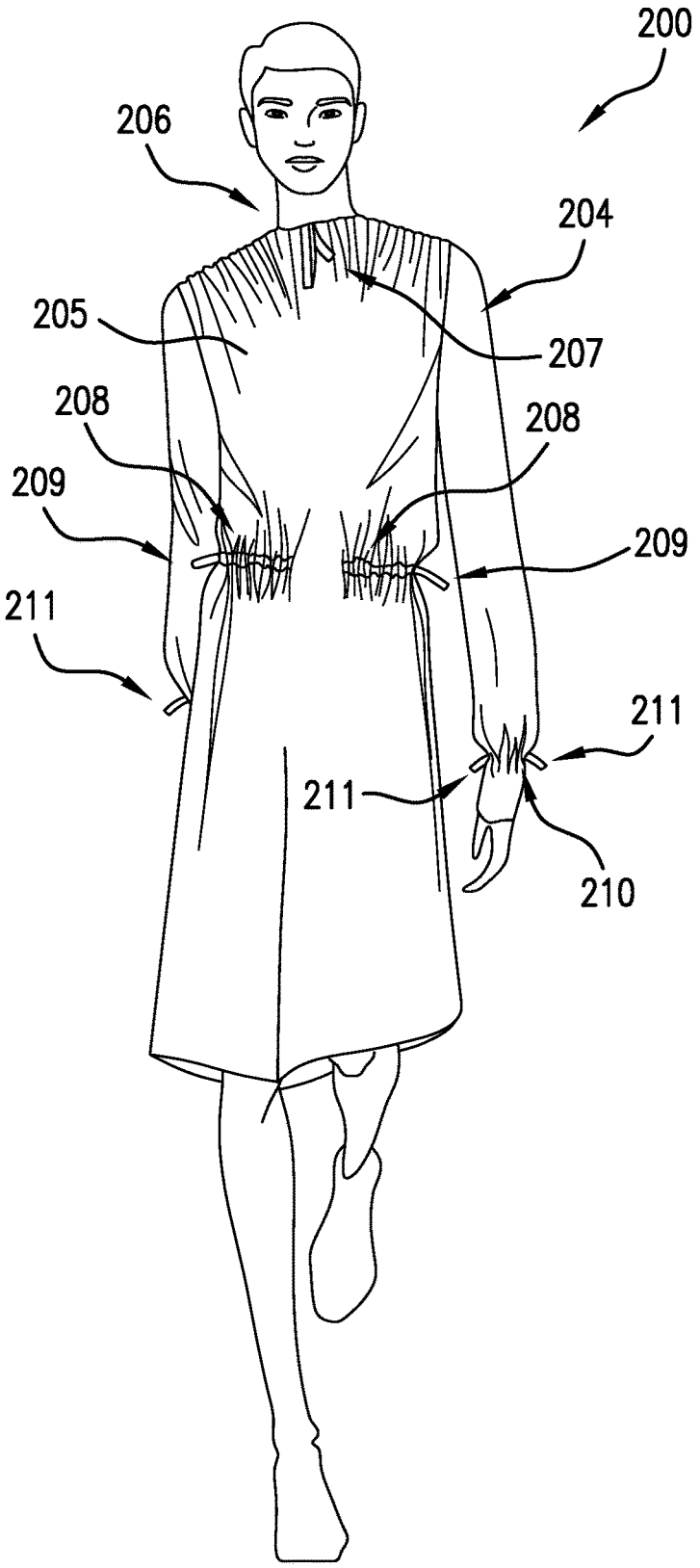
FIG. 2A is a stylized illustration of a wearer having donned a medical gown, according to an exemplary embodiment of the present disclosure.
Figure 2B:
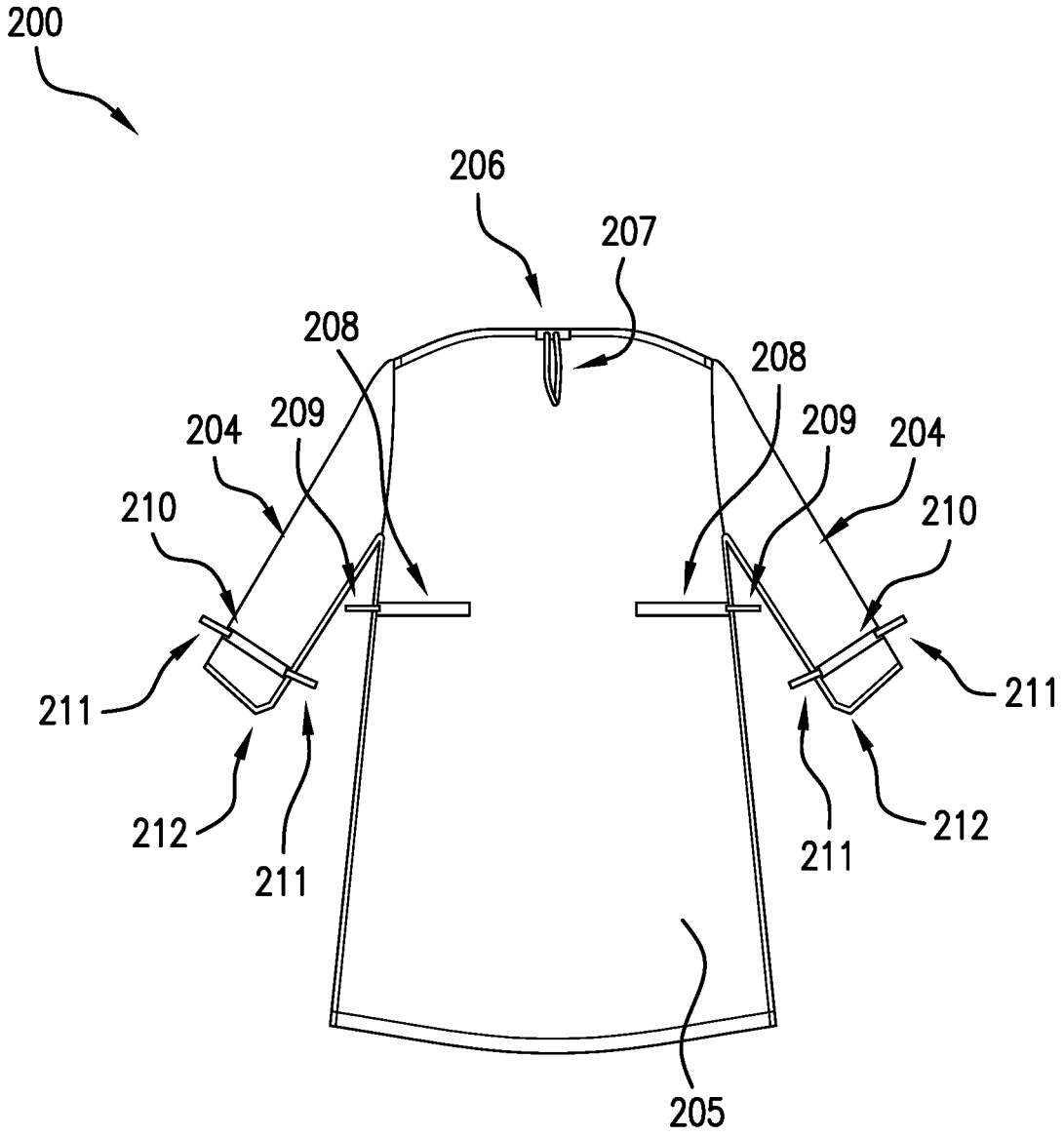
FIG. 2B is an illustration of a front view of a medical gown, according to an exemplary embodiment of the present disclosure.
Figure 2C:
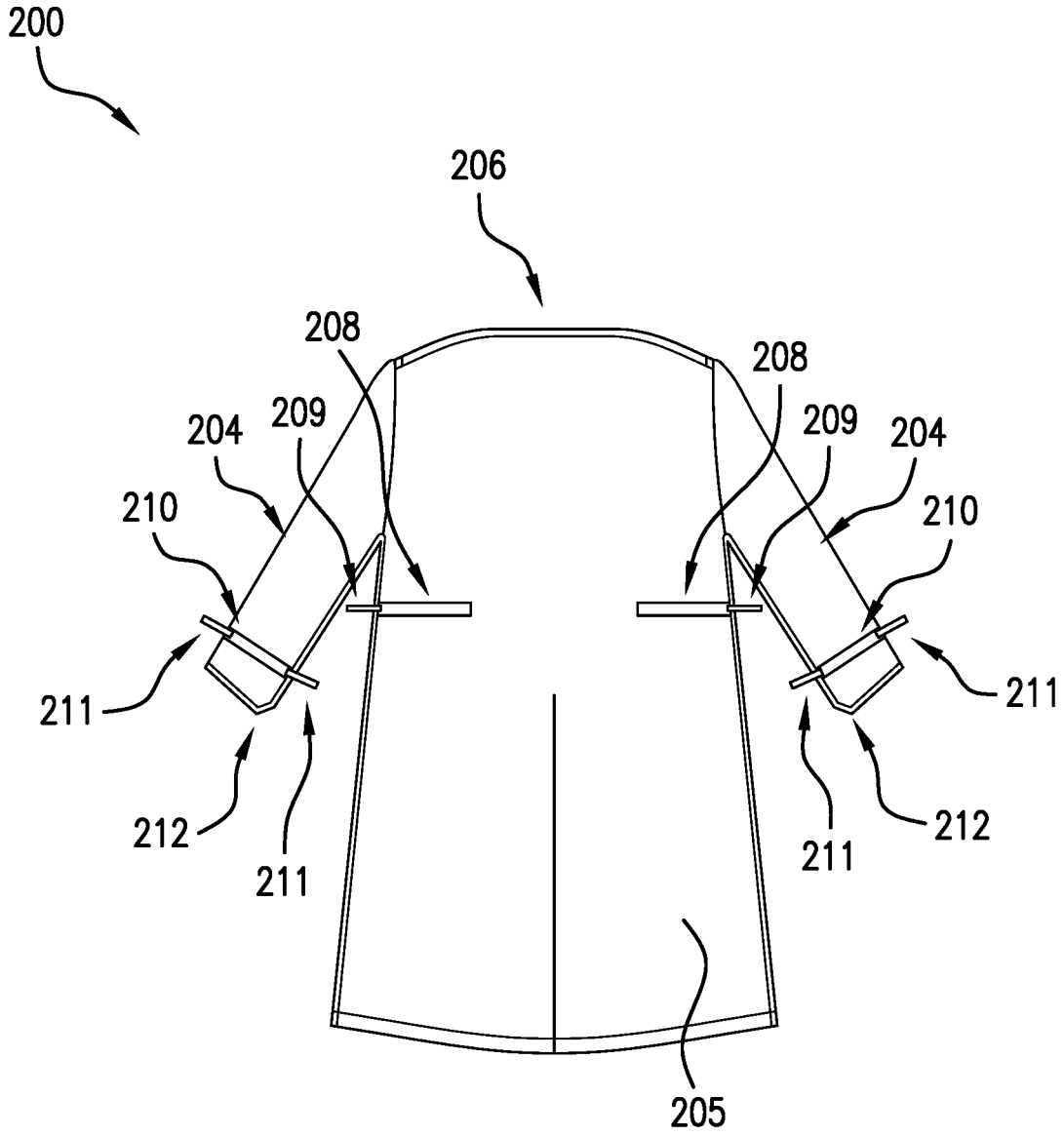
FIG. 2C is an illustration of a rear view of a medical gown, according to an exemplary embodiment of the present disclosure.

FIG. 2A through FIG. 2C provide illustrations of an isolation gown 200, according to an exemplary embodiment of the present disclosure. A body covering portion of the isolation gown 200, including a garment body 205 and sleeves 204, is configured to wrap about the torso of a wearer. In one embodiment, the medical gown 200 is manufactured from a non-woven fabric, a woven fabric, a non-woven synthetic, or a woven synthetic. The fabric can be a disposable material and, optionally, can include a fluid resistant lining that prevents the passage of fluids, such as water and bodily fluids, through the garment body 205 and/or the sleeves 204. In an embodiment, a length of the isolation gown 200 is configured to extend from a wearer's shoulders to below their knees.

In an embodiment, the fabric is a non-woven fabric configured to be tearable by a wearer. For example, the non-woven fabric may have a tensile strength of between four and ten pounds. Thus, if the wearer were to grasp opposing sides of a section of the non-woven fabric, and then pull with a force of between four and ten pounds, the fabric would tear.

In an embodiment, the sleeves 204 extend distally from the garment body 205 and are configured to receive arms of the wearer when the isolation gown 200 is donned. As in FIG. 2A, the sleeves 204 are illustrated as long sleeves, though it can be appreciated that any length sleeve can be used so long as required protection is provided.

In an embodiment, the isolation gown 200 may optionally include pockets or other surface features. For instance, a transparent covering may be affixed to a pocket on a surface of the isolation gown 200. The transparent covering, which will be described with respect to FIG. 3A through FIG. 3D, allows for viewing of printable material, such as a name tag or a mobile device, such as a smartphone.

In the illustrative embodiment of FIG. 2C, the garment body 205 includes, at a lower end, a body opening through which the body of the wearer can be introduced. In an embodiment, the body opening can be configured with a slit that runs a portion of a length of the garment body 205.

In an embodiment, and with particular reference to FIG. 2B, the isolation gown 200 is retained about the neck of the wearer by one or more restraining mechanisms 206. The one or more restraining mechanisms 206 may include an adjustable contracting mechanism having at least one actuatable portion 207 that allows for adjusting the one or more restraining mechanisms 206 between a contracted state that secures a neck opening of the isolation gown 200 to the neck of the wearer and an expanded state wherein the neck opening of the isolation gown 200 is large enough to allow the isolation gown 200 to be lifted over the head of the wearer and disposed or slipped to the floor around the body of the wearer and disposed. In an embodiment, the adjustable contracting mechanism may be a drawstring mechanism, a hook and loop mechanism, a button mechanism, a buckle mechanism, an elastic mechanism, and the like. In another embodiment, the adjustable contracting mechanism may be integrated with a powered air-purifying respirator (PAPR) system, and the contracted state and the expanded state of the adjustable contracting mechanism may be controlled by an amount of fluid from the PAPR system and within the one or more restraining mechanisms 206. In another embodiment, the adjustable contracting mechanism may include snap/press studs, safety pins, cuff links, brooches, zippers, metal hooks and eye, frog fasteners, toggle fasteners, snap hooks/clasps, grommets/eyelets, glass studs, cords and ropes, sliders, adhesives, clasps, squeeze buckles, and G-hooks, among others. In an example, the adjustable contracting mechanism may be a drawstring. The drawstring may include a cordlock in order to secure the neck opening in both of a contracted state and an expanded state. The drawstring may, alternatively, include imprints or depressions to allow for frictional securing of the drawstring within a hem of the neck opening in a contracted state and an expanded state. In another embodiment, the adjustable contracting mechanism may be a drawstring comprising elastic materials to allow the neck opening, without the aid of a locking mechanism, to be secured to the wearer in a contracted state and easily released from the wearer by expansion to an expanded state.

In an embodiment, the at least one actuatable portion 207 of the adjustable contracting mechanism of the one or more restraining mechanisms 206 may be positioned along a shoulder line of the wearer and proximate a glenohumeral joint of the wearer. In other embodiments, the at least one actuatable portion 207 may be arranged at another position accessible to the wearer. For instance, the at least one actuatable portion 207 may be arranged in front of the wearer so as to be visible and easily reached when the wearer wishes to doff the isolation gown 200.

In other embodiments, the at least one actuatable portion 207 may be more than one actuatable portion.

In an embodiment, the isolation gown 200 is retained about a midsection of the wearer by one or more restraining mechanisms 208. The one or more restraining mechanisms 208 may include an adjustable contracting mechanism having at least one actuatable portion 209 that allows for adjusting the one or more restraining mechanisms 208 between a contracted state that secures the garment body 205 of the isolation gown 200 to the midsection of the wearer and an expanded state wherein an area of the garment body 205 of the isolation gown 200 is large enough to allow the isolation gown 200 to be lifted over the head of the wearer or slipped to the floor around the body of the wearer. In an embodiment, the adjustable contracting mechanism may be a drawstring mechanism, a hook and loop mechanism, a button mechanism, a buckle mechanism, an elastic mechanism, and the like. In another embodiment, the adjustable contracting mechanism may include snap/press studs, safety pins, cuff links, brooches, zippers, metal hooks and eye, frog fasteners, toggle fasteners, snap hooks/clasps, grommets/eyelets, glass studs, cords and ropes, sliders, adhesives, clasps, squeeze buckles, and G-hooks, among others. In an example, the adjustable contracting mechanism may be a drawstring. The drawstring may include a cordlock in order to secure a midsection of the garment body in both of a contracted state and an expanded state. The drawstring may, alternatively, include imprints or depressions to allow for frictional securing of the drawstring within a hem of the midsection of the garment body in a contracted state and an expanded state. In another embodiment, the adjustable contracting mechanism may be a drawstring comprising elastic materials to allow the midsection of the garment body, without the aid of a locking mechanism, to be secured to the wearer in a contracted state and easily released from the wearer by expansion to an expanded state.

In an embodiment, the at least one actuatable portion 209 of the adjustable contracting mechanism of the one or more restraining mechanisms 208 may be positioned at a hip of the wearer. In other embodiments, the at least one actuatable portion 209 may be arranged at another position accessible to the wearer. The position of the at least one actuatable portion 209 as close to the hip ensures that the at least one actuatable portion 209 is accessible without interfering with a task that is front of the wearer. Moreover, positioning the at least one actuatable portion 209 as close to the hip allows the wearer to ensure, via proprioception and/or vision, that the expanded state of the one or more restraining mechanisms 208 is sufficient to allow the isolation gown 200 to be lifted over the shoulders and head of the wearer or to fall to the floor around the wearer.

In an embodiment, as in FIG. 2A through FIG. 2C, the at least one actuatable portion 209 may be two actuatable portions that allow for improved control of the one or more restraining mechanisms 208.

In an embodiment, the isolation gown 200 is retained about arms of the wearer by one or more restraining mechanisms 210. The one or more restraining mechanisms 210 may include an adjustable contracting mechanism having at least one actuatable portion 211 that allows for adjusting the one or more restraining mechanisms 210 between a contracted state that secures the sleeves 204 of the isolation gown 200 to the arms of the wearer and an expanded state wherein an opening of a distal end of the sleeves 204 of the isolation gown 200 is large enough to allow the sleeves 204 to slip over hands of the wearer. In an embodiment, the adjustable contracting mechanism may be a drawstring mechanism, a hook and loop mechanism, a button mechanism, a buckle mechanism, an elastic mechanism, and the like. In another embodiment, the adjustable contracting mechanism may include snap/press studs, safety pins, cuff links, brooches, zippers, metal hooks and eye, frog fasteners, toggle fasteners, snap hooks/clasps, grommets/eyelets, glass studs, cords and ropes, sliders, adhesives, clasps, squeeze buckles, and G-hooks, among others. In an example, the adjustable contracting mechanism may be a drawstring. The drawstring may include a cordlock in order to secure the sleeve opening in both of a contracted state and an expanded state. The drawstring may, alternatively, include imprints or depressions to allow for frictional securing of the drawstring within a hem of the sleeve opening in a contracted state and an expanded state. In another embodiment, the adjustable contracting mechanism may be a drawstring comprising elastic materials to allow the sleeve opening, without the aid of a locking mechanism, to be secured to the wearer in a contracted state and easily released from the wearer by expansion to an expanded state.

In an embodiment, the at least one actuatable portion 211 of the adjustable contracting mechanism of the one or more restraining mechanisms 210 may be positioned at wrists of the wearer. In other embodiments, the at least one actuatable portion 211 may be arranged at another position accessible to the wearer. The position of the at least one actuatable portion 211 as close to the wrists ensures that the one or more restraining mechanisms 210 are secured to the arms of the wearer such that contamination via the sleeves 204 is improbable.

In an embodiment, as in FIG. 2A through FIG. 2C, the at least one actuatable portion 211 may be two actuatable portions that allow for improved control of the one or more restraining mechanisms 210.

According to an embodiment, the sleeves 204 may include, at a distal end, one or more openings. An opening 212 of the one or more openings of the sleeves 204 may be configured to receive a thumb of the wearer. The opening 212, arranged at a distal end of the sleeves 204, secures the sleeves 204 relative to a hand of the wearer. As described above with regard to the one or more restraining mechanisms 210, the opening 212 improves contamination prevention.

According to an embodiment, each of the adjustable contracting mechanisms of the one or more restraining mechanisms 206, 208, 210, may be a drawstring tape paper as shown in FIG. 1C. The drawstring tape paper may have an actuatable portion that allows the drawstring tape paper to move from an expanded state to a contracted state, and vice versa.

In an embodiment, the isolation gown of the present disclosure includes a garment having one or a plurality of transparent windows affixed over a surface of the garment for viewing and interacting with electronic devices or printed materials. The plurality of transparent windows may include an opening such that the electronic devices or printed materials may be retained within a slot behind the transparent windows.

Accordingly, FIG. 3A through FIG. 3D provide illustrations of an isolation gown 300, according to an exemplary embodiment of the present disclosure. A body covering portion of the isolation gown 300, including a garment body 305 and sleeves 304, is configured to wrap about the torso of a wearer. In one embodiment, the medical gown 300 is manufactured from a non-woven fabric, a woven fabric, a non-woven synthetic, or a woven synthetic. The fabric can be a disposable material and, optionally, can include a fluid resistant lining that prevents the passage of fluids, such as water and bodily fluids, through the garment body 305 and/or the sleeves 304. In an embodiment, a length of the isolation gown 300 is configured to extend from a wearer's shoulders to below their knees.

In an embodiment, the fabric is a non-woven fabric configured to be tearable by a wearer. For example, the non-woven fabric may have a tensile strength of between four and ten pounds. Thus, if the wearer were to grasp opposing sides of a section of the non-woven fabric, and then pull with a force of between four and ten pounds, the fabric would tear.

In an embodiment, the sleeves 304 extend distally from the garment body 305 and are configured to receive arms of the wearer when the isolation gown 300 is donned. As in FIG. 3A, the sleeves 304 are illustrated as long sleeves, though it can be appreciated that any length sleeve can be used so long as required protection is provided.

In an embodiment, the isolation gown 300 may include one or more pockets. As in FIG. 3B, a front panel of a pocket 320 may be transparent. Thus, the front panel of the pocket 320 may be a transparent covering affixed to a surface of the isolation gown 300. In an example, the transparent pocket 320 may be a housing for a name tag, a mobile device, or other object. To this end, the transparent pocket 320 may be secured to the surface of the isolation gown 300 such that an object can be inserted into the transparent pocket 320 from a direction of the head of the wearer. In another example, the transparent pocket 320 may be secured to the surface of the isolation gown by hook and loop mechanism, or other releasable mechanism. In an event, the transparent pocket 320 allows for viewing of printable material, such as a name tag or a mobile device, such as a smartphone.

Figure 3A:
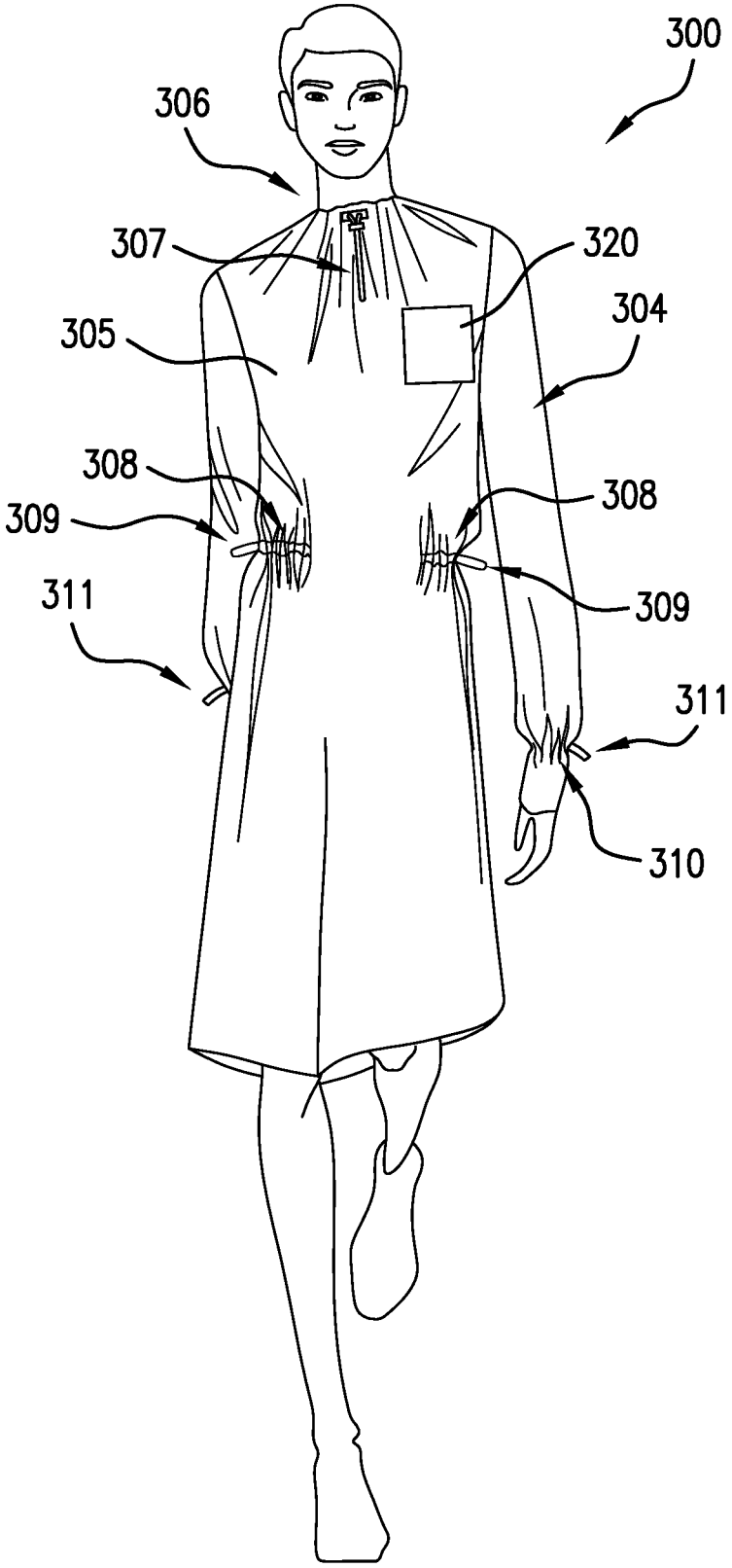
FIG. 3A is a stylized illustration of a wearer having donned a medical gown, according to an exemplary embodiment of the present disclosure.
Figure 3B:
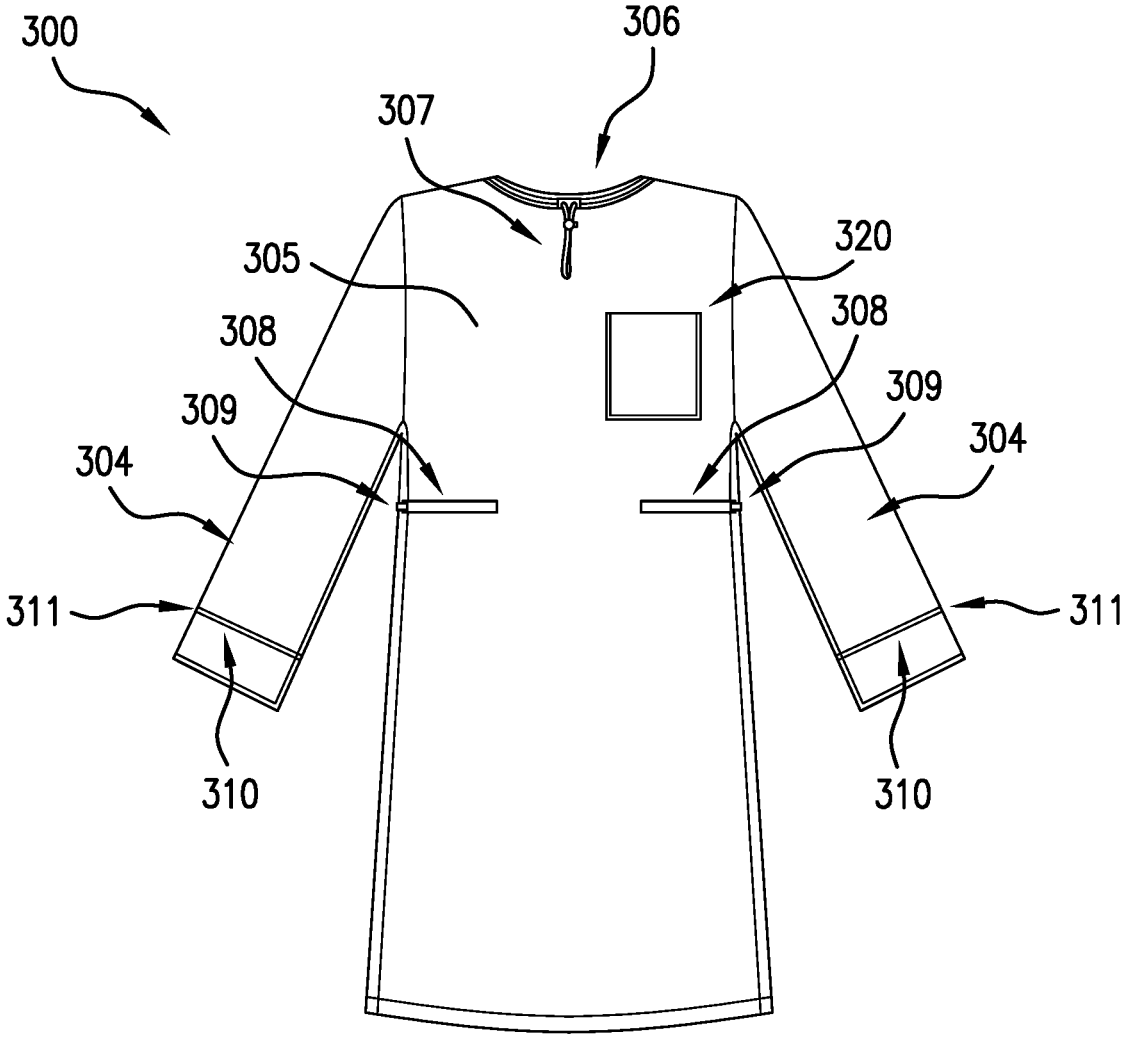
FIG. 3B is an illustration of a front view of a medical gown, according to an exemplary embodiment of the present disclosure.
Figure 3C:
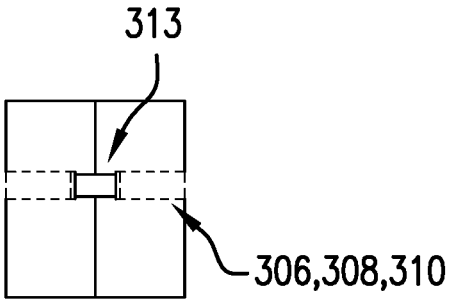
FIG. 3C is an illustration of an aspect of a medical gown, according to an exemplary embodiment of the present disclosure.
Figure 3D:
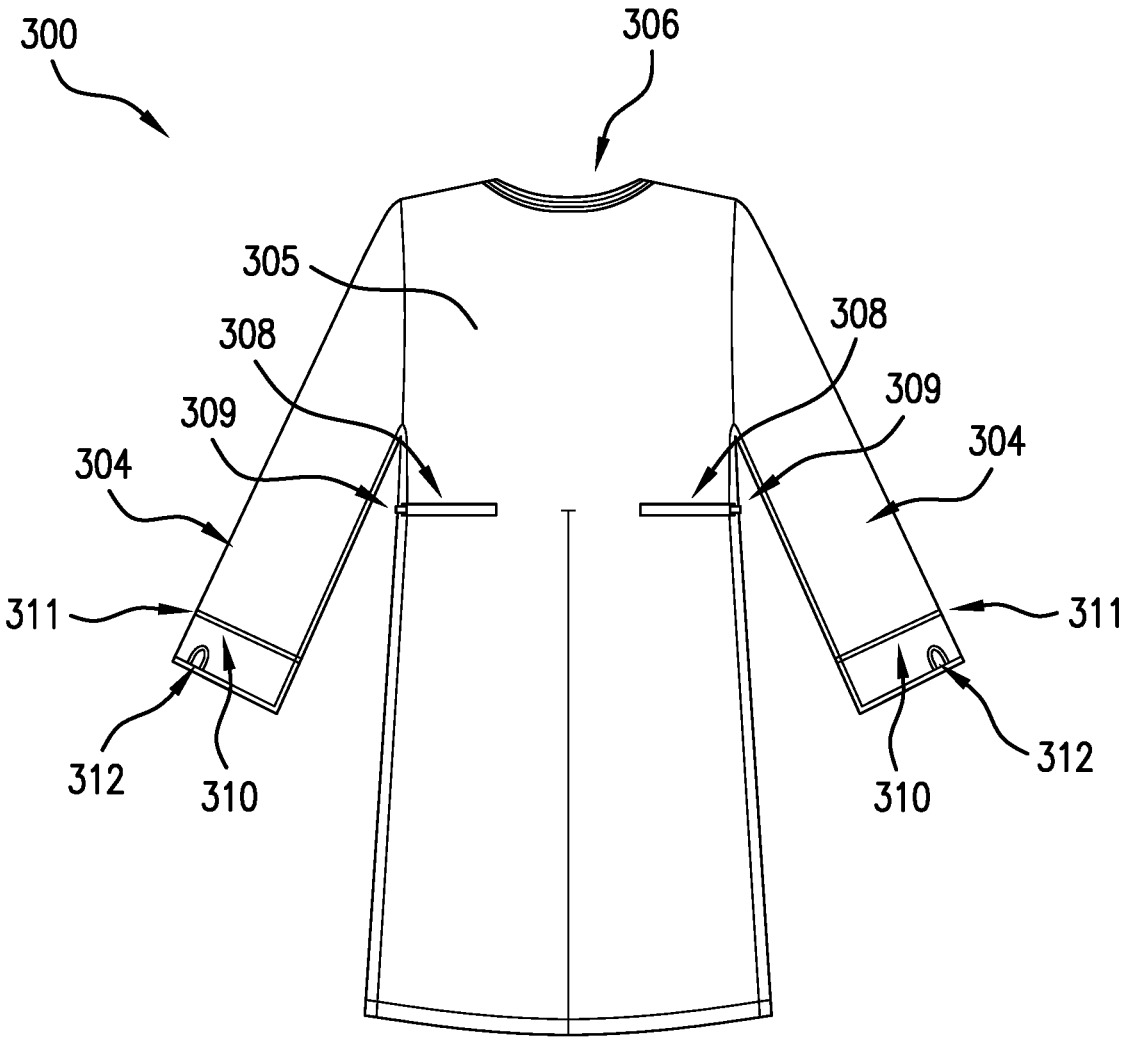
FIG. 3D is an illustration of a rear view of a medical gown, according to an exemplary embodiment of the present disclosure.

In the illustrative embodiment of FIG. 3D, the garment body 305 includes, at a lower end, a body opening through which the body of the wearer can be introduced. In an embodiment, the body opening can be configured with a slit that runs a portion of a length of the garment body 305.

In an embodiment, and with particular reference to FIG. 3B, the isolation gown 300 is retained about the neck of the wearer by one or more restraining mechanisms 306. The one or more restraining mechanisms 306 may include an adjustable contracting mechanism having at least one actuatable portion 307 that allows for adjusting the one or more restraining mechanisms 306 between a contracted state that secures a neck opening of the isolation gown 300 to the neck of the wearer and an expanded state wherein the neck opening of the isolation gown 300 is large enough to allow the isolation gown 300 to be lifted over the head of the wearer and disposed or slipped to the floor around the body of the wearer and disposed. In an embodiment, the adjustable contracting mechanism may be a drawstring mechanism, a hook and loop mechanism, a button mechanism, a buckle mechanism, an elastic mechanism, and the like. In another embodiment, the adjustable contracting mechanism may be integrated with a powered air-purifying respirator (PAPR) system, and the contracted state and the expanded state of the adjustable contracting mechanism may be controlled by an amount of fluid from the PAPR system and within the one or more restraining mechanisms 306. In another embodiment, the adjustable contracting mechanism may include snap/press studs, safety pins, cuff links, brooches, zippers, metal hooks and eye, frog fasteners, toggle fasteners, snap hooks/clasps, grommets/eyelets, glass studs, cords and ropes, sliders, adhesives, clasps, squeeze buckles, and G-hooks, among others. In an example, the adjustable contracting mechanism may be a drawstring. The drawstring may include a cordlock in order to secure the neck opening in both of a contracted state and an expanded state. The drawstring may, alternatively, include imprints or depressions to allow for frictional securing of the drawstring within a hem of the neck opening in a contracted state and an expanded state. In another embodiment, the adjustable contracting mechanism may be a drawstring comprising elastic materials to allow the neck opening, without the aid of a locking mechanism, to be secured to the wearer in a contracted state and easily released from the wearer by expansion to an expanded state.

In an embodiment, the at least one actuatable portion 307 of the adjustable contracting mechanism of the one or more restraining mechanisms 306 may be positioned along a shoulder line of the wearer and proximate a glenohumeral joint of the wearer. In other embodiments, the at least one actuatable portion 307 may be arranged at another position accessible to the wearer. For instance, the at least one actuatable portion 307 may be arranged in front of the wearer so as to be visible and easily reached when the wearer wishes to doff the isolation gown 300.

In other embodiments, the at least one actuatable portion 307 may be more than one actuatable portion.

In an embodiment, the isolation gown 300 is retained about a midsection of the wearer by one or more restraining mechanisms 308. The one or more restraining mechanisms 308 may include an adjustable contracting mechanism having at least one actuatable portion 309 that allows for adjusting the one or more restraining mechanisms 308 between a contracted state that secures the garment body 305 of the isolation gown 300 to the midsection of the wearer and an expanded state wherein an area of the garment body 305 of the isolation gown 300 is large enough to allow the isolation gown 300 to be lifted over the head of the wearer or slipped to the floor around the body of the wearer. In an embodiment, the adjustable contracting mechanism may be a drawstring mechanism, a hook and loop mechanism, a button mechanism, a buckle mechanism, an elastic mechanism, and the like. In another embodiment, the adjustable contracting mechanism may include snap/press studs, safety pins, cuff links, brooches, zippers, metal hooks and eye, frog fasteners, toggle fasteners, snap hooks/clasps, grommets/eyelets, glass studs, cords and ropes, sliders, adhesives, clasps, squeeze buckles, and G-hooks, among others. In an example, the adjustable contracting mechanism may be a drawstring. The drawstring may include a cordlock in order to secure a midsection of the garment body in both of a contracted state and an expanded state. The drawstring may, alternatively, include imprints or depressions to allow for frictional securing of the drawstring within a hem of the midsection of the garment body in a contracted state and an expanded state. In another embodiment, the adjustable contracting mechanism may be a drawstring comprising elastic materials to allow the midsection of the garment body, without the aid of a locking mechanism, to be secured to the wearer in a contracted state and easily released from the wearer by expansion to an expanded state.

In an embodiment, the at least one actuatable portion 309 of the adjustable contracting mechanism of the one or more restraining mechanisms 308 may be positioned at a hip of the wearer. In other embodiments, the at least one actuatable portion 309 may be arranged at another position accessible to the wearer. The position of the at least one actuatable portion 309 as close to the hip ensures that the at least one actuatable portion 309 is accessible without interfering with a task that is front of the wearer. Moreover, positioning the at least one actuatable portion 309 as close to the hip allows the wearer to ensure, via proprioception and/or vision, that the expanded state of the one or more restraining mechanisms 308 is sufficient to allow the isolation gown 300 to be lifted over the shoulders and head of the wearer or to fall to the floor around the wearer.

In an embodiment, as in FIG. 3A through FIG. 3D, the at least one actuatable portion 309 may be two actuatable portions that allow for improved control of the one or more restraining mechanisms 308.

In an embodiment, the isolation gown 300 is retained about arms of the wearer by one or more restraining mechanisms 310. The one or more restraining mechanisms 310 may include an adjustable contracting mechanism having at least one actuatable portion 311 that allows for adjusting the one or more restraining mechanisms 310 between a contracted state that secures the sleeves 304 of the isolation gown 300 to the arms of the wearer and an expanded state wherein an opening of a distal end of the sleeves 304 of the isolation gown 300 is large enough to allow the sleeves 304 to slip over hands of the wearer. In an embodiment, the adjustable contracting mechanism may be a drawstring mechanism, a hook and loop mechanism, a button mechanism, a buckle mechanism, an elastic mechanism, and the like. In another embodiment, the adjustable contracting mechanism may include snap/press studs, safety pins, cuff links, brooches, zippers, metal hooks and eye, frog fasteners, toggle fasteners, snap hooks/clasps, grommets/eyelets, glass studs, cords and ropes, sliders, adhesives, clasps, squeeze buckles, and G-hooks, among others. In an example, the adjustable contracting mechanism may be a drawstring. The drawstring may include a cordlock in order to secure the sleeve opening in both of a contracted state and an expanded state. The drawstring may, alternatively, include imprints or depressions to allow for frictional securing of the drawstring within a hem of the sleeve opening in a contracted state and an expanded state. In another embodiment, the adjustable contracting mechanism may be a drawstring comprising elastic materials to allow the sleeve opening, without the aid of a locking mechanism, to be secured to the wearer in a contracted state and easily released from the wearer by expansion to an expanded state.

In an embodiment, the at least one actuatable portion 311 of the adjustable contracting mechanism of the one or more restraining mechanisms 310 may be positioned at wrists of the wearer. In other embodiments, the at least one actuatable portion 311 may be arranged at another position accessible to the wearer. The position of the at least one actuatable portion 311 as close to the wrists ensures that the one or more restraining mechanisms 310 are secured to the arms of the wearer such that contamination via the sleeves 304 is improbable.

In an embodiment, the at least one actuatable portion 311 may be two actuatable portions that allow for improved control of the one or more restraining mechanisms 310.

According to an embodiment, the sleeves 304 may include, at a distal end, one or more openings. An opening 312 of the one or more openings of the sleeves 304 may be configured to receive a thumb of the wearer. The opening 312, arranged at a distal end of the sleeves 304, secures the sleeves 304 relative to a hand of the wearer. As described above with regard to the one or more restraining mechanisms 310, the opening 312 improves contamination prevention.

According to an embodiment, each of the adjustable contracting mechanisms of the one or more restraining mechanisms 306, 308, 310, may be a drawstring tape paper as shown in FIG. 3C. The drawstring tape paper may have an actuatable portion 313 that allows the drawstring tape paper to move from an expanded state to a contracted state, and vice versa.

Figure 4A:
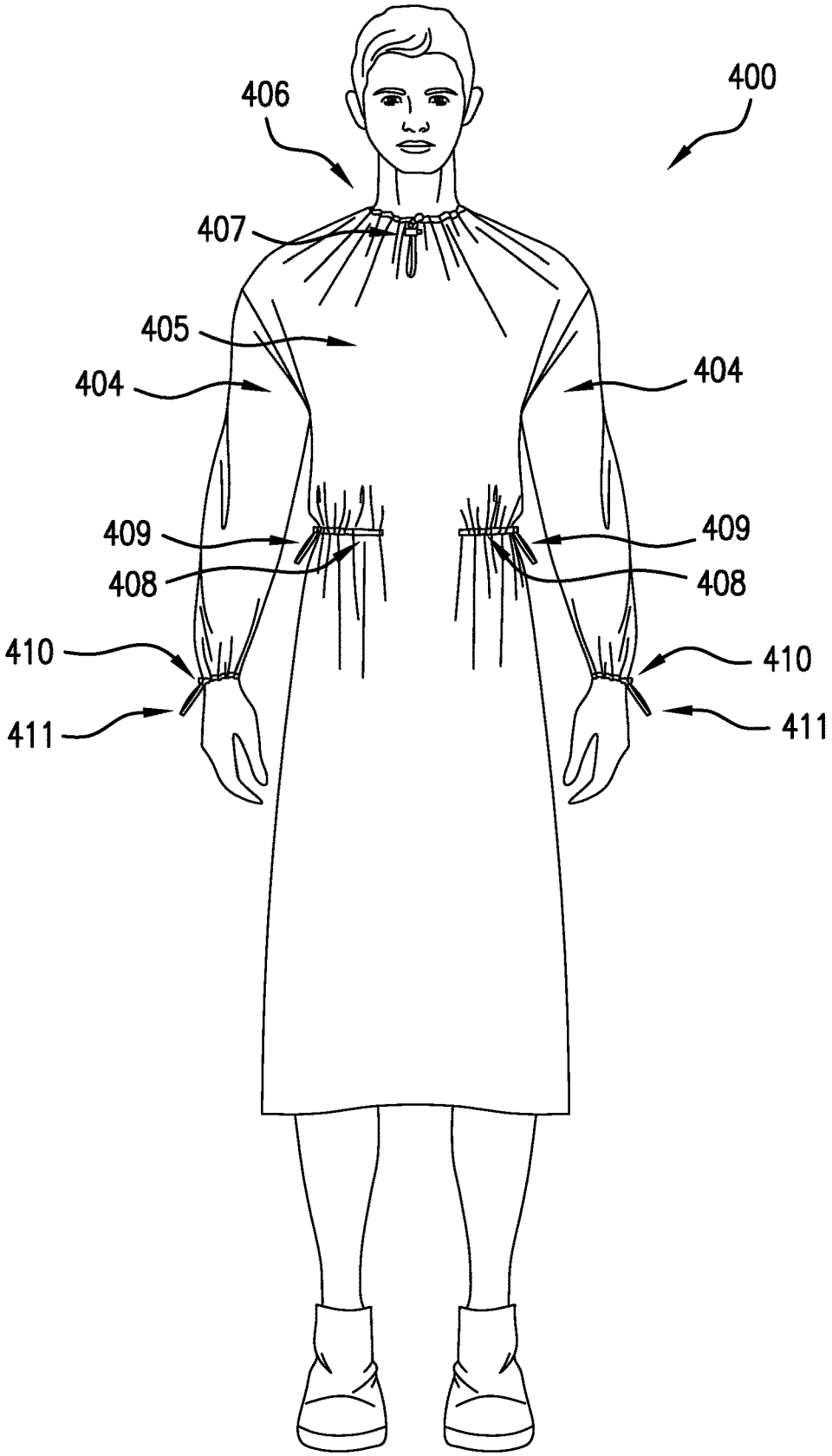
FIG. 4A is a stylized illustration of a wearer having donned a medical gown, according to an exemplary embodiment of the present disclosure.
Figure 4C:
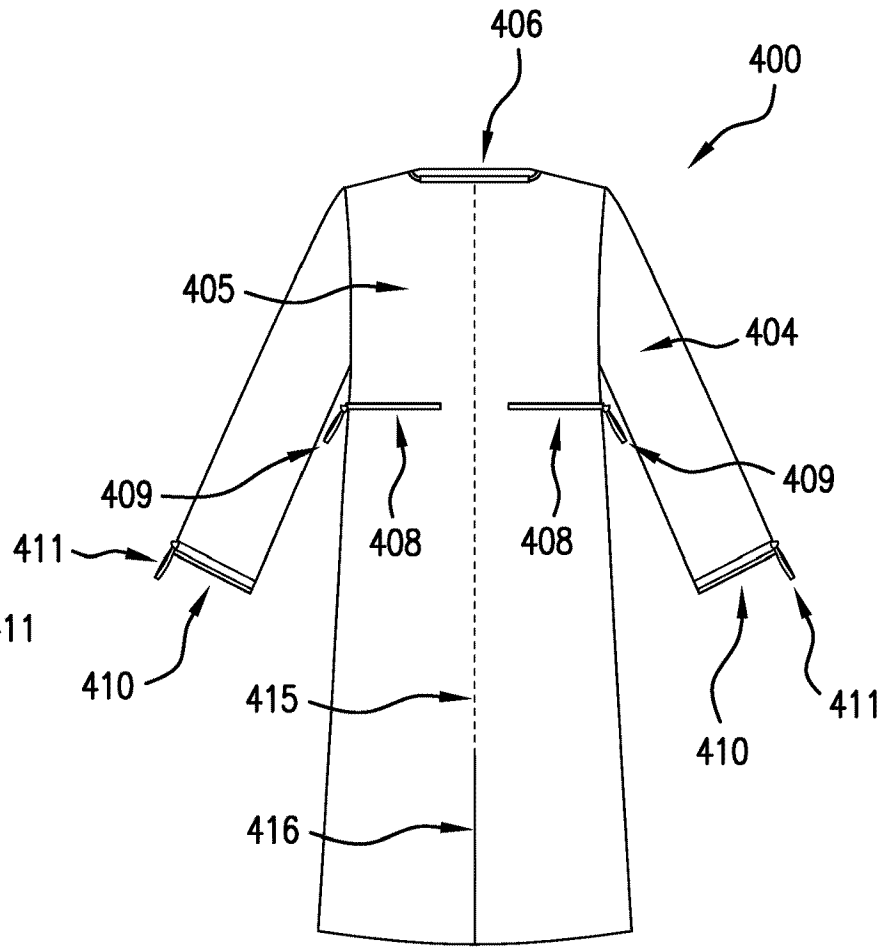
FIG. 4C is an illustration of a rear view of a medical gown, according to an exemplary embodiment of the present disclosure.
Figure 4B:
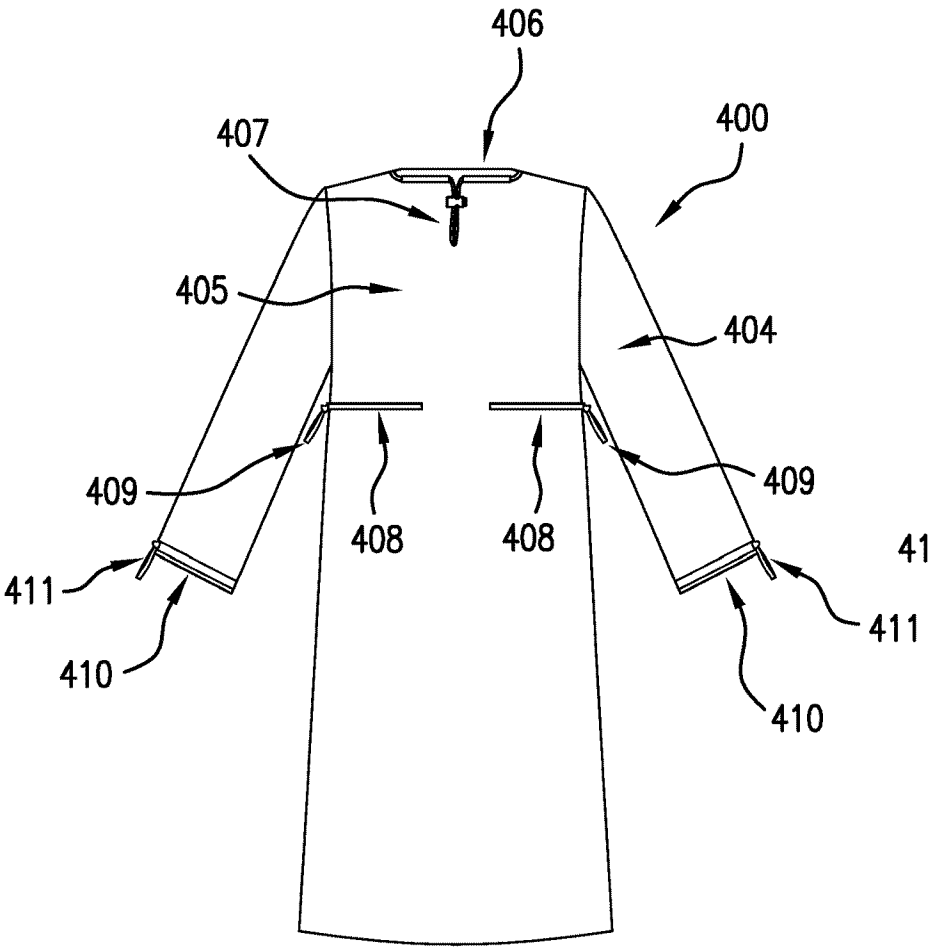
FIG. 4B is an illustration of a front view of a medical gown, according to an exemplary embodiment of the present disclosure.

FIG. 4A through FIG. 4C provide illustrations of an isolation gown 400, according to an exemplary embodiment of the present disclosure. A body covering portion of the isolation gown 400, including a garment body 405 and sleeves 404, is configured to wrap about the torso of a wearer. In one embodiment, the medical gown 400 is manufactured from a non-woven fabric, a woven fabric, a non-woven synthetic, or a woven synthetic. The fabric can be a disposable material and, optionally, can include a fluid resistant lining that prevents the passage of fluids, such as water and bodily fluids, through the garment body 405 and/or the sleeves 404. In an embodiment, a length of the isolation gown 400 is configured to extend from a wearer's shoulders to below their knees.

In an embodiment, the fabric is a non-woven fabric configured to be tearable by a wearer. For example, the non-woven fabric may have a tensile strength of between four and ten pounds. Thus, if the wearer were to grasp opposing sides of a section of the non-woven fabric, and then pull with a force of between four and ten pounds, the fabric would tear.

In an embodiment, the sleeves 404 extend distally from the garment body 405 and are configured to receive arms of the wearer when the isolation gown 400 is donned. As in FIG. 4A, the sleeves 404 are illustrated as long sleeves, though it can be appreciated that any length sleeve can be used so long as required protection is provided.

In the illustrative embodiment of FIG. 4A, the garment body 405 includes, at a lower end, a body opening through which the body of the wearer can be introduced. In an embodiment, the body opening can be configured with a slit that runs a portion of a length of the garment body 405.

In an embodiment, and with particular reference to FIG. 4B, the isolation gown 400 is retained about the neck of the wearer by one or more restraining mechanisms 406. The one or more restraining mechanisms 406 may include an adjustable contracting mechanism having at least one actuatable portion 407 that allows for adjusting the one or more restraining mechanisms 406 between a contracted state that secures a neck opening of the isolation gown 400 to the neck of the wearer and an expanded state wherein the neck opening of the isolation gown 400 is large enough to allow the isolation gown 400 to be lifted over the head of the wearer and disposed or slipped to the floor around the body of the wearer and disposed. In an embodiment, the adjustable contracting mechanism may be a drawstring mechanism, a hook and loop mechanism, a button mechanism, a buckle mechanism, an elastic mechanism, and the like. In another embodiment, the adjustable contracting mechanism may be integrated with a powered air-purifying respirator (PAPR) system, and the contracted state and the expanded state of the adjustable contracting mechanism may be controlled by an amount of fluid from the PAPR system and within the one or more restraining mechanisms 406. In another embodiment, the adjustable contracting mechanism may include snap/press studs, safety pins, cuff links, brooches, zippers, metal hooks and eye, frog fasteners, toggle fasteners, snap hooks/clasps, grommets/eyelets, glass studs, cords and ropes, sliders, adhesives, clasps, squeeze buckles, and G-hooks, among others. In an example, the adjustable contracting mechanism may be a drawstring. The drawstring may include a cordlock in order to secure the neck opening in both of a contracted state and an expanded state. The drawstring may, alternatively, include imprints or depressions to allow for frictional securing of the drawstring within a hem of the neck opening in a contracted state and an expanded state. In another embodiment, the adjustable contracting mechanism may be a drawstring comprising elastic materials to allow the neck opening, without the aid of a locking mechanism, to be secured to the wearer in a contracted state and easily released from the wearer by expansion to an expanded state.

In an embodiment, the at least one actuatable portion 407 of the adjustable contracting mechanism of the one or more restraining mechanisms 406 may be positioned along a shoulder line of the wearer and proximate a glenohumeral joint of the wearer. In other embodiments, the at least one actuatable portion 407 may be arranged at another position accessible to the wearer. For instance, the at least one actuatable portion 407 may be arranged in front of the wearer so as to be visible and easily reached when the wearer wishes to doff the isolation gown 400.

In one embodiment, the at least one actuatable portion 407 and the adjustable contracting mechanism may be arranged at a position to enable the garment body 405 to be expanded and/or opened while the neck opening is in a contracted state. For example, the garment body 405 may include a lengthwise perforated seam 415, as is illustrated in FIG. 4C and as will be discussed in further detail below. The garment body 405 may be torn along the perforated seam 415 in order to remove the isolation gown 400. In one embodiment, the perforated seam 415 may run through the neck opening. The at least one actuatable portion 407 and the adjustable contracting mechanism of the one more restraining mechanisms 406 may be positioned around the perforated seam 415 and/or without blocking the perforated seam 415 to enable the neck opening to be torn open along with the rest of the garment body 405. For example, the adjustable contracting mechanism may be a drawstring. The drawstring may be secured in a channel around the neck opening, wherein the channel does not intersect with or cross over the perforated seam 415. In one embodiment, the channel may be closed off on either side of the perforated seam 415 so that the perforated seam 415 may be torn without breaking the adjustable contracting mechanism. The at least one actuatable portion 407 may be positioned at the side of the neck opening, e.g., along the clavicle, so that the at least one actuatable portion 407 does not obstruct the perforated seam. The at least one actuatable portion 407 may still be used to adjust the adjustable contracting mechanism and contract and/or expand the entire neck opening in this position. This positioning may be advantageous in reducing the number of steps needed to doff the isolation gown 400 and reducing contact between the wearer's hands and areas close to the wearer's face after contamination. The isolation gown 400 may be removed by tearing the garment body 405 along the perforated seam 415 without actuating the at least one actuatable portion 407 or expanding the neck opening.

In other embodiments, the at least one actuatable portion 407 may be more than one actuatable portion.

In an embodiment, the isolation gown 400 is retained about a midsection of the wearer by one or more restraining mechanisms 408. The one or more restraining mechanisms 408 may include an adjustable contracting mechanism having at least one actuatable portion 409 that allows for adjusting the one or more restraining mechanisms 408 between a contracted state that secures the garment body 405 of the isolation gown 400 to the midsection of the wearer and an expanded state wherein an area of the garment body 405 of the isolation gown 400 is large enough to allow the isolation gown 400 to be lifted over the head of the wearer or slipped to the floor around the body of the wearer. In an embodiment, the adjustable contracting mechanism may be a drawstring mechanism, a hook and loop mechanism, a button mechanism, a buckle mechanism, an elastic mechanism, and the like. In another embodiment, the adjustable contracting mechanism may include snap/press studs, safety pins, cuff links, brooches, zippers, metal hooks and eye, frog fasteners, toggle fasteners, snap hooks/clasps, grommets/eyelets, glass studs, cords and ropes, sliders, adhesives, clasps, squeeze buckles, and G-hooks, among others. In an example, the adjustable contracting mechanism may be a drawstring. The drawstring may include a cordlock in order to secure a midsection of the garment body in both of a contracted state and an expanded state. The drawstring may, alternatively, include imprints or depressions to allow for frictional securing of the drawstring within a hem of the midsection of the garment body in a contracted state and an expanded state. In another embodiment, the adjustable contracting mechanism may be a drawstring comprising elastic materials to allow the midsection of the garment body, without the aid of a locking mechanism, to be secured to the wearer in a contracted state and easily released from the wearer by expansion to an expanded state.

In an embodiment, the at least one actuatable portion 409 of the adjustable contracting mechanism of the one or more restraining mechanisms 408 may be positioned at a hip of the wearer. In other embodiments, the at least one actuatable portion 409 may be arranged at another position accessible to the wearer. The position of the at least one actuatable portion 409 as close to the hip ensures that the at least one actuatable portion 409 is accessible without interfering with a task that is front of the wearer. Moreover, positioning the at least one actuatable portion 409 as close to the hip allows the wearer to ensure, via proprioception and/or vision, that the expanded state of the one or more restraining mechanisms 408 is sufficient to allow the isolation gown 400 to be lifted over the shoulders and head of the wearer or to fall to the floor around the wearer.

In an embodiment, as in FIG. 4A through FIG. 4D, the at least one actuatable portion 409 may be two actuatable portions that allow for improved control of the one or more restraining mechanisms 408.

In an embodiment, the isolation gown 400 is retained about arms of the wearer by one or more restraining mechanisms 410. The one or more restraining mechanisms 410 may include an adjustable contracting mechanism having at least one actuatable portion 411 that allows for adjusting the one or more restraining mechanisms 410 between a contracted state that secures the sleeves 404 of the isolation gown 400 to the arms of the wearer and an expanded state wherein an opening of a distal end of the sleeves 404 of the isolation gown 400 is large enough to allow the sleeves 404 to slip over hands of the wearer. In an embodiment, the adjustable contracting mechanism may be a drawstring mechanism, a hook and loop mechanism, a button mechanism, a buckle mechanism, an elastic mechanism, and the like. In another embodiment, the adjustable contracting mechanism may include snap/press studs, safety pins, cuff links, brooches, zippers, metal hooks and eye, frog fasteners, toggle fasteners, snap hooks/clasps, grommets/eyelets, glass studs, cords and ropes, sliders, adhesives, clasps, squeeze buckles, and G-hooks, among others. In an example, the adjustable contracting mechanism may be a drawstring. The drawstring may include a cordlock in order to secure the sleeve opening in both of a contracted state and an expanded state. The drawstring may, alternatively, include imprints or depressions to allow for frictional securing of the drawstring within a hem of the sleeve opening in a contracted state and an expanded state. In another embodiment, the adjustable contracting mechanism may be a drawstring comprising elastic materials to allow the sleeve opening, without the aid of a locking mechanism, to be secured to the wearer in a contracted state and easily released from the wearer by expansion to an expanded state.

In an embodiment, the at least one actuatable portion 411 of the adjustable contracting mechanism of the one or more restraining mechanisms 410 may be positioned at wrists of the wearer. In other embodiments, the at least one actuatable portion 411 may be arranged at another position accessible to the wearer. The position of the at least one actuatable portion 411 as close to the wrists ensures that the one or more restraining mechanisms 410 are secured to the arms of the wearer such that contamination via the sleeves 404 is improbable.

In an embodiment, at least one actuatable portion 411 may be two actuatable portions that allow for improved control of the one or more restraining mechanisms 410.

According to an embodiment, each of the adjustable contracting mechanisms of the one or more restraining mechanisms 406, 408, 410, may be a drawstring tape paper. The drawstring tape paper may have an actuatable portion that allows the drawstring tape paper to move from an expanded state to a contracted state, and vice versa.

According to one embodiment, as illustrated in FIG. 4C, the isolation gown 400 may include a perforated seam 415. In one embodiment, the perforated seam 415 may start at an opening of the garment body 405 of the isolation gown 400. For example, the perforated seam 415 may start at a neck opening or at a base of the garment body 405. The perforated seam 415 may run down the back of the garment body 405 or a portion of the back of the garment body 405. The perforations enable expansion of the garment body 405 of the isolation gown 400. In one embodiment, the isolation gown 400 may be torn open along the perforated seam 415 with less force than would be needed to tear open an unperforated isolation gown along the same location. A wearer may thus apply less force to either side of the perforated seam 415 to expand the garment body 405 for removal of the isolation gown 400. However, the perforated seam 415 may remain intact when force is not applied to the garment body 405. In one embodiment, as illustrated in FIG. 4C, the perforated seam 415 may end in a slit 416 that runs a portion of the length of the garment body 405. In one embodiment, as further illustrated in FIG. 4C, the perforated seam 415 may end approximately at the knees of the wearer. In one embodiment, the perforated seam 415 may be located on the front of the garment body 405. In another embodiment, the perforated seam 415 may be located along a side of the garment body 405. The isolation gown 400 may include multiple perforated seams.

In one embodiment, the perforated seam 415 may terminate at an opening of the garment body 405, e.g., a neck opening. In one embodiment, tearing open the perforated seam 415 may also result in the opening of the garment body 405 also being torn open. In another embodiment, the perforated seam 415 may terminate before the opening of the garment body 405. The opening may remain closed even when the perforated seam 415 is broken.

Figure 4D:
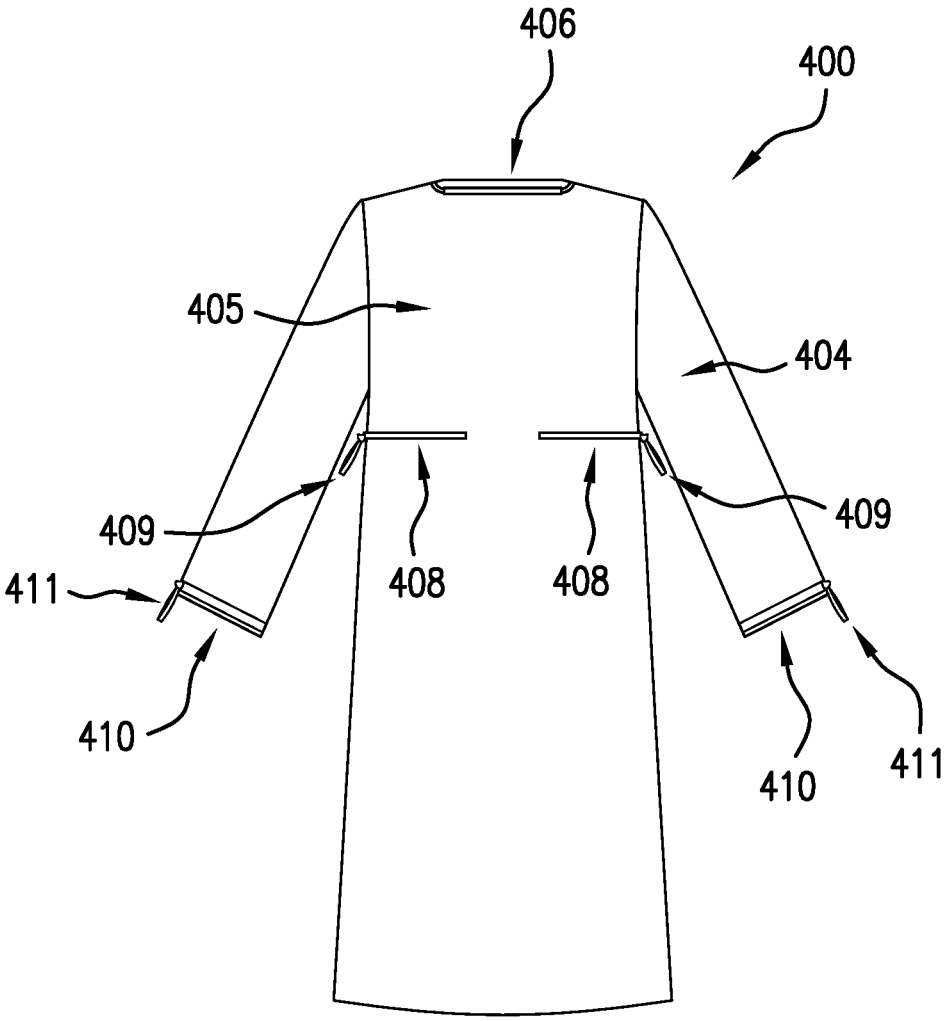
FIG. 4D is an illustration of a rear view of a medical gown, according to an exemplary embodiment of the present disclosure.

In another embodiment, as illustrated in FIG. 4D, the garment body 405 may not include a perforated seam.

Figure 5A:
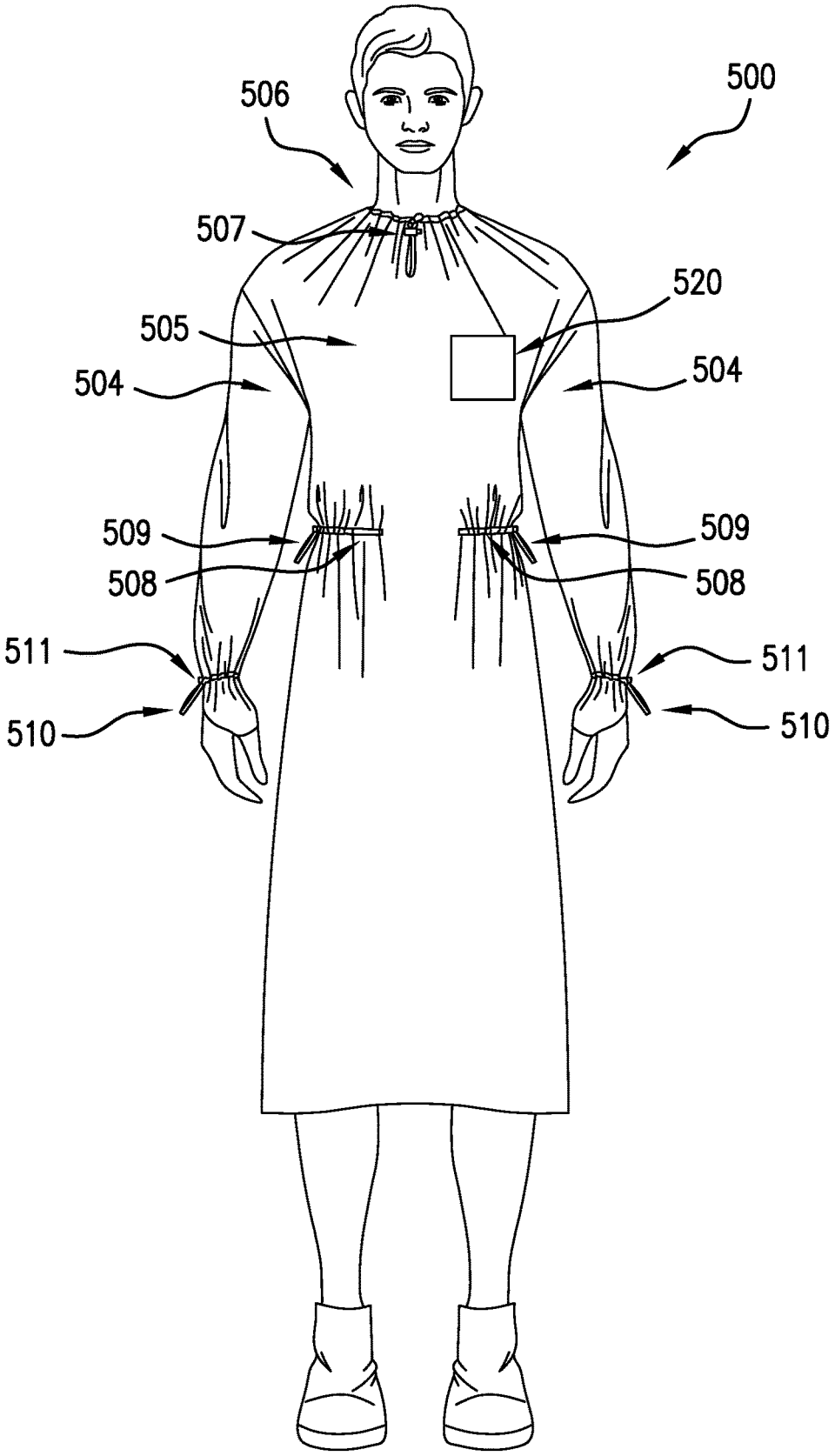
FIG. 5A is a stylized illustration of a wearer having donned a medical gown, according to an exemplary embodiment of the present disclosure.
Figure 5C:
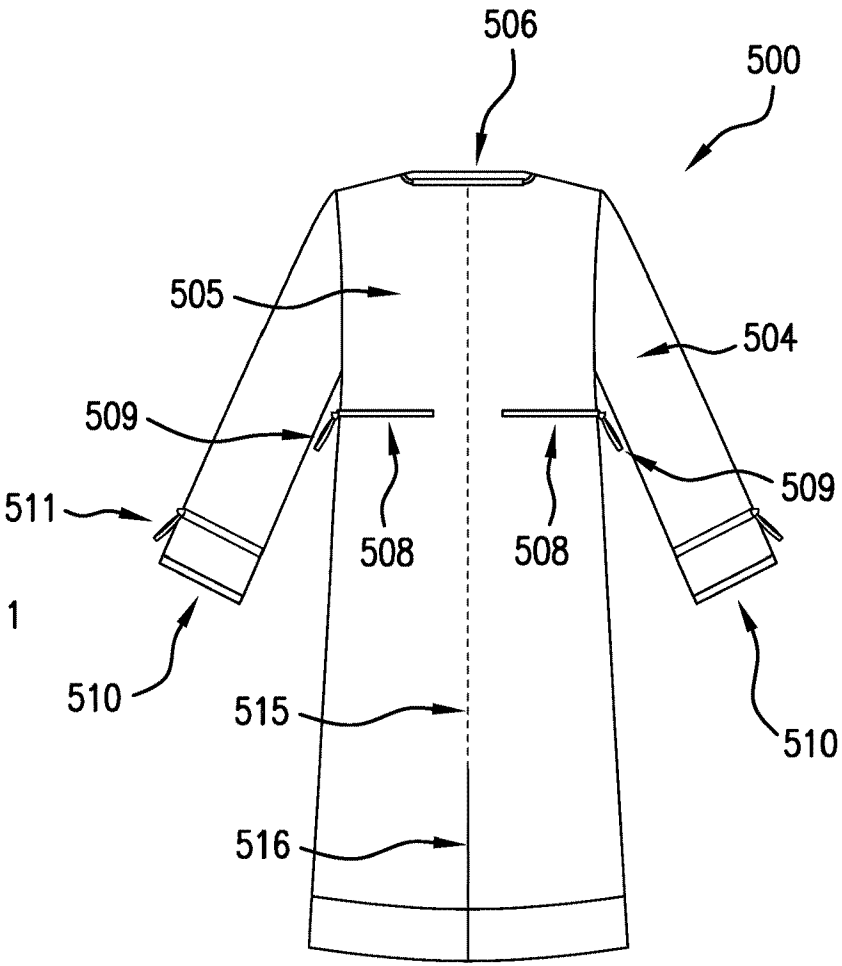
FIG. 5C is an illustration of a rear view of a medical gown, according to an exemplary embodiment of the present disclosure.
Figure 5B:
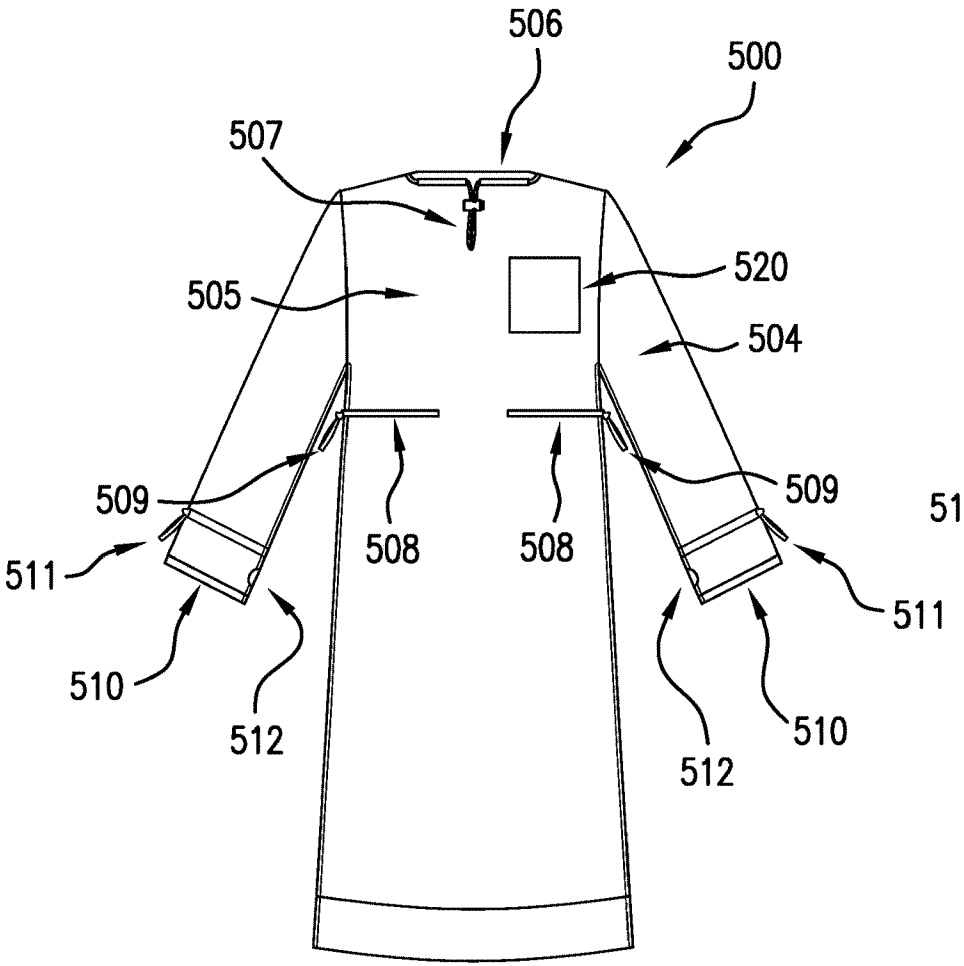
FIG. 5B is an illustration of a front view of a medical gown, according to an exemplary embodiment of the present disclosure.

FIG. 5A through FIG. 5C provide illustrations of an isolation gown 500, according to an exemplary embodiment of the present disclosure. A body covering portion of the isolation gown 500, including a garment body 505 and sleeves 504, is configured to wrap about the torso of a wearer. In one embodiment, the medical gown 500 is manufactured from a non-woven fabric, a woven fabric, a non-woven synthetic, or a woven synthetic. The fabric can be a disposable material and, optionally, can include a fluid resistant lining that prevents the passage of fluids, such as water and bodily fluids, through the garment body 505 and/or the sleeves 504. In an embodiment, a length of the isolation gown 500 is configured to extend from a wearer's shoulders to below their knees.

In an embodiment, the fabric is a non-woven fabric configured to be tearable by a wearer. For example, the non-woven fabric may have a tensile strength of between four and ten pounds. Thus, if the wearer were to grasp opposing sides of a section of the non-woven fabric, and then pull with a force of between four and ten pounds, the fabric would tear.

In an embodiment, the sleeves 504 extend distally from the garment body 505 and are configured to receive arms of the wearer when the isolation gown 500 is donned. As in FIG. 5A, the sleeves 504 are illustrated as long sleeves, though it can be appreciated that any length sleeve can be used so long as required protection is provided.

In the illustrative embodiment of FIG. 5A, the garment body 505 includes, at a lower end, a body opening through which the body of the wearer can be introduced. In an embodiment, the body opening can be configured with a slit that runs a portion of a length of the garment body 505.

In an embodiment, the isolation gown 500 may include one or more pockets. As in FIGS. 5A and 5B, a front panel of a pocket 520 may be transparent. Thus, the front panel of the pocket 520 may be a transparent covering affixed to a surface of the isolation gown 500. In an example, the transparent pocket 520 may be a housing for a name tag, a mobile device, or other object. To this end, the transparent pocket 520 may be secured to the surface of the isolation gown 500 such that an object can be inserted into the transparent pocket 520 from a direction of the head of the wearer. In another example, the transparent pocket 520 may be secured to the surface of the isolation gown by hook and loop mechanism, or other releasable mechanism. In an event, the transparent pocket 520 allows for viewing of printable material, such as a name tag or a mobile device, such as a smartphone.

In an embodiment, and with particular reference to FIG. 5B, the isolation gown 500 is retained about the neck of the wearer by one or more restraining mechanisms 506. The one or more restraining mechanisms 506 may include an adjustable contracting mechanism having at least one actuatable portion 507 that allows for adjusting the one or more restraining mechanisms 506 between a contracted state that secures a neck opening of the isolation gown 500 to the neck of the wearer and an expanded state wherein the neck opening of the isolation gown 500 is large enough to allow the isolation gown 500 to be lifted over the head of the wearer and disposed or slipped to the floor around the body of the wearer and disposed. In an embodiment, the adjustable contracting mechanism may be a drawstring mechanism, a hook and loop mechanism, a button mechanism, a buckle mechanism, an elastic mechanism, and the like. In another embodiment, the adjustable contracting mechanism may be integrated with a powered air-purifying respirator (PAPR) system, and the contracted state and the expanded state of the adjustable contracting mechanism may be controlled by an amount of fluid from the PAPR system and within the one or more restraining mechanisms 506. In another embodiment, the adjustable contracting mechanism may include snap/press studs, safety pins, cuff links, brooches, zippers, metal hooks and eye, frog fasteners, toggle fasteners, snap hooks/clasps, grommets/eyelets, glass studs, cords and ropes, sliders, adhesives, clasps, squeeze buckles, and G-hooks, among others. In an example, the adjustable contracting mechanism may be a drawstring. The drawstring may include a cordlock in order to secure the neck opening in both of a contracted state and an expanded state. The drawstring may, alternatively, include imprints or depressions to allow for frictional securing of the drawstring within a hem of the neck opening in a contracted state and an expanded state. In another embodiment, the adjustable contracting mechanism may be a drawstring comprising elastic materials to allow the neck opening, without the aid of a locking mechanism, to be secured to the wearer in a contracted state and easily released from the wearer by expansion to an expanded state.

In an embodiment, the at least one actuatable portion 507 of the adjustable contracting mechanism of the one or more restraining mechanisms 506 may be positioned along a shoulder line of the wearer and proximate a glenohumeral joint of the wearer. In other embodiments, the at least one actuatable portion 507 may be arranged at another position accessible to the wearer. For instance, the at least one actuatable portion 507 may be arranged in front of the wearer so as to be visible and easily reached when the wearer wishes to doff the isolation gown 500.

In other embodiments, the at least one actuatable portion 507 may be more than one actuatable portion.

In an embodiment, the isolation gown 500 is retained about a midsection of the wearer by one or more restraining mechanisms 508. The one or more restraining mechanisms 508 may include an adjustable contracting mechanism having at least one actuatable portion 509 that allows for adjusting the one or more restraining mechanisms 508 between a contracted state that secures the garment body 505 of the isolation gown 500 to the midsection of the wearer and an expanded state wherein an area of the garment body 505 of the isolation gown 500 is large enough to allow the isolation gown 500 to be lifted over the head of the wearer or slipped to the floor around the body of the wearer. In an embodiment, the adjustable contracting mechanism may be a drawstring mechanism, a hook and loop mechanism, a button mechanism, a buckle mechanism, an elastic mechanism, and the like. In another embodiment, the adjustable contracting mechanism may include snap/press studs, safety pins, cuff links, brooches, zippers, metal hooks and eye, frog fasteners, toggle fasteners, snap hooks/clasps, grommets/eyelets, glass studs, cords and ropes, sliders, adhesives, clasps, squeeze buckles, and G-hooks, among others. In an example, the adjustable contracting mechanism may be a drawstring. The drawstring may include a cordlock in order to secure a midsection of the garment body in both of a contracted state and an expanded state. The drawstring may, alternatively, include imprints or depressions to allow for frictional securing of the drawstring within a hem of the midsection of the garment body in a contracted state and an expanded state. In another embodiment, the adjustable contracting mechanism may be a drawstring comprising elastic materials to allow the midsection of the garment body, without the aid of a locking mechanism, to be secured to the wearer in a contracted state and easily released from the wearer by expansion to an expanded state.

In an embodiment, the at least one actuatable portion 509 of the adjustable contracting mechanism of the one or more restraining mechanisms 508 may be positioned at a hip of the wearer. In other embodiments, the at least one actuatable portion 509 may be arranged at another position accessible to the wearer. The position of the at least one actuatable portion 509 as close to the hip ensures that the at least one actuatable portion 509 is accessible without interfering with a task that is front of the wearer. Moreover, positioning the at least one actuatable portion 509 as close to the hip allows the wearer to ensure, via proprioception and/or vision, that the expanded state of the one or more restraining mechanisms 508 is sufficient to allow the isolation gown 500 to be lifted over the shoulders and head of the wearer or to fall to the floor around the wearer.

In an embodiment, as in FIG. 5A through FIG. 5C, the at least one actuatable portion 509 may be two actuatable portions that allow for improved control of the one or more restraining mechanisms 508.

In an embodiment, the isolation gown 500 is retained about arms of the wearer by one or more restraining mechanisms 510. The one or more restraining mechanisms 510 may include an adjustable contracting mechanism having at least one actuatable portion 511 that allows for adjusting the one or more restraining mechanisms 510 between a contracted state that secures the sleeves 504 of the isolation gown 500 to the arms of the wearer and an expanded state wherein an opening of a distal end of the sleeves 504 of the isolation gown 500 is large enough to allow the sleeves 504 to slip over hands of the wearer. In an embodiment, the adjustable contracting mechanism may be a drawstring mechanism, a hook and loop mechanism, a button mechanism, a buckle mechanism, an elastic mechanism, and the like. In another embodiment, the adjustable contracting mechanism may include snap/press studs, safety pins, cuff links, brooches, zippers, metal hooks and eye, frog fasteners, toggle fasteners, snap hooks/clasps, grommets/eyelets, glass studs, cords and ropes, sliders, adhesives, clasps, squeeze buckles, and G-hooks, among others. In an example, the adjustable contracting mechanism may be a drawstring. The drawstring may include a cordlock in order to secure the sleeve opening in both of a contracted state and an expanded state. The drawstring may, alternatively, include imprints or depressions to allow for frictional securing of the drawstring within a hem of the sleeve opening in a contracted state and an expanded state. In another embodiment, the adjustable contracting mechanism may be a drawstring comprising elastic materials to allow the sleeve opening, without the aid of a locking mechanism, to be secured to the wearer in a contracted state and easily released from the wearer by expansion to an expanded state.

In an embodiment, the at least one actuatable portion 511 of the adjustable contracting mechanism of the one or more restraining mechanisms 510 may be positioned at wrists of the wearer. In other embodiments, the at least one actuatable portion 511 may be arranged at another position accessible to the wearer. The position of the at least one actuatable portion 511 as close to the wrists ensures that the one or more restraining mechanisms 510 are secured to the arms of the wearer such that contamination via the sleeves 504 is improbable.

In an embodiment, the at least one actuatable portion 511 may be two actuatable portions that allow for improved control of the one or more restraining mechanisms 510.

According to an embodiment, the sleeves 504 may include, at a distal end, one or more openings. An opening 512 of the one or more openings of the sleeves 504 may be configured to receive a thumb of the wearer. The opening 512, arranged at a distal end of the sleeves 504, secures the sleeves 504 relative to a hand of the wearer. As described above with regard to the one or more restraining mechanisms 510, the opening 512 improves contamination prevention.

According to an embodiment, each of the adjustable contracting mechanisms of the one or more restraining mechanisms 506, 508, 510, may be a drawstring tape paper. The drawstring tape paper may have an actuatable portion that allows the drawstring tape paper to move from an expanded state to a contracted state, and vice versa.

According to one embodiment, as illustrated in FIG. 5C, the isolation gown 500 may include a perforated seam 515. In one embodiment, the perforated seam 515 may start at an opening of the garment body 505 of the isolation gown 500. For example, the perforated seam 515 may start at a neck opening or at a base of the garment body 505. The perforated seam 515 may run down the back of the garment body 505 or a portion of the back of the garment body 505. The perforations enable expansion of the garment body 505 of the isolation gown 500. In one embodiment, the isolation gown 500 may be torn open along the perforated seam 515 with less force than would be needed to tear open an unperforated isolation gown along the same location. A wearer may thus apply less force to either side of the perforated seam 515 to expand the garment body 505 for removal of the isolation gown 500. However, the perforated seam 515 may remain intact when force is not applied to the garment body 505. In one embodiment, as illustrated in FIG. 5C, the perforated seam 515 may end in a slit 516 that runs a portion of the length of the garment body 505. In one embodiment, as further illustrated in FIG. 5C, the perforated seam 515 may end approximately at the knees of the wearer. In one embodiment, the perforated seam 515 may be located on the front of the garment body 505. In another embodiment, the perforated seam 515 may be located along a side of the garment body 505. The isolation gown 500 may include multiple perforated seams.

In one embodiment, the perforated seam 515 may terminate at an opening of the garment body 505, e.g., a neck opening. In one embodiment, tearing open the perforated seam 515 may also result in the opening of the garment body 505 also being torn open. In another embodiment, the perforated seam 515 may terminate before the opening of the garment body 505. The opening will remain closed even when the perforated seam 515 is broken.

Figure 6A:
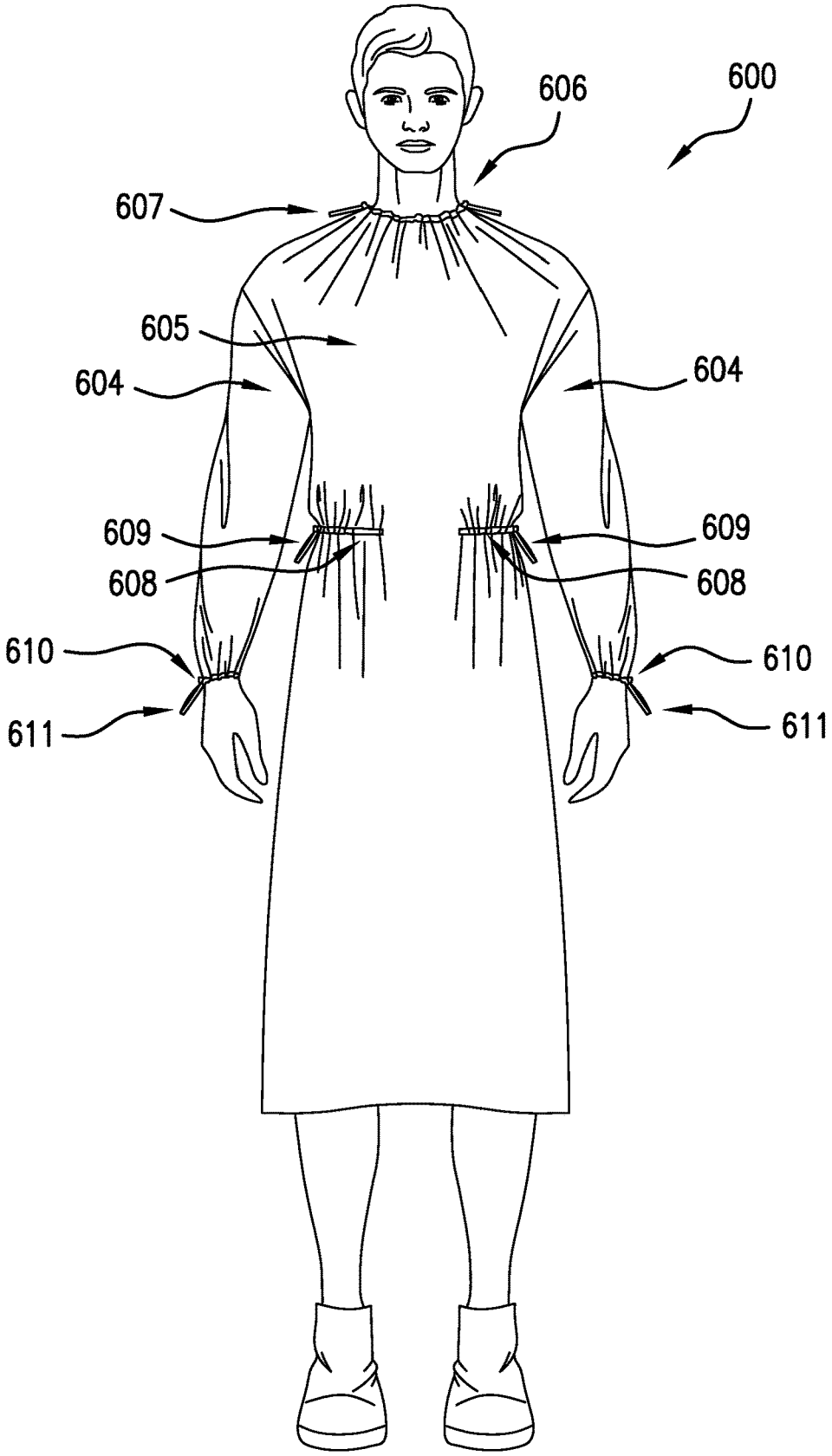
FIG. 6A is a stylized illustration of a wearer having donned a medical gown, according to an exemplary embodiment of the present disclosure.
Figure 6C:
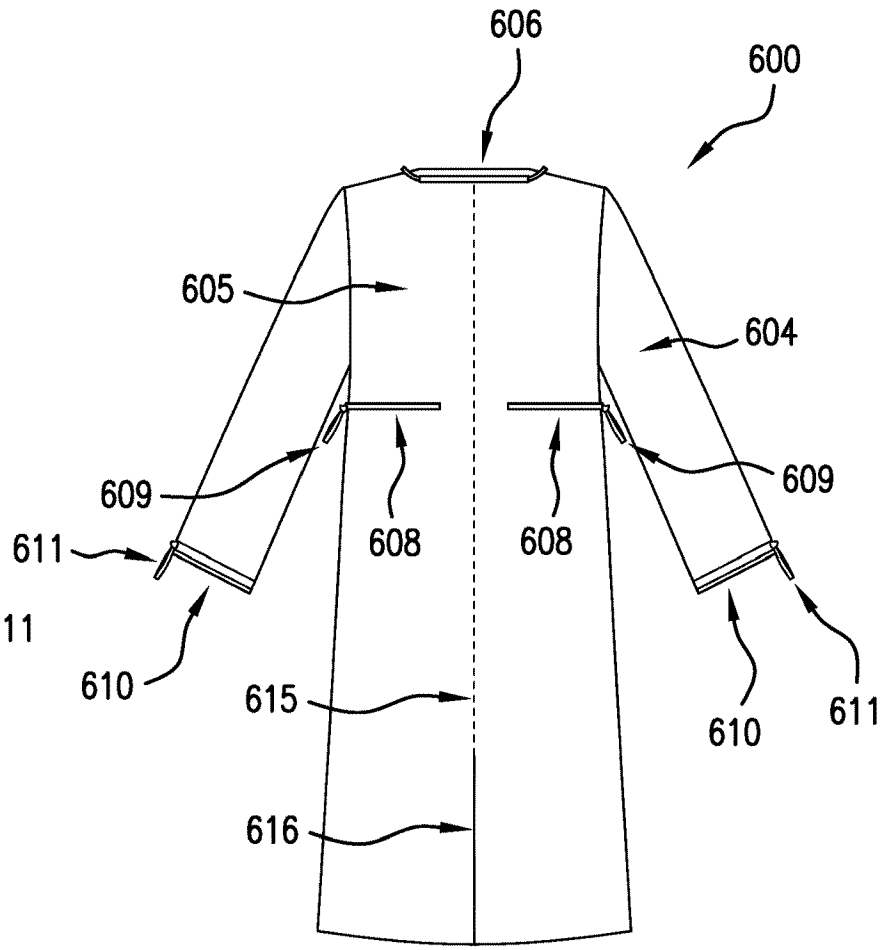
FIG. 6C is an illustration of a rear view of a medical gown, according to an exemplary embodiment of the present disclosure.
Figure 6B:
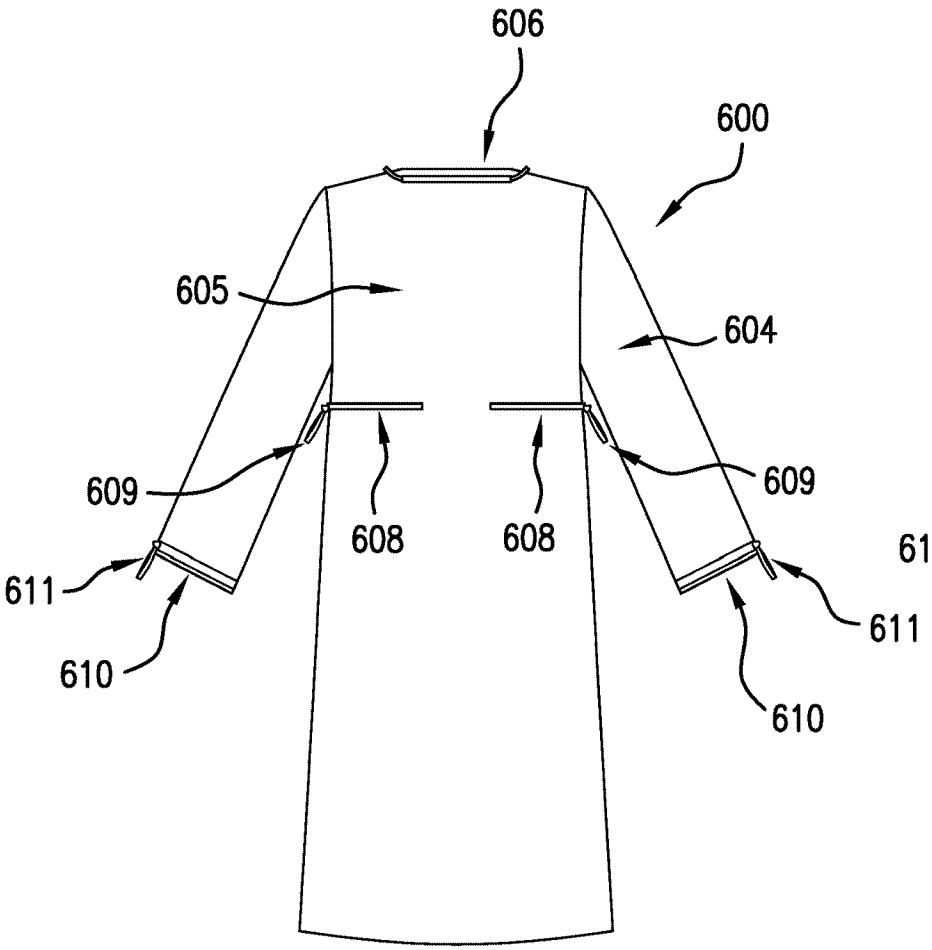
FIG. 6B is an illustration of a front view of a medical gown, according to an exemplary embodiment of the present disclosure.

FIG. 6A through 6C provide illustrations of an isolation gown 600, according to an exemplary embodiment of the present disclosure. A body covering portion of the isolation gown 600, including a garment body 605 and sleeves 604, is configured to wrap about the torso of a wearer. In one embodiment, the medical gown 600 is manufactured from a non-woven fabric, a woven fabric, a non-woven synthetic, or a woven synthetic. The fabric can be a disposable material and, optionally, can include a fluid resistant lining that prevents the passage of fluids, such as water and bodily fluids, through the garment body 605 and/or the sleeves 604. In an embodiment, a length of the isolation gown 600 is configured to extend from a wearer's shoulders to below their knees.

In an embodiment, the fabric is a non-woven fabric configured to be tearable by a wearer. For example, the non-woven fabric may have a tensile strength of between four and ten pounds. Thus, if the wearer were to grasp opposing sides of a section of the non-woven fabric, and then pull with a force of between four and ten pounds, the fabric would tear.

In an embodiment, the sleeves 604 extend distally from the garment body 605 and are configured to receive arms of the wearer when the isolation gown 600 is donned. As in FIG. 6A, the sleeves 604 are illustrated as long sleeves, though it can be appreciated that any length sleeve can be used so long as required protection is provided. In an embodiment, the isolation gown 600 may include one or more pockets.

In the illustrative embodiment of FIG. 6A, the garment body 605 includes, at a lower end, a body opening through which the body of the wearer can be introduced. In an embodiment, the body opening can be configured with a slit that runs a portion of a length of the garment body 605.

In an embodiment, and with particular reference to FIG. 6B, the isolation gown 600 is retained about the neck of the wearer by one or more restraining mechanisms 606. The one or more restraining mechanisms 606 may include an adjustable contracting mechanism having at least one actuatable portion 607 that allows for adjusting the one or more restraining mechanisms 606 between a contracted state that secures a neck opening of the isolation gown 600 to the neck of the wearer and an expanded state wherein the neck opening of the isolation gown 600 is large enough to allow the isolation gown 600 to be lifted over the head of the wearer and disposed or slipped to the floor around the body of the wearer and disposed. In an embodiment, the adjustable contracting mechanism may be a drawstring mechanism, a hook and loop mechanism, a button mechanism, a buckle mechanism, an elastic mechanism, and the like. In another embodiment, the adjustable contracting mechanism may be integrated with a powered air-purifying respirator (PAPR) system, and the contracted state and the expanded state of the adjustable contracting mechanism may be controlled by an amount of fluid from the PAPR system and within the one or more restraining mechanisms 606. In another embodiment, the adjustable contracting mechanism may include snap/press studs, safety pins, cuff links, brooches, zippers, metal hooks and eye, frog fasteners, toggle fasteners, snap hooks/clasps, grommets/eyelets, glass studs, cords and ropes, sliders, adhesives, clasps, squeeze buckles, and G-hooks, among others. In an example, the adjustable contracting mechanism may be a drawstring. The drawstring may include a cordlock in order to secure the neck opening in both of a contracted state and an expanded state. The drawstring may, alternatively, include imprints or depressions to allow for frictional securing of the drawstring within a hem of the neck opening in a contracted state and an expanded state. In another embodiment, the adjustable contracting mechanism may be a drawstring comprising elastic materials to allow the neck opening, without the aid of a locking mechanism, to be secured to the wearer in a contracted state and easily released from the wearer by expansion to an expanded state.

In an embodiment, the at least one actuatable portion 607 of the adjustable contracting mechanism of the one or more restraining mechanisms 606 may be positioned along a shoulder line of the wearer and proximate a glenohumeral joint of the wearer. In other embodiments, the at least one actuatable portion 607 may be arranged at another position accessible to the wearer. For instance, the at least one actuatable portion 607 may be arranged in front of the wearer so as to be visible and easily reached when the wearer wishes to doff the isolation gown 600.

In other embodiments, the at least one actuatable portion 607 may be more than one actuatable portion. For example, as illustrated in FIG. 6A, the at least one actuatable portion 607 may be two actuatable portions 607 on opposing sides of the neck opening. The two actuatable portions 607 may be actuatable portions of two drawstrings as adjustable contracting mechanisms. In one embodiment, each half of the neck opening can include a channel for a drawstring, wherein the channels do not intersect. Each actuatable portion may be used to adjust a portion of the neck opening (e.g., half of the neck opening) between a contracted state and an expanded state. In one embodiment, the two actuatable portions 607 may be located approximately at each shoulder of the wearer, as depicted in FIG. 6A.

In one embodiment, as illustrated in FIG. 6A, the two actuatable portions 607 and the adjustable contracting mechanisms may be arranged to enable the garment body 605 to be expanded and/or opened while the neck opening is in a contracted state. For example, the garment body 605 may include a lengthwise perforated seam 615, as is illustrated in FIG. 6C and as will be discussed in further detail below. The garment body 605 may be torn along the perforated seam 615 in order to remove the isolation gown 600. In one embodiment, the perforated seam 615 may run through the neck opening. The actuatable portions 607 and the adjustable contracting mechanisms of the one more restraining mechanisms 606 may be positioned around the perforated seam 615 and/or without blocking the perforated seam 615 to enable the neck opening to be torn open along with the rest of the garment body 605. For example, the channels containing the drawstrings may not intersect with or cross over the perforated seam 615. The channels may be closed off on either side of the perforated seam 615 so that the perforated seam 615 may be torn without breaking the adjustable contracting mechanisms. The actuatable portions 607 may still be used to adjust the adjustable contracting mechanisms and contract and/or expand the entire neck opening in this position. This positioning may be advantageous in reducing the number of steps needed to doff the isolation gown 600 and reducing contact between the wearer's hands and areas close to the wearer's face after contamination. The isolation gown 600 may be removed by tearing the garment body 605 along the perforated seam 615 without actuating the actuatable portion 607 or expanding the neck opening.

In another embodiment, the two actuatable portions 607 may be located at the front of the garment body 605 and the back of the garment body 605. In another embodiment, the two actuatable portions 607 may be located on non-opposing sides of the neck opening. For example, the two actuatable portions 607 may both be located on the front of the garment body 605. The two or more actuatable portions may provide more flexibility to the wearer in adjusting portions of the neck opening between a contracted state and an expanded state. In addition, shortening the span of each adjustable contracting mechanism may improve the gripping or holding ability of each adjustable contracting mechanism to maintain a contracted state of a portion of the neck opening. In one embodiment, the at least one actuatable portion 607 may include more than two actuatable portions.

In an embodiment, the isolation gown 600 is retained about a midsection of the wearer by one or more restraining mechanisms 608. The one or more restraining mechanisms 608 may include an adjustable contracting mechanism having at least one actuatable portion 609 that allows for adjusting the one or more restraining mechanisms 608 between a contracted state that secures the garment body 605 of the isolation gown 600 to the midsection of the wearer and an expanded state wherein an area of the garment body 605 of the isolation gown 600 is large enough to allow the isolation gown 600 to be lifted over the head of the wearer or slipped to the floor around the body of the wearer. In an embodiment, the adjustable contracting mechanism may be a drawstring mechanism, a hook and loop mechanism, a button mechanism, a buckle mechanism, an elastic mechanism, and the like. In another embodiment, the adjustable contracting mechanism may include snap/press studs, safety pins, cuff links, brooches, zippers, metal hooks and eye, frog fasteners, toggle fasteners, snap hooks/clasps, grommets/eyelets, glass studs, cords and ropes, sliders, adhesives, clasps, squeeze buckles, and G-hooks, among others. In an example, the adjustable contracting mechanism may be a drawstring. The drawstring may include a cordlock in order to secure a midsection of the garment body in both of a contracted state and an expanded state. The drawstring may, alternatively, include imprints or depressions to allow for frictional securing of the drawstring within a hem of the midsection of the garment body in a contracted state and an expanded state. In another embodiment, the adjustable contracting mechanism may be a drawstring comprising elastic materials to allow the midsection of the garment body, without the aid of a locking mechanism, to be secured to the wearer in a contracted state and easily released from the wearer by expansion to an expanded state.

In an embodiment, the at least one actuatable portion 609 of the adjustable contracting mechanism of the one or more restraining mechanisms 608 may be positioned at a hip of the wearer. In other embodiments, the at least one actuatable portion 609 may be arranged at another position accessible to the wearer. The position of the at least one actuatable portion 609 as close to the hip ensures that the at least one actuatable portion 609 is accessible without interfering with a task that is front of the wearer. Moreover, positioning the at least one actuatable portion 609 as close to the hip allows the wearer to ensure, via proprioception and/or vision, that the expanded state of the one or more restraining mechanisms 608 is sufficient to allow the isolation gown 600 to be lifted over the shoulders and head of the wearer or to fall to the floor around the wearer.

In an embodiment, as in FIG. 6A through FIG. 6C, the at least one actuatable portion 609 may be two actuatable portions that allow for improved control of the one or more restraining mechanisms 608.

In an embodiment, the isolation gown 600 is retained about arms of the wearer by one or more restraining mechanisms 610. The one or more restraining mechanisms 610 may include an adjustable contracting mechanism having at least one actuatable portion 611 that allows for adjusting the one or more restraining mechanisms 610 between a contracted state that secures the sleeves 604 of the isolation gown 600 to the arms of the wearer and an expanded state wherein an opening of a distal end of the sleeves 604 of the isolation gown 600 is large enough to allow the sleeves 604 to slip over hands of the wearer. In an embodiment, the adjustable contracting mechanism may be a drawstring mechanism, a hook and loop mechanism, a button mechanism, a buckle mechanism, an elastic mechanism, and the like. In another embodiment, the adjustable contracting mechanism may include snap/press studs, safety pins, cuff links, brooches, zippers, metal hooks and eye, frog fasteners, toggle fasteners, snap hooks/clasps, grommets/eyelets, glass studs, cords and ropes, sliders, adhesives, clasps, squeeze buckles, and G-hooks, among others. In an example, the adjustable contracting mechanism may be a drawstring. The drawstring may include a cordlock in order to secure the sleeve opening in both of a contracted state and an expanded state. The drawstring may, alternatively, include imprints or depressions to allow for frictional securing of the drawstring within a hem of the sleeve opening in a contracted state and an expanded state. In another embodiment, the adjustable contracting mechanism may be a drawstring comprising elastic materials to allow the sleeve opening, without the aid of a locking mechanism, to be secured to the wearer in a contracted state and easily released from the wearer by expansion to an expanded state.

In an embodiment, the at least one actuatable portion 611 of the adjustable contracting mechanism of the one or more restraining mechanisms 610 may be positioned at wrists of the wearer. In other embodiments, the at least one actuatable portion 611 may be arranged at another position accessible to the wearer. The position of the at least one actuatable portion 611 as close to the wrists ensures that the one or more restraining mechanisms 610 are secured to the arms of the wearer such that contamination via the sleeves 604 is improbable.

In an embodiment, as in FIG. 6A through FIG. 6C, the at least one actuatable portion 611 may be two actuatable portions that allow for improved control of the one or more restraining mechanisms 610.

According to an embodiment, each of the adjustable contracting mechanisms of the one or more restraining mechanisms 606, 608, 610, may be a drawstring tape paper. The drawstring tape paper may have an actuatable portion that allows the drawstring tape paper to move from an expanded state to a contracted state, and vice versa.

According to one embodiment, as illustrated in FIG. 6C, the isolation gown 600 may include a perforated seam 615. In one embodiment, the perforated seam 615 may start at an opening of the garment body 605 of the isolation gown 600. For example, the perforated seam 615 may start at a neck opening of the garment body 605. The perforated seam 615 may run down the back of the garment body 605 or a portion of the back of the garment body 605. The perforations enable expansion of the garment body 605 of the isolation gown 600. In one embodiment, the isolation gown 600 may be torn open along the perforated seam 615 with less force than would be needed to tear an unperforated isolation gown along the same location. A wearer may thus apply less force to either side of the perforated seam 615 to expand the garment body 605 for removal of the isolation gown 600. However, the perforated seam 615 may remain intact when force is not applied to the garment body 605. In one embodiment, as illustrated in FIG. 6C, the perforated seam 615 may end in a slit 616 that runs a portion of the length of the garment body 605. In one embodiment, as illustrated in FIG. 6C, the perforated seam 615 may end approximately at the knees of the wearer. In one embodiment, the perforated seam 615 may be located on the front of the garment body 605. In another embodiment, the perforated seam 615 may be located along a side of the garment body 605. The isolation gown 600 may include multiple perforated seams.

In one embodiment, the perforated seam 615 may terminate at an opening of the garment body 605, e.g., a neck opening. In one embodiment, tearing open the perforated seam 615 may also result in the opening of the garment body 605 also being torn open. In another embodiment, the perforated seam 615 may terminate before the opening of the garment body 605. The opening will remain closed even when the perforated seam 615 is broken.

FIG. 7A through FIG. 7D provide illustrations of an isolation gown 700, according to an exemplary embodiment of the present disclosure. A body covering portion of the isolation gown 700, including a garment body 705 and sleeves 704, is configured to wrap about the torso of a wearer. In one embodiment, the medical gown 700 is manufactured from a non-woven fabric, a woven fabric, a non-woven synthetic, or a woven synthetic. The fabric can be a disposable material and, optionally, can include a fluid resistant lining that prevents the passage of fluids, such as water and bodily fluids, through the garment body 705 and/or the sleeves 704. In an embodiment, a length of the isolation gown 700 is configured to extend from a wearer's shoulders to below their knees.

In an embodiment, the fabric is a non-woven fabric configured to be tearable by a wearer. For example, the non-woven fabric may have a tensile strength of between four and ten pounds. Thus, if the wearer were to grasp opposing sides of a section of the non-woven fabric, and then pull with a force of between four and ten pounds, the fabric would tear.

In an embodiment, the sleeves 704 extend distally from the garment body 705 and are configured to receive arms of the wearer when the isolation gown 700 is donned. As in FIG. 7A, the sleeves 704 are illustrated as long sleeves, though it can be appreciated that any length sleeve can be used so long as required protection is provided. In an embodiment, the isolation gown 700 may include one or more pockets.

Figure 7A:
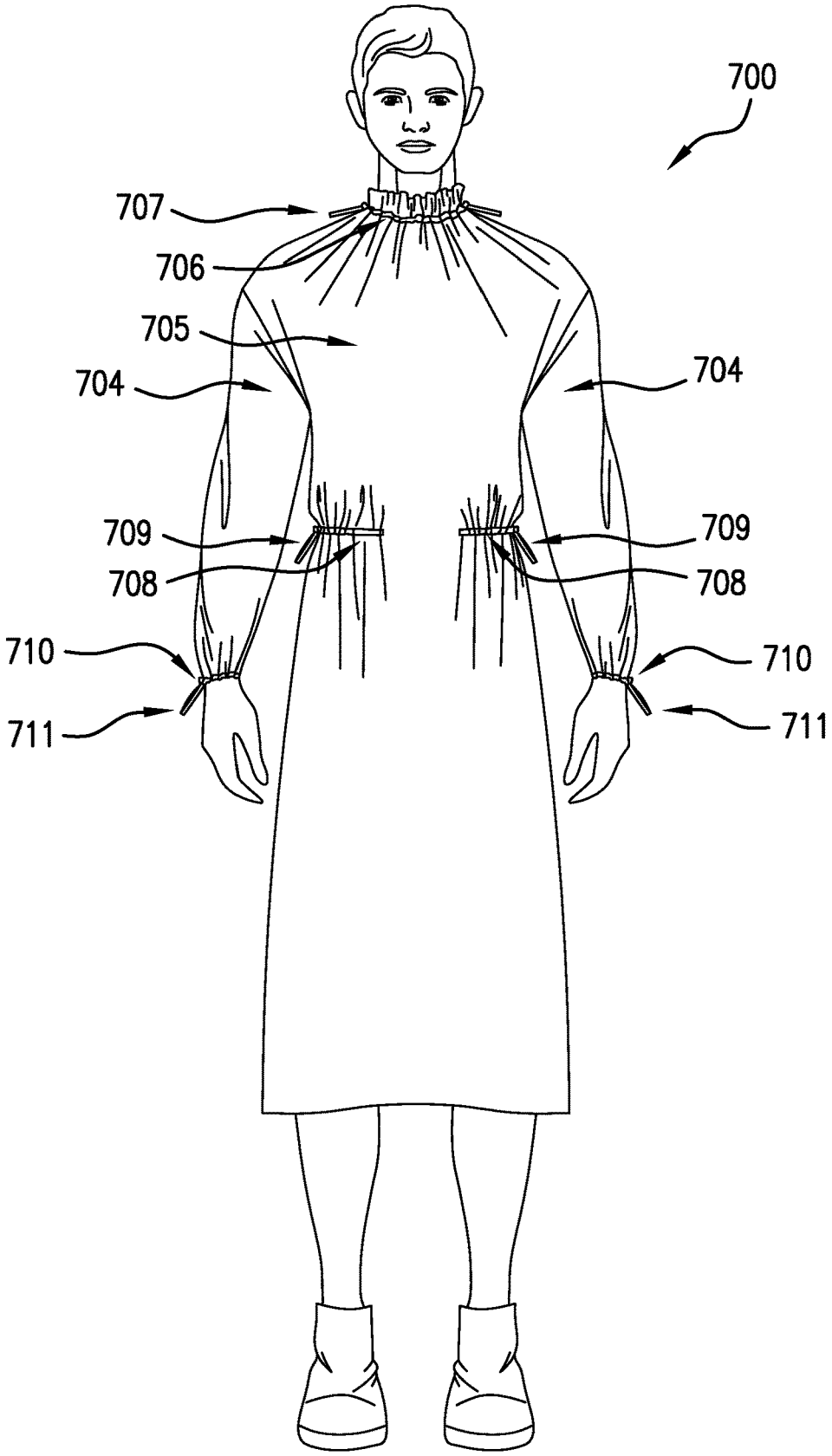
FIG. 7A is a stylized illustration of a wearer having donned a medical gown, according to an exemplary embodiment of the present disclosure.

In the illustrative embodiment of FIG. 7A, the garment body 105 includes, at a lower end, a body opening through which the body of the wearer can be introduced. In an embodiment, the body opening can be configured with a slit that runs a portion of a length of the garment body 705.

Figure 7C:
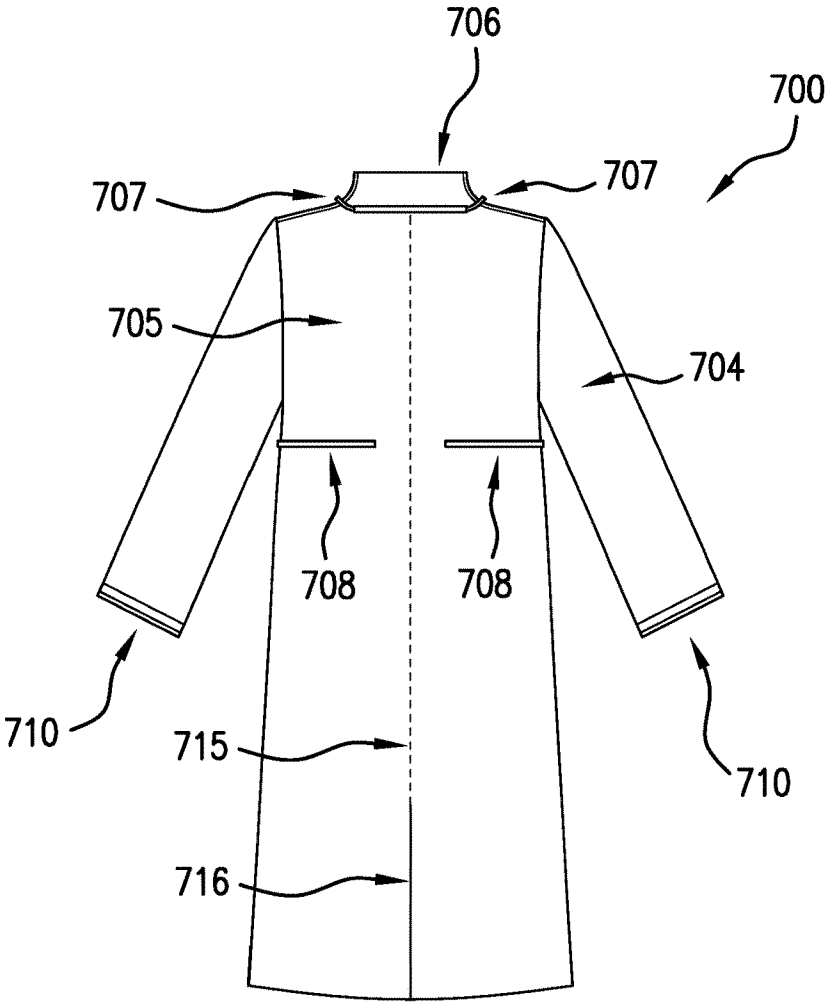
FIG. 7C is an illustration of a rear view of a medical gown, according to an exemplary embodiment of the present disclosure.
Figure 7B:
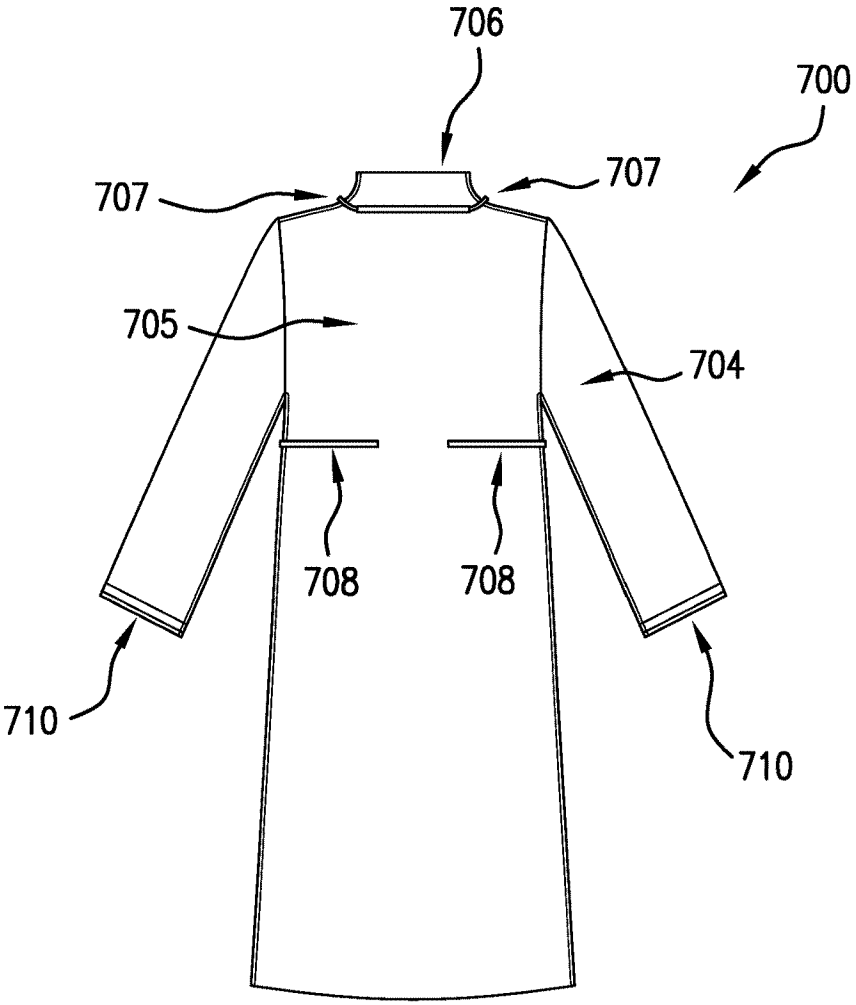
FIG. 7B is an illustration of a front view of a medical gown, according to an exemplary embodiment of the present disclosure.

In an embodiment, and with particular reference to FIG. 7B, the isolation gown 700 is retained about the neck of the wearer by one or more restraining mechanisms 706. The one or more restraining mechanisms 706 may include an adjustable contracting mechanism having at least one actuatable portion 707 that allows for adjusting the one or more restraining mechanisms 706 between a contracted state that secures a neck opening of the isolation gown 700 to the neck of the wearer and an expanded state wherein the neck opening of the isolation gown 700 is large enough to allow the isolation gown 700 to be lifted over the head of the wearer and disposed or slipped to the floor around the body of the wearer and disposed. In an embodiment, the adjustable contracting mechanism may be a drawstring mechanism, a hook and loop mechanism, a button mechanism, a buckle mechanism, an elastic mechanism, and the like. In another embodiment, the adjustable contracting mechanism may be integrated with a powered air-purifying respirator (PAPR) system, and the contracted state and the expanded state of the adjustable contracting mechanism may be controlled by an amount of fluid from the PAPR system and within the one or more restraining mechanisms 706. In another embodiment, the adjustable contracting mechanism may include snap/press studs, safety pins, cuff links, brooches, zippers, metal hooks and eye, frog fasteners, toggle fasteners, snap hooks/clasps, grommets/eyelets, glass studs, cords and ropes, sliders, adhesives, clasps, squeeze buckles, and G-hooks, among others. In an example, the adjustable contracting mechanism may be a drawstring. The drawstring may include a cordlock in order to secure the neck opening in both of a contracted state and an expanded state. The drawstring may, alternatively, include imprints or depressions to allow for frictional securing of the drawstring within a hem of the neck opening in a contracted state and an expanded state. In another embodiment, the adjustable contracting mechanism may be a drawstring comprising elastic materials to allow the neck opening, without the aid of a locking mechanism, to be secured to the wearer in a contracted state and easily released from the wearer by expansion to an expanded state.

In an embodiment, the at least one actuatable portion 707 of the adjustable contracting mechanism of the one or more restraining mechanisms 706 may be positioned along a shoulder line of the wearer and proximate a glenohumeral joint of the wearer. In other embodiments, the at least one actuatable portion 707 may be arranged at another position accessible to the wearer. For instance, the at least one actuatable portion 707 may be arranged in front of the wearer so as to be visible and easily reached when the wearer wishes to doff the isolation gown 700.

In other embodiments, the at least one actuatable portion 707 may be more than one actuatable portion. For example, as illustrated in FIG. 7A through FIG. 7C, the at least one actuatable portion 707 may be two actuatable portions 707 on opposing sides of the neck opening. The adjustable contracting mechanisms may be, for example, two drawstrings. In one embodiment, each half of the neck opening can include a channel for a drawstring, wherein the channels do not intersect. Each actuatable portion 707 may be used to adjust a portion of the neck opening (e.g., half of the neck opening) between a contracted state and an expanded state. In one embodiment, the two actuatable portions 707 may be located approximately at each shoulder of the wearer, as depicted in FIG. 7A. In another embodiment, the two actuatable portions 707 may be located at the front of the garment body 705 and the back of the garment body 705. In another embodiment, the two actuatable portions 707 may be located on non-opposing sides of the neck opening. For example, the two actuatable portions 707 may both be located on the front of the garment body 705. The isolation gown 700 having two or more actuatable portions may provide more flexibility to the wearer in adjusting portions of the neck opening between a contracted state and an expanded state. In addition, shortening the length of each adjustable contracting mechanism may improve the gripping or holding ability of each adjustable contracting mechanism to maintain a contracted state of a portion of the neck opening. In one embodiment, the at least one actuatable portion 707 may include more than two actuatable portions.

Figure 7D:
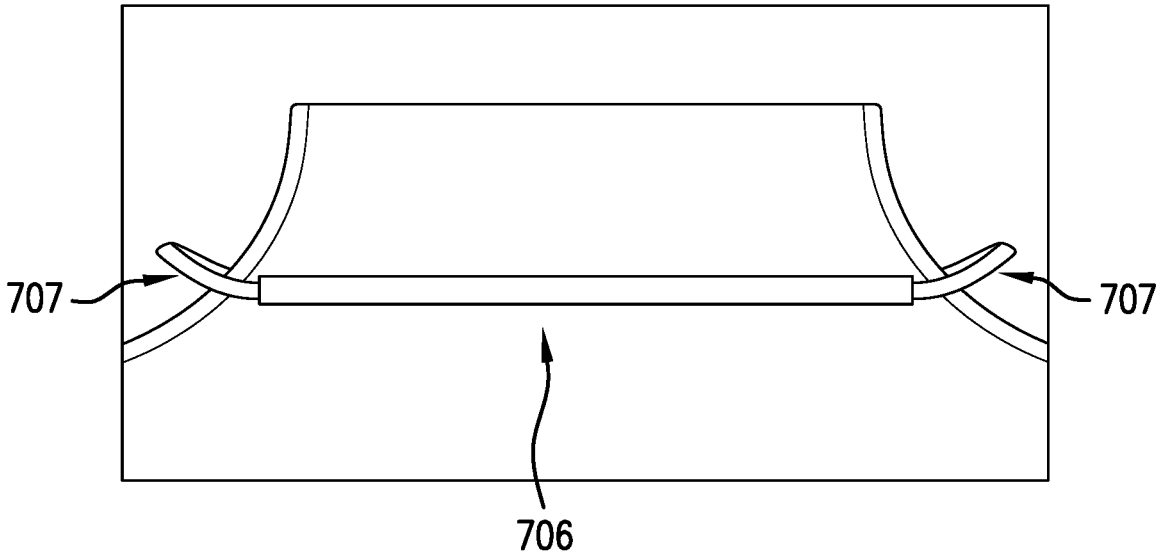
FIG. 7D is an illustration of an aspect of a medical gown, according to an exemplary embodiment of the present disclosure.

In one embodiment, the neck opening of the isolation gown may be a turtleneck opening. A turtleneck opening may include additional fabric (the turtleneck) below the turtleneck opening to cover at least a portion of the neck of the wearer. The additional fabric covers the neck circumferentially. The turtleneck may cover any portion of the neck of the wearer. For example, a low turtleneck may cover a lower portion of the neck of the wearer, as illustrated in FIG. 7D. As another non-limiting example, a high turtleneck may cover the entire neck of the wearer. In one embodiment, a turtleneck may have fabric that folds over to cover the neck, as in a traditional turtleneck garment. In another embodiment, the turtleneck may include a single layer of additional fabric. In one embodiment, the turtleneck opening may be circular, rectangular, square, ellipsoidal, or another geometric shape appropriate for a given wearer.

The turtleneck may include the at least one actuatable portion 707 of the adjustable contracting mechanism of the one or more restraining mechanisms 706. In one embodiment, the at least one adjustable contracting mechanism may be located at the base of the turtleneck, near the collarbone of the wearer. In another embodiment, the at least one adjustable contracting mechanism may be located at the top of the turtleneck, near the head of the wearer. In yet another embodiment, the at least one adjustable contracting mechanism may be located at the middle of the turtleneck covering the neck. FIG. 7D illustrates an example of the at least one actuatable portion 707 of the adjustable contracting mechanism of the one or more restraining mechanisms 706 located at the base of the turtleneck opening.

The turtleneck opening may provide more fabric, or increased surface area, for frictional securing of the adjustable contracting mechanism, e.g., a drawstring, elastic, or similar material. In one embodiment, the one or more restraining mechanisms 706 may achieve a tighter grip on the turtleneck opening due to the additional fabric. Thus, the contracted state of the turtleneck opening may be maintained at a smaller dimension and/or for a longer period of time.

In an embodiment, the isolation gown 700 is retained about a midsection of the wearer by one or more restraining mechanisms 708. The one or more restraining mechanisms 708 may include an adjustable contracting mechanism having at least one actuatable portion 709 that allows for adjusting the one or more restraining mechanisms 708 between a contracted state that secures the garment body 705 of the isolation gown 700 to the midsection of the wearer and an expanded state wherein an area of the garment body 705 of the isolation gown 700 is large enough to allow the isolation gown 700 to be lifted over the head of the wearer or slipped to the floor around the body of the wearer. In an embodiment, the adjustable contracting mechanism may be a drawstring mechanism, a hook and loop mechanism, a button mechanism, a buckle mechanism, an elastic mechanism, and the like. In another embodiment, the adjustable contracting mechanism may include snap/press studs, safety pins, cuff links, brooches, zippers, metal hooks and eye, frog fasteners, toggle fasteners, snap hooks/clasps, grommets/eyelets, glass studs, cords and ropes, sliders, adhesives, clasps, squeeze buckles, and G-hooks, among others. In an example, the adjustable contracting mechanism may be a drawstring. The drawstring may include a cordlock in order to secure a midsection of the garment body in both of a contracted state and an expanded state. The drawstring may, alternatively, include imprints or depressions to allow for frictional securing of the drawstring within a hem of the midsection of the garment body in a contracted state and an expanded state. In another embodiment, the adjustable contracting mechanism may be a drawstring comprising elastic materials to allow the midsection of the garment body, without the aid of a locking mechanism, to be secured to the wearer in a contracted state and easily released from the wearer by expansion to an expanded state.

In an embodiment, the at least one actuatable portion 709 of the adjustable contracting mechanism of the one or more restraining mechanisms 708 may be positioned at a hip of the wearer. In other embodiments, the at least one actuatable portion 709 may be arranged at another position accessible to the wearer. The position of the at least one actuatable portion 709 as close to the hip ensures that the at least one actuatable portion 709 is accessible without interfering with a task that is front of the wearer. Moreover, positioning the at least one actuatable portion 709 as close to the hip allows the wearer to ensure, via proprioception and/or vision, that the expanded state of the one or more restraining mechanisms 708 is sufficient to allow the isolation gown 700 to be lifted over the shoulders and head of the wearer or to fall to the floor around the wearer.

In an embodiment, as in FIG. 7A through FIG. 7C, the at least one actuatable portion 709 may be two actuatable portions that allow for improved control of the one or more restraining mechanisms 708.

In an embodiment, the isolation gown 700 is retained about arms of the wearer by one or more restraining mechanisms 710. The one or more restraining mechanisms 710 may include an adjustable contracting mechanism having at least one actuatable portion 711 that allows for adjusting the one or more restraining mechanisms 710 between a contracted state that secures the sleeves 704 of the isolation gown 700 to the arms of the wearer and an expanded state wherein an opening of a distal end of the sleeves 704 of the isolation gown 700 is large enough to allow the sleeves 704 to slip over hands of the wearer. In an embodiment, the adjustable contracting mechanism may be a drawstring mechanism, a hook and loop mechanism, a button mechanism, a buckle mechanism, an elastic mechanism, and the like. In another embodiment, the adjustable contracting mechanism may include snap/press studs, safety pins, cuff links, brooches, zippers, metal hooks and eye, frog fasteners, toggle fasteners, snap hooks/clasps, grommets/eyelets, glass studs, cords and ropes, sliders, adhesives, clasps, squeeze buckles, and G-hooks, among others. In an example, the adjustable contracting mechanism may be a drawstring. The drawstring may include a cordlock in order to secure the sleeve opening in both of a contracted state and an expanded state. The drawstring may, alternatively, include imprints or depressions to allow for frictional securing of the drawstring within a hem of the sleeve opening in a contracted state and an expanded state. In another embodiment, the adjustable contracting mechanism may be a drawstring comprising elastic materials to allow the sleeve opening, without the aid of a locking mechanism, to be secured to the wearer in a contracted state and easily released from the wearer by expansion to an expanded state.

In an embodiment, the at least one actuatable portion 711 of the adjustable contracting mechanism of the one or more restraining mechanisms 710 may be positioned at wrists of the wearer. In other embodiments, the at least one actuatable portion 711 may be arranged at another position accessible to the wearer. The position of the at least one actuatable portion 711 as close to the wrists ensures that the one or more restraining mechanisms 710 are secured to the arms of the wearer such that contamination via the sleeves 704 is improbable.

In an embodiment, the at least one actuatable portion 711 may be two actuatable portions that allow for improved control of the one or more restraining mechanisms 710.

According to an embodiment, the sleeves 704 may include, at a distal end, one or more openings.

According to an embodiment, each of the adjustable contracting mechanisms of the one or more restraining mechanisms 706, 708, 710, may be a drawstring tape paper. The drawstring tape paper may have an actuatable portion that allows the drawstring tape paper to move from an expanded state to a contracted state, and vice versa.

According to one embodiment, as illustrated in FIG. 7C, the isolation gown 700 may include a perforated seam 715. In one embodiment, the perforated seam 715 may start at an opening of the garment body 705 of the isolation gown 700. For example, the perforated seam 715 may start at a neck opening or at a base of the garment body 705. The perforated seam 715 may run down the back of the garment body 705 or a portion of the back of the garment body 705. The perforations enable expansion of the garment body 705 of the isolation gown 700. In one embodiment, the isolation gown 700 may be torn open along the perforated seam 715 with less force than would be needed to tear open an unperforated isolation gown along the same location. A wearer may thus apply less force to either side of the perforated seam 715 to expand the garment body 705 for removal of the isolation gown 700. However, the perforated seam 715 may remain intact when force is not applied to the garment body 705. In one embodiment, the perforated seam 715 may end in a slit that runs a portion of the length of the garment body 705. In one embodiment, the perforated seam 715 may be located on the front of the garment body 705. In another embodiment, the perforated seam 715 may be located along a side of the garment body 705. The isolation gown 700 may include multiple perforated seams.

In one embodiment, as illustrated in FIG. 7C, the perforated seam 715 may end in a slit 716 that runs a portion of the length of the garment body 705. In one embodiment, as also illustrated in FIG. 7C, the perforated seam 715 may end approximately at the knees of the wearer. In one embodiment, the perforated seam 715 may terminate at an opening of the garment body 705, e.g., a neck opening. In one embodiment, tearing open the perforated seam 715 may also result in the opening of the garment body 705 also being torn open. In another embodiment, the perforated seam 715 may terminate before the opening of the garment body 705. The opening will remain closed even when the perforated seam 715 is broken.

FIG. 8A through FIG. 8D provide illustrations of an isolation gown 800, according to an exemplary embodiment of the present disclosure. A body covering portion of the isolation gown 800, including a garment body 805 and sleeves 804, is configured to wrap about the torso of a wearer. In one embodiment, the medical gown 800 is manufactured from a non-woven fabric, a woven fabric, a non-woven synthetic, or a woven synthetic. The fabric can be a disposable material and, optionally, can include a fluid resistant lining that prevents the passage of fluids, such as water and bodily fluids, through the garment body 805 and/or the sleeves 804. In an embodiment, a length of the isolation gown 800 is configured to extend from a wearer's shoulders to below their knees.

In an embodiment, the fabric is a non-woven fabric configured to be tearable by a wearer. For example, the non-woven fabric may have a tensile strength of between four and ten pounds. Thus, if the wearer were to grasp opposing sides of a section of the non-woven fabric, and then pull with a force of between four and ten pounds, the fabric would tear.

In an embodiment, the sleeves 804 extend distally from the garment body 805 and are configured to receive arms of the wearer when the isolation gown 800 is donned. As in FIG. 8A, the sleeves 804 are illustrated as long sleeves, though it can be appreciated that any length sleeve can be used so long as required protection is provided. In an embodiment, the isolation gown 800 may include one or more pockets.

Figure 8A:
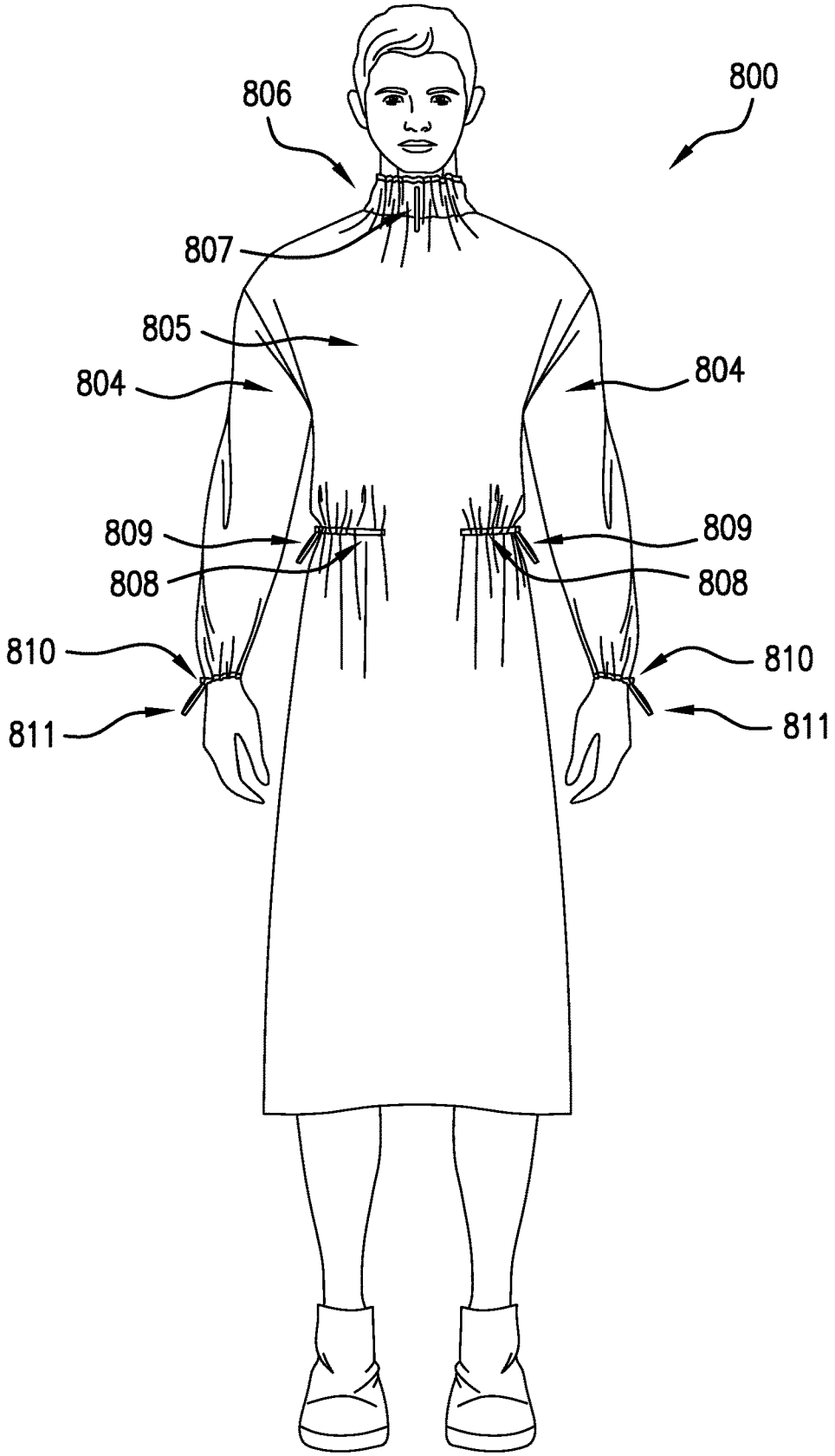
FIG. 8A is a stylized illustration of a wearer having donned a medical gown, according to an exemplary embodiment of the present disclosure.

In the illustrative embodiment of FIG. 8A, the garment body 805 includes, at a lower end, a body opening through which the body of the wearer can be introduced. In an embodiment, the body opening can be configured with a slit that runs a portion of a length of the garment body 805.

Figure 8C:
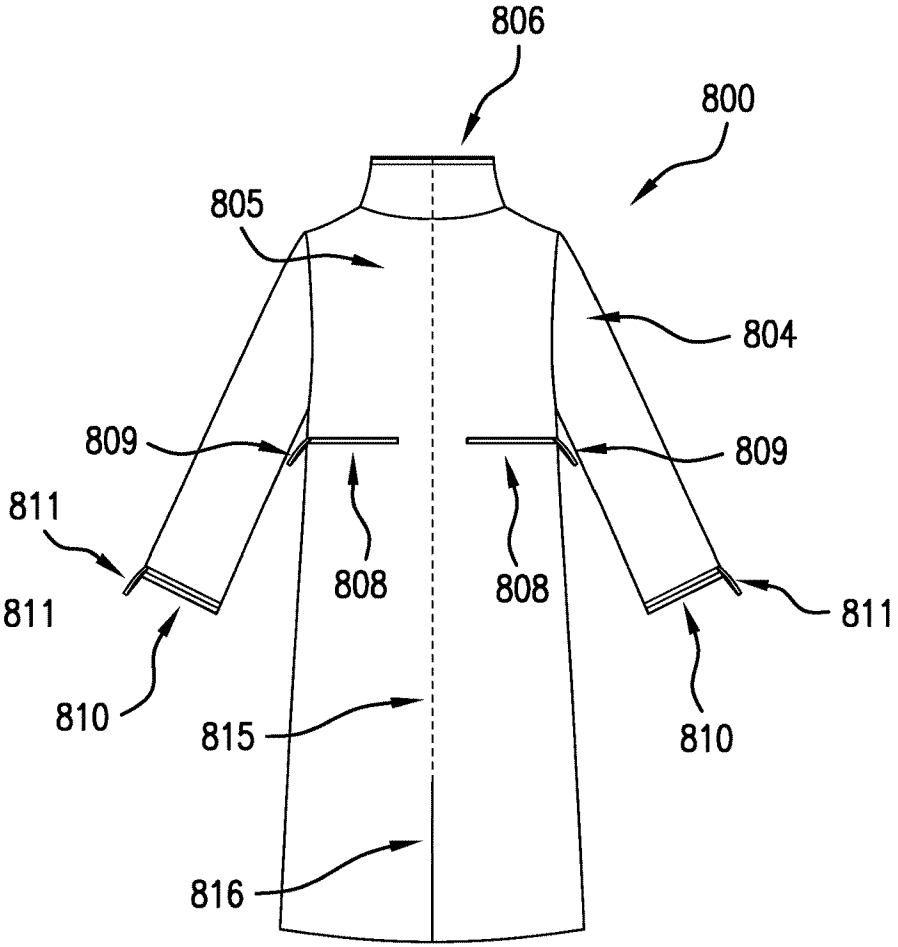
FIG. 8C is an illustration of a rear view of a medical gown, according to an exemplary embodiment of the present disclosure.
Figure 8B:
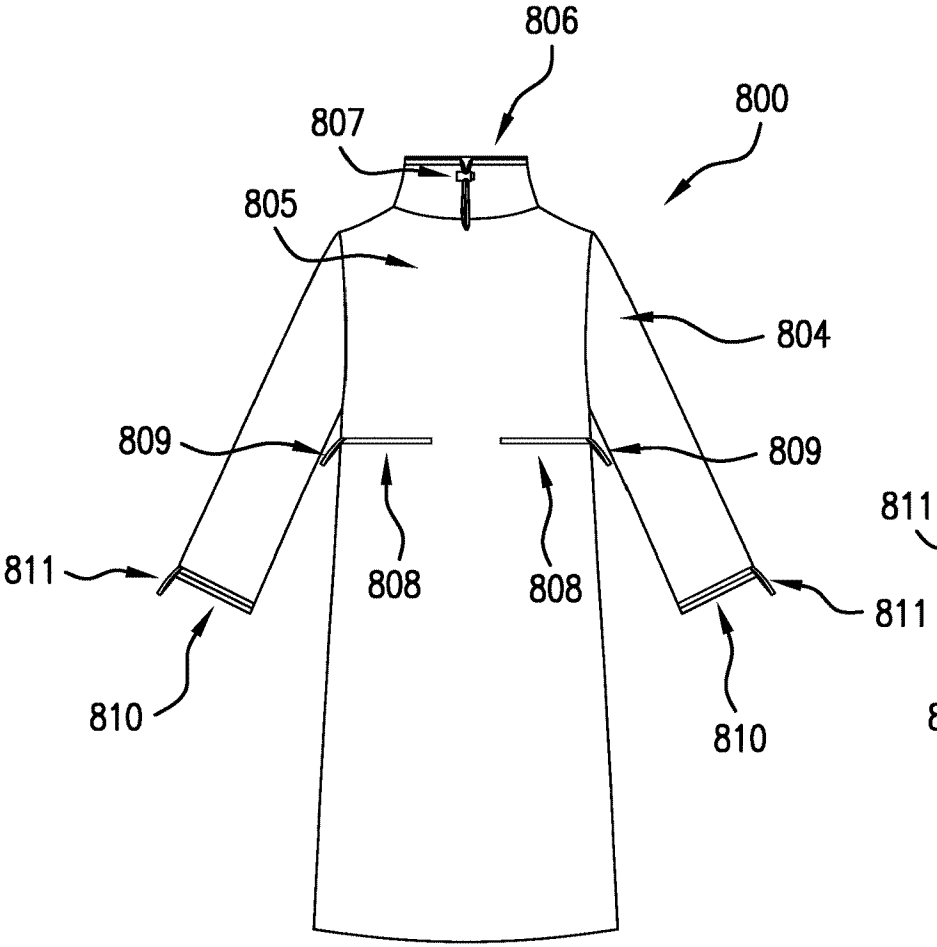
FIG. 8B is an illustration of a front view of a medical gown, according to an exemplary embodiment of the present disclosure.

In an embodiment, and with particular reference to FIG. 8B, the isolation gown 800 is retained about the neck of the wearer by one or more restraining mechanisms 806. The one or more restraining mechanisms 806 may include an adjustable contracting mechanism having at least one actuatable portion 807 that allows for adjusting the one or more restraining mechanisms 806 between a contracted state that secures a neck opening of the isolation gown 800 to the neck of the wearer and an expanded state wherein the neck opening of the isolation gown 800 is large enough to allow the isolation gown 800 to be lifted over the head of the wearer and disposed or slipped to the floor around the body of the wearer and disposed. In an embodiment, the adjustable contracting mechanism may be a drawstring mechanism, a hook and loop mechanism, a button mechanism, a buckle mechanism, an elastic mechanism, and the like. In another embodiment, the adjustable contracting mechanism may be integrated with a powered air-purifying respirator (PAPR) system, and the contracted state and the expanded state of the adjustable contracting mechanism may be controlled by an amount of fluid from the PAPR system and within the one or more restraining mechanisms 806. In another embodiment, the adjustable contracting mechanism may include snap/press studs, safety pins, cuff links, brooches, zippers, metal hooks and eye, frog fasteners, toggle fasteners, snap hooks/clasps, grommets/eyelets, glass studs, cords and ropes, sliders, adhesives, clasps, squeeze buckles, and G-hooks, among others. In an example, the adjustable contracting mechanism may be a drawstring. The drawstring may include a cordlock in order to secure the neck opening in both of a contracted state and an expanded state. The drawstring may, alternatively, include imprints or depressions to allow for frictional securing of the drawstring within a hem of the neck opening in a contracted state and an expanded state. In another embodiment, the adjustable contracting mechanism may be a drawstring comprising elastic materials to allow the neck opening, without the aid of a locking mechanism, to be secured to the wearer in a contracted state and easily released from the wearer by expansion to an expanded state.

In an embodiment, the at least one actuatable portion 807 of the adjustable contracting mechanism of the one or more restraining mechanisms 806 may be positioned along a shoulder line of the wearer and proximate a glenohumeral joint of the wearer. In other embodiments, the at least one actuatable portion 807 may be arranged at another position accessible to the wearer. For instance, the at least one actuatable portion 807 may be arranged in front of the wearer so as to be visible and easily reached when the wearer wishes to doff the isolation gown 800. In other embodiments, the at least one actuatable portion 807 may be more than one actuatable portion.

Figure 8D:
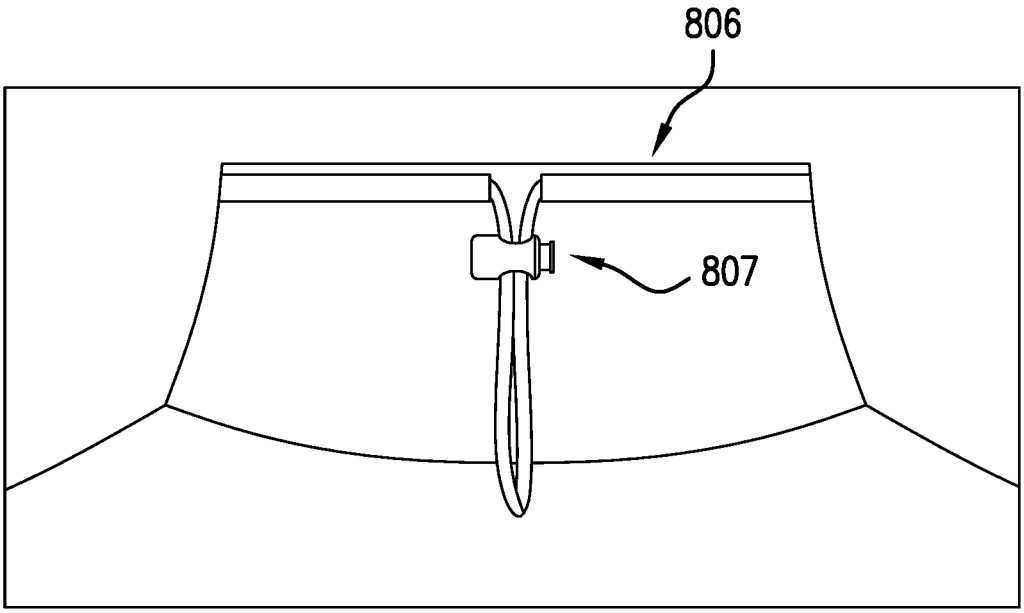
FIG. 8D is an illustration of an aspect of a medical gown, according to an exemplary embodiment of the present disclosure.

In one embodiment, the neck opening of the isolation gown may be a turtleneck opening. A turtleneck opening may include additional fabric (the turtleneck) below the turtleneck opening to cover at least a portion of the neck of the wearer. The additional fabric covers the neck circumferentially. The turtleneck may cover any portion of the neck of the wearer. For example, a low turtleneck may cover a lower portion of the neck of the wearer. As another non-limiting example, a high turtleneck, as illustrated in FIG. 8A and FIG. 8D, may cover a majority of the neck of the wearer. In one embodiment, a turtleneck may have fabric that folds over to cover the neck, as in a traditional turtleneck garment. In another embodiment, the turtleneck may include a single layer of additional fabric. In one embodiment, the turtleneck opening may be circular, rectangular, square, ellipsoidal, or another geometric shape appropriate for a given wearer.

The turtleneck may include the at least one actuatable portion 807 of the adjustable contracting mechanism of the one or more restraining mechanisms 806. In one embodiment, the at least one adjustable contracting mechanism may be located at the base of the turtleneck, near the collarbone of the wearer. In another embodiment, the at least one adjustable contracting mechanism may be located at the turtleneck opening, near the head of the wearer. FIG. 8D illustrates an example embodiment of a high turtleneck opening wherein the at least one actuatable portion 807 of the adjustable contracting mechanism of the one or more restraining mechanisms 806 is located at the top of the turtleneck opening. In yet another embodiment, the at least one adjustable contracting mechanism may be located at the middle of the turtleneck covering the neck. In an example embodiment, the turtleneck opening may include two restraining mechanisms. A first restraining mechanism may be located at the base of the turtleneck opening, and a second restraining mechanism may be located at a rim of the turtleneck opening. The first restraining mechanism and the second restraining mechanism may be actuated independently. Thus, a first dimension of the turtleneck may be adjusted independently of a second dimension of the turtleneck opening.

The turtleneck may provide more fabric, or increased surface area, for frictional securing of an adjustable contracting mechanism, e.g., a drawstring, elastic, or similar material used to create an expanded state and a contracted state of the turtleneck opening. In one embodiment, the adjustable contracting mechanism may achieve a tighter grip on the turtleneck due to the additional fabric. Thus, the contracted state of the turtleneck opening may be maintained at a smaller dimension and/or for a longer period of time.

In an embodiment, the isolation gown 800 is retained about a midsection of the wearer by one or more restraining mechanisms 808. The one or more restraining mechanisms 808 may include an adjustable contracting mechanism having at least one actuatable portion 809 that allows for adjusting the one or more restraining mechanisms 808 between a contracted state that secures the garment body 805 of the isolation gown 800 to the midsection of the wearer and an expanded state wherein an area of the garment body 805 of the isolation gown 800 is large enough to allow the isolation gown 800 to be lifted over the head of the wearer or slipped to the floor around the body of the wearer. In an embodiment, the adjustable contracting mechanism may be a drawstring mechanism, a hook and loop mechanism, a button mechanism, a buckle mechanism, an elastic mechanism, and the like. In another embodiment, the adjustable contracting mechanism may include snap/press studs, safety pins, cuff links, brooches, zippers, metal hooks and eye, frog fasteners, toggle fasteners, snap hooks/clasps, grommets/eyelets, glass studs, cords and ropes, sliders, adhesives, clasps, squeeze buckles, and G-hooks, among others. In an example, the adjustable contracting mechanism may be a drawstring. The drawstring may include a cordlock in order to secure a midsection of the garment body in both of a contracted state and an expanded state. The drawstring may, alternatively, include imprints or depressions to allow for frictional securing of the drawstring within a hem of the midsection of the garment body in a contracted state and an expanded state. In another embodiment, the adjustable contracting mechanism may be a drawstring comprising elastic materials to allow the midsection of the garment body, without the aid of a locking mechanism, to be secured to the wearer in a contracted state and easily released from the wearer by expansion to an expanded state.

In an embodiment, the at least one actuatable portion 809 of the adjustable contracting mechanism of the one or more restraining mechanisms 808 may be positioned at a hip of the wearer. In other embodiments, the at least one actuatable portion 809 may be arranged at another position accessible to the wearer. The position of the at least one actuatable portion 809 as close to the hip ensures that the at least one actuatable portion 809 is accessible without interfering with a task that is front of the wearer. Moreover, positioning the at least one actuatable portion 809 as close to the hip allows the wearer to ensure, via proprioception and/or vision, that the expanded state of the one or more restraining mechanisms 808 is sufficient to allow the isolation gown 800 to be lifted over the shoulders and head of the wearer or to fall to the floor around the wearer.

In an embodiment, as in FIG. 8A through FIG. 8C, the at least one actuatable portion 809 may be two actuatable portions that allow for improved control of the one or more restraining mechanisms 808.

In an embodiment, the isolation gown 800 is retained about arms of the wearer by one or more restraining mechanisms 810. The one or more restraining mechanisms 810 may include an adjustable contracting mechanism having at least one actuatable portion 811 that allows for adjusting the one or more restraining mechanisms 810 between a contracted state that secures the sleeves 804 of the isolation gown 800 to the arms of the wearer and an expanded state wherein an opening of a distal end of the sleeves 804 of the isolation gown 800 is large enough to allow the sleeves 804 to slip over hands of the wearer. In an embodiment, the adjustable contracting mechanism may be a drawstring mechanism, a hook and loop mechanism, a button mechanism, a buckle mechanism, an elastic mechanism, and the like. In another embodiment, the adjustable contracting mechanism may include snap/press studs, safety pins, cuff links, brooches, zippers, metal hooks and eye, frog fasteners, toggle fasteners, snap hooks/clasps, grommets/eyelets, glass studs, cords and ropes, sliders, adhesives, clasps, squeeze buckles, and G-hooks, among others. In an example, the adjustable contracting mechanism may be a drawstring. The drawstring may include a cordlock in order to secure the sleeve opening in both of a contracted state and an expanded state. The drawstring may, alternatively, include imprints or depressions to allow for frictional securing of the drawstring within a hem of the sleeve opening in a contracted state and an expanded state. In another embodiment, the adjustable contracting mechanism may be a drawstring comprising elastic materials to allow the sleeve opening, without the aid of a locking mechanism, to be secured to the wearer in a contracted state and easily released from the wearer by expansion to an expanded state.

In an embodiment, the at least one actuatable portion 811 of the adjustable contracting mechanism of the one or more restraining mechanisms 810 may be positioned at wrists of the wearer. In other embodiments, the at least one actuatable portion 811 may be arranged at another position accessible to the wearer. The position of the at least one actuatable portion 811 as close to the wrists ensures that the one or more restraining mechanisms 810 are secured to the arms of the wearer such that contamination via the sleeves 804 is improbable.

In an embodiment, the at least one actuatable portion 811 may be two actuatable portions that allow for improved control of the one or more restraining mechanisms 810.

According to an embodiment, the sleeves 804 may include, at a distal end, one or more openings.

According to an embodiment, each of the adjustable contracting mechanisms of the one or more restraining mechanisms 806, 808, 810, may be a drawstring tape paper. The drawstring tape paper may have an actuatable portion that allows the drawstring tape paper to move from an expanded state to a contracted state, and vice versa.

According to one embodiment, as illustrated in FIG. 8C, the isolation gown 800 may include a perforated seam 815. In one embodiment, the perforated seam 815 may start at an opening of the garment body 805 of the isolation gown 800. For example, the perforated seam 815 may start at a neck opening or at a base of the garment body 805. The perforated seam 815 may run down the back of the garment body 805 or a portion of the back of the garment body 805. The perforations enable expansion of the garment body 805 of the isolation gown 800. In one embodiment, the isolation gown 800 may be torn open along the perforated seam 815 with less force than would be needed to tear open an unperforated isolation gown along the same location. A wearer may thus apply less force to either side of the perforated seam 815 to expand the garment body 805 for removal of the isolation gown 800. However, the perforated seam 815 may remain intact when force is not applied to the garment body 805. In one embodiment, the perforated seam 815 may end in a slit that runs a portion of the length of the garment body 805. In one embodiment, the perforated seam 815 may be located on the front of the garment body 805. In another embodiment, the perforated seam 815 may be located along a side of the garment body 805. The isolation gown 800 may include multiple perforated seams.

In one embodiment, as illustrated in FIG. 8C, the perforated seam 815 may end in a slit 816 that runs a portion of the length of the garment body 805. In one embodiment, as illustrated in FIG. 8C, the perforated seam 815 may end approximately at the knees of the wearer. In one embodiment, the perforated seam 815 may terminate at an opening of the garment body 805, e.g., a neck opening. In one embodiment, tearing open the perforated seam 815 may also result in the opening of the garment body 805 also being torn open. In another embodiment, the perforated seam 815 may terminate before the opening of the garment body 805. The opening will remain closed even when the perforated seam 815 is broken.

FIG. 9A through FIG. 9F provide illustrations of an isolation gown 900, according to an exemplary embodiment of the present disclosure. A body covering portion of the isolation gown 900, including a garment body 905 and sleeves 904, is configured to wrap about the torso of a wearer. In one embodiment, the medical gown 900 is manufactured from a non-woven fabric, a woven fabric, a non-woven synthetic, or a woven synthetic. The fabric can be a disposable material and, optionally, can include a fluid resistant lining that prevents the passage of fluids, such as water and bodily fluids, through the garment body 905 and/or the sleeves 904. In an embodiment, a length of the isolation gown 900 is configured to extend from a wearer's shoulders to below their knees.

In an embodiment, the fabric is a non-woven fabric configured to be tearable by a wearer. For example, the non-woven fabric may have a tensile strength of between four and ten pounds. Thus, if the wearer were to grasp opposing sides of a section of the non-woven fabric, and then pull with a force of between four and ten pounds, the fabric would tear.

In an embodiment, the sleeves 904 extend distally from the garment body 905 and are configured to receive arms of the wearer when the isolation gown 900 is donned. As in FIG. 9A, the sleeves 904 are illustrated as long sleeves, though it can be appreciated that any length sleeve can be used so long as required protection is provided. In an embodiment, the isolation gown 900 may include one or more pockets.

Figure 9A:
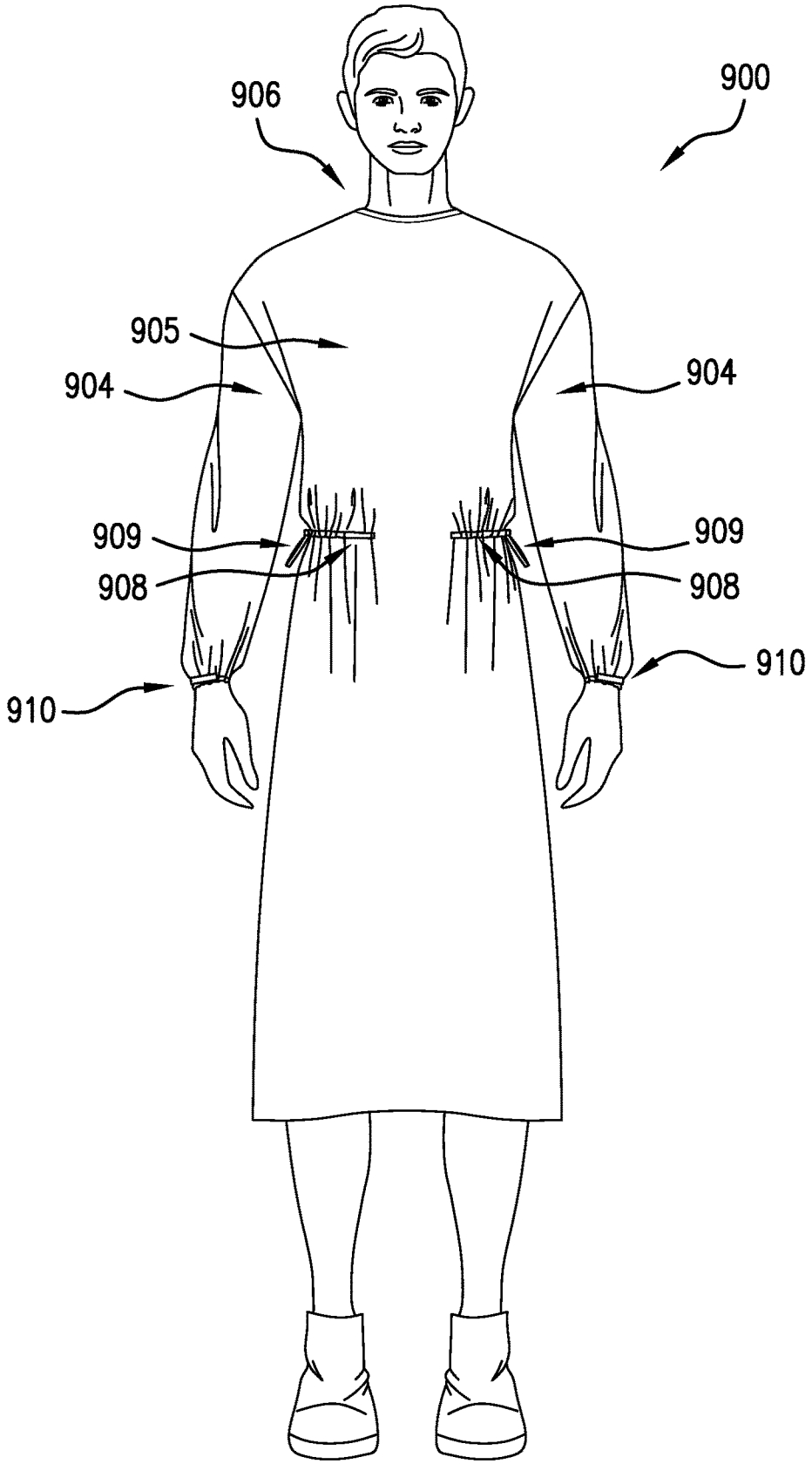
FIG. 9A is a stylized illustration of a wearer having donned a medical gown, according to an exemplary embodiment of the present disclosure.

In the illustrative embodiment of FIG. 9A, the garment body 905 includes, at a lower end, a body opening through which the body of the wearer can be introduced. In an embodiment, the body opening can be configured with a slit that runs a portion of a length of the garment body 905.

Figure 9C:
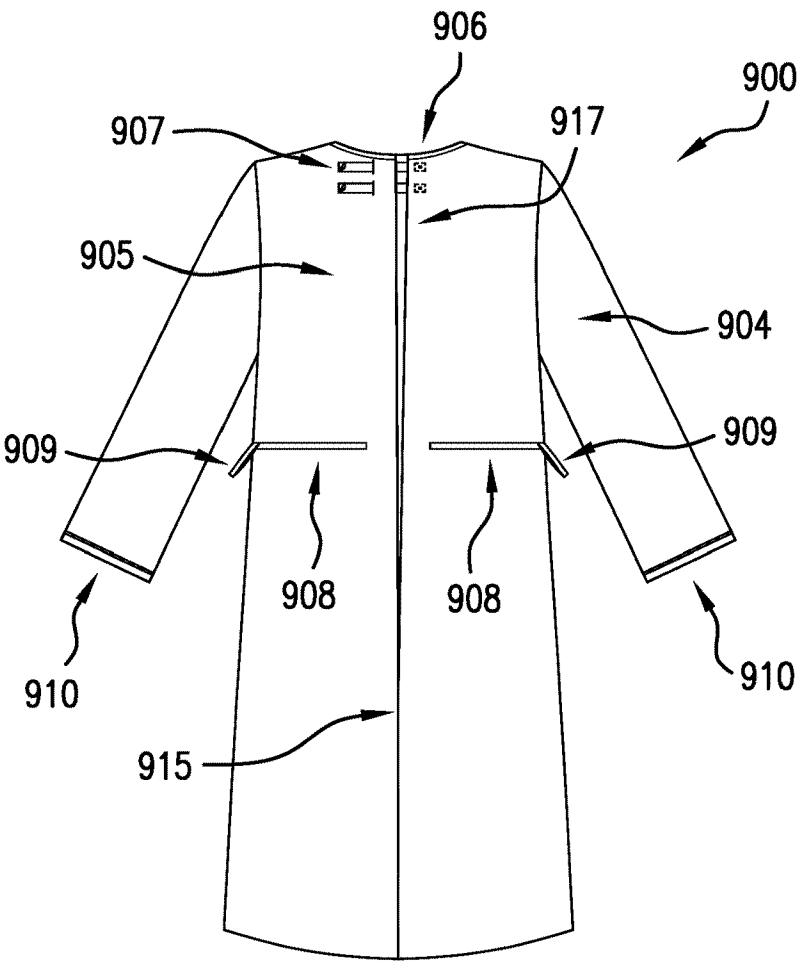
FIG. 9C is an illustration of a rear view of a medical gown, according to an exemplary embodiment of the present disclosure.
Figure 9B:
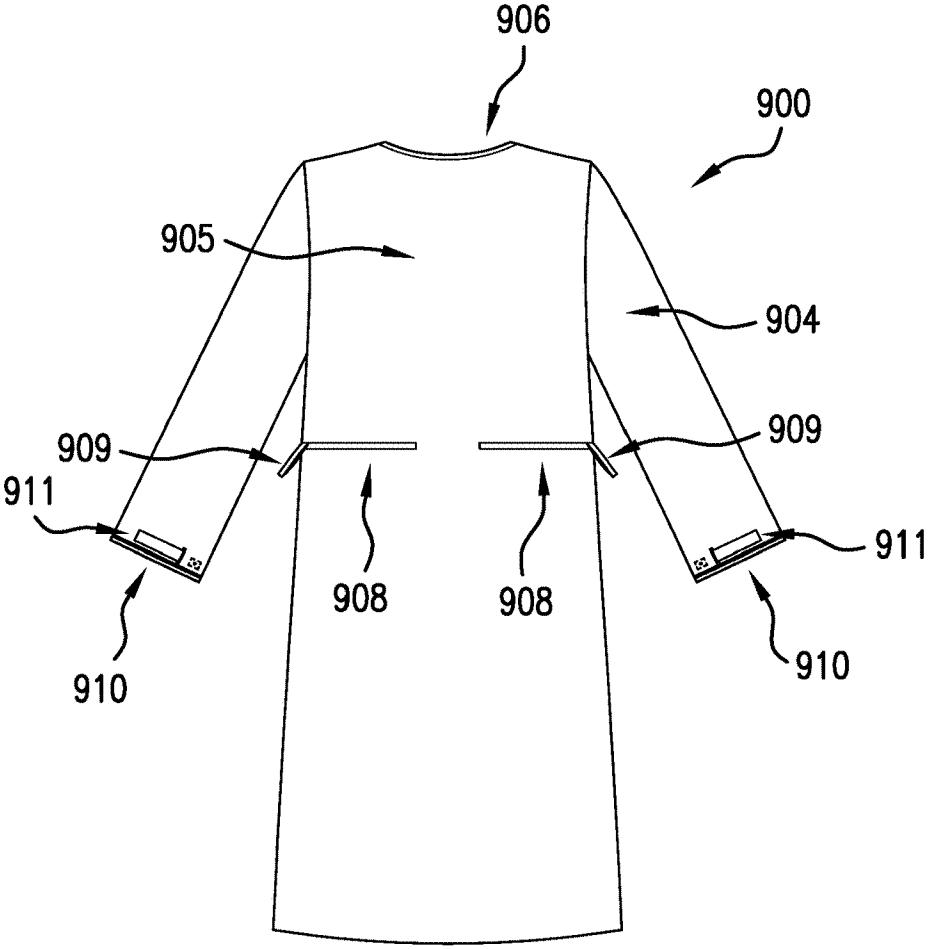
FIG. 9B is an illustration of a front view of a medical gown, according to an exemplary embodiment of the present disclosure.

In an embodiment, and with particular reference to FIG. 9B, the isolation gown 900 is retained about the neck of the wearer by one or more restraining mechanisms 906. The one or more restraining mechanisms 906 may include an adjustable contracting mechanism having at least one actuatable portion 907 that allows for adjusting the one or more restraining mechanisms 906 between a contracted state that secures a neck opening of the isolation gown 900 to the neck of the wearer and an expanded state wherein the neck opening of the isolation gown 900 is large enough to allow the isolation gown 900 to be lifted over the head of the wearer and disposed or slipped to the floor around the body of the wearer and disposed. In an embodiment, the adjustable contracting mechanism may be a drawstring mechanism, a hook and loop mechanism, a button mechanism, a buckle mechanism, an elastic mechanism, and the like. In another embodiment, the adjustable contracting mechanism may be integrated with a powered air-purifying respirator (PAPR) system, and the contracted state and the expanded state of the adjustable contracting mechanism may be controlled by an amount of fluid from the PAPR system and within the one or more restraining mechanisms 906. In another embodiment, the adjustable contracting mechanism may include snap/press studs, safety pins, cuff links, brooches, zippers, metal hooks and eye, frog fasteners, toggle fasteners, snap hooks/clasps, grommets/eyelets, glass studs, cords and ropes, sliders, adhesives, clasps, squeeze buckles, and G-hooks, among others. In an example, the adjustable contracting mechanism may be a drawstring. The drawstring may include a cordlock in order to secure the neck opening in both of a contracted state and an expanded state. The drawstring may, alternatively, include imprints or depressions to allow for frictional securing of the drawstring within a hem of the neck opening in a contracted state and an expanded state. In another embodiment, the adjustable contracting mechanism may be a drawstring comprising elastic materials to allow the neck opening, without the aid of a locking mechanism, to be secured to the wearer in a contracted state and easily released from the wearer by expansion to an expanded state.

Figure 9D:
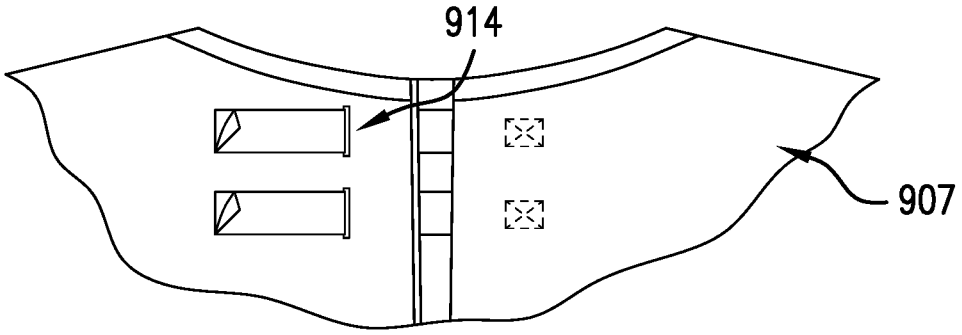
FIG. 9D is an illustration of an aspect of a medical gown, according to an exemplary embodiment of the present disclosure.

In one embodiment, the at least one actuatable portion 907 of the adjustable contracting mechanism of the one or more restraining mechanisms 906 may include self-adhesive tape as illustrated in FIG. 9C and FIG. 9D. A first end of the self-adhesive tape may be fixed to the garment body 905 at a fixed point wherein the fixed point may be on the inside of the garment body 905, or the side of the garment body 905 in contact with the wearer. In another embodiment, the fixed point may be on the outside of the garment body 905 or may be exposed to the outside of the garment body 905, e.g., through a cutout. The first end of the self-adhesive tape may be fixed to the fixed point using an adhesive, stitching, stapling, etc. In one embodiment, the longitudinal second end of the self-adhesive tape may be threaded through an opening 914 in the garment body. The opening 914 may be an incision or slit wherein the length of the opening is approximately the width of the self-adhesive tape, as shown in FIG. 9D. The self-adhesive tape may be threaded from the inside of the garment body 905 to the outside of the garment body 905, or the side that is not in contact with the wearer, through the opening. To actuate the adjustable contracting mechanism of the one or more restraining mechanisms 906, the self-adhesive tape may be folded over to adhere the longitudinal second end of the self-adhesive tape to the outside of the garment body 905 at an adhesion site. Pressure may be applied to the second end of the self-adhesive tape on top of the adhesion site, e.g., by a digit of the wearer. The pressure may cause the self-adhesive tape to adhere to the adhesion site even when the pressure is removed. In one embodiment, the adhesion site may be located on the outside of the garment body 905 on top of the fixed point on the inside of the garment body 905. In another embodiment, the adhesion site may be located on top of another portion of the self-adhesive tape extending from the fixed point. The longitudinal second end of the self-adhesive tape may adhere to the first end or the portion of the self-adhesive tape through the fabric of the garment body 905. In another embodiment, the self-adhesive tape may adhere directly to the fabric of the garment body 905 at the adhesion site.

In one embodiment, the self-adhesive tape may be used to attach two pieces of fabric together. For example, the garment body 905 may have an opening 917 along the back of the garment body 905, as shown in FIG. 9C. The opening may be a partial opening or a full opening. The self-adhesive tape may be used to secure a first side of the opening 917 to a second side of the opening 917, as illustrated in FIG. 9D. In one embodiment, the self-adhesive tape may be used to expand or contract the neck opening. For example, a portion in the middle of the self-adhesive tape (e.g., not the second longitudinal end of the self-adhesive tape) may be adhered to the adhesion site. Adhering a portion in the middle of the self-adhesive tape may shorten the distance between the first side of the partial opening and the second side of the partial opening, thus contracting the neck opening. In one embodiment, the adhesion of the self-adhesive tape to the adhesion site may be broken by applying a pulling force to the self-adhesive tape or the garment body 905. In another embodiment, the self-adhesive tape may be torn to release the opening.

In an embodiment, the at least one actuatable portion 907 of the adjustable contracting mechanism of the one or more restraining mechanisms 906 may be positioned along a shoulder line of the wearer and proximate a glenohumeral joint of the wearer. In other embodiments, the at least one actuatable portion 907 may be arranged at another position accessible to the wearer. For instance, the at least one actuatable portion 907 may be arranged in front of the wearer so as to be visible and easily reached when the wearer wishes to doff the isolation gown 900. In other embodiments, as illustrated in FIG. 9D, the at least one actuatable portion 907 may be more than one actuatable portion.

In an embodiment, the isolation gown 900 is retained about a midsection of the wearer by one or more restraining mechanisms 908. The one or more restraining mechanisms 908 may include an adjustable contracting mechanism having at least one actuatable portion 909 that allows for adjusting the one or more restraining mechanisms 908 between a contracted state that secures the garment body 905 of the isolation gown 900 to the midsection of the wearer and an expanded state wherein an area of the garment body 905 of the isolation gown 900 is large enough to allow the isolation gown 900 to be lifted over the head of the wearer or slipped to the floor around the body of the wearer. In an embodiment, the adjustable contracting mechanism may be a drawstring mechanism, a hook and loop mechanism, a button mechanism, a buckle mechanism, an elastic mechanism, and the like. In another embodiment, the adjustable contracting mechanism may include snap/press studs, safety pins, cuff links, brooches, zippers, metal hooks and eye, frog fasteners, toggle fasteners, snap hooks/clasps, grommets/eyelets, glass studs, cords and ropes, sliders, adhesives, clasps, squeeze buckles, and G-hooks, among others. In an example, the adjustable contracting mechanism may be a drawstring. The drawstring may include a cordlock in order to secure a midsection of the garment body in both of a contracted state and an expanded state. The drawstring may, alternatively, include imprints or depressions to allow for frictional securing of the drawstring within a hem of the midsection of the garment body in a contracted state and an expanded state. In another embodiment, the adjustable contracting mechanism may be a drawstring comprising elastic materials to allow the midsection of the garment body, without the aid of a locking mechanism, to be secured to the wearer in a contracted state and easily released from the wearer by expansion to an expanded state.

In an embodiment, the at least one actuatable portion 909 of the adjustable contracting mechanism of the one or more restraining mechanisms 908 may be positioned at a hip of the wearer. In other embodiments, the at least one actuatable portion 909 may be arranged at another position accessible to the wearer. The position of the at least one actuatable portion 909 as close to the hip ensures that the at least one actuatable portion 909 is accessible without interfering with a task that is front of the wearer. Moreover, positioning the at least one actuatable portion 909 as close to the hip allows the wearer to ensure, via proprioception and/or vision, that the expanded state of the one or more restraining mechanisms 908 is sufficient to allow the isolation gown 900 to be lifted over the shoulders and head of the wearer or to fall to the floor around the wearer.

In an embodiment, as in FIG. 9A through FIG. 9C, the at least one actuatable portion 909 may be two actuatable portions that allow for improved control of the one or more restraining mechanisms 908.

In an embodiment, the isolation gown 900 is retained about arms of the wearer by one or more restraining mechanisms 910. The one or more restraining mechanisms 910 may include an adjustable contracting mechanism having at least one actuatable portion 911 that allows for adjusting the one or more restraining mechanisms 910 between a contracted state that secures the sleeves 904 of the isolation gown 900 to the arms of the wearer and an expanded state wherein an opening of a distal end of the sleeves 904 of the isolation gown 900 is large enough to allow the sleeves 904 to slip over hands of the wearer. In an embodiment, the adjustable contracting mechanism may be a drawstring mechanism, a hook and loop mechanism, a button mechanism, a buckle mechanism, an elastic mechanism, and the like. In another embodiment, the adjustable contracting mechanism may include snap/press studs, safety pins, cuff links, brooches, zippers, metal hooks and eye, frog fasteners, toggle fasteners, snap hooks/clasps, grommets/eyelets, glass studs, cords and ropes, sliders, adhesives, clasps, squeeze buckles, and G-hooks, among others. In an example, the adjustable contracting mechanism may be a drawstring. The drawstring may include a cordlock in order to secure the sleeve opening in both of a contracted state and an expanded state. The drawstring may, alternatively, include imprints or depressions to allow for frictional securing of the drawstring within a hem of the sleeve opening in a contracted state and an expanded state. In another embodiment, the adjustable contracting mechanism may be a drawstring comprising elastic materials to allow the sleeve opening, without the aid of a locking mechanism, to be secured to the wearer in a contracted state and easily released from the wearer by expansion to an expanded state.

In an embodiment, the at least one actuatable portion 911 of the adjustable contracting mechanism of the one or more restraining mechanisms 910 may be positioned at wrists of the wearer. In other embodiments, the at least one actuatable portion 911 may be arranged at another position accessible to the wearer. The position of the at least one actuatable portion 911 as close to the wrists ensures that the one or more restraining mechanisms 910 are secured to the arms of the wearer such that contamination via the sleeves 904 is improbable.

In an embodiment, the at least one actuatable portion 911 may be two actuatable portions that allow for improved control of the one or more restraining mechanisms 910.

According to an embodiment, the sleeves 904 may include, at a distal end, one or more openings.

According to an embodiment, each of the adjustable contracting mechanisms of the one or more restraining mechanisms 906, 908, 910, may be a drawstring tape paper. The drawstring tape paper may have an actuatable portion that allows the drawstring tape paper to move from an expanded state to a contracted state, and vice versa.

Figure 9E:
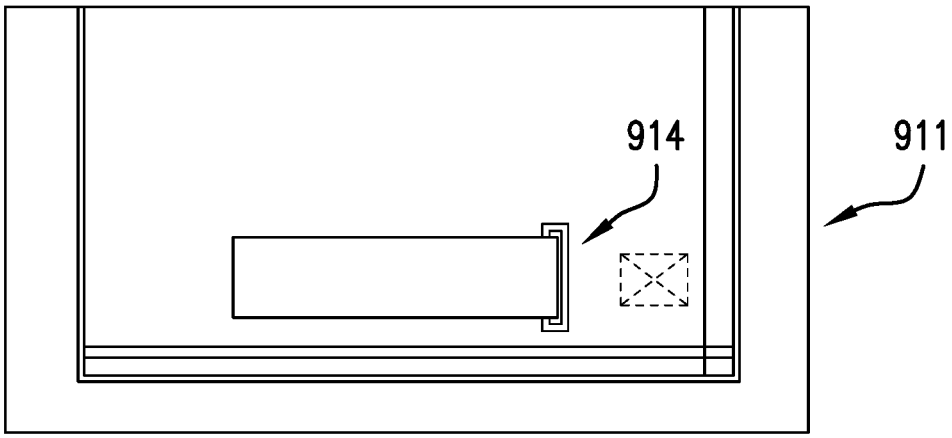
FIG. 9E is an illustration of an aspect of a medical gown, according to an exemplary embodiment of the present disclosure.

In one embodiment, the at least one actuatable portion 911 of the adjustable contracting mechanism of the one or more restraining mechanisms 910 may include self-adhesive tape as illustrated in FIG. 9B and FIG. 9E. A first end of the self-adhesive tape may be fixed to a sleeve 904 of the isolation gown 900 at a fixed point wherein the fixed point may be on the inside of the sleeve 904, or the side of the sleeve 904 in contact with the wearer. In another embodiment, the fixed point may be on the outside of the sleeve 904 or may be exposed to the outside of the sleeve 904, e.g., through a cutout. The first end of the self-adhesive tape may be fixed to the fixed point using an adhesive, stitching, stapling, etc. In one embodiment, the longitudinal second end of the self-adhesive tape may be threaded through an opening 914 in the sleeve 904. The opening 914 may be an incision or slit wherein the length of the opening may be approximately the width of the self-adhesive tape, as shown in FIG. 9E. The self-adhesive tape may be threaded from the inside of the sleeve 904 to the outside of the sleeve 904, or the side that is not in contact with the wearer, through the opening. To actuate the adjustable contracting mechanism of the one or more restraining mechanisms 910, the self-adhesive tape may be folded over to adhere the longitudinal second end of the self-adhesive tape to the outside of the sleeve 904 at an adhesion site. Pressure may be applied to the second end of the self-adhesive tape on top of the adhesion site, e.g., by a digit of the wearer. The pressure may cause the self-adhesive tape to adhere to the adhesion site even when the pressure is removed. In one embodiment, the adhesion site may be located on the outside of the sleeve 904 on top of the fixed point on the inside of the sleeve 904. In another embodiment, the adhesion site may be located on top of another portion of the self-adhesive tape extending from the fixed point. The longitudinal second end of the self-adhesive tape may adhere to the first end or the portion of the self-adhesive tape through the fabric of the sleeve 904. In another embodiment, the self-adhesive tape may adhere directly to the fabric of the sleeve 904 at the adhesion site.

In one embodiment, the self-adhesive tape may be used to contract an opening or a dimension of the isolation gown to the contracted state. For example, a portion of fabric along a dimension of the opening may be folded to reduce the dimension and contract the opening. The self-adhesive tape may be adhered to the folded portion of fabric to maintain the contracted state. In one embodiment, the portion of fabric may be folded between the opening through which the self-adhesive tape is threaded and the adhesion site. The self-adhesive tape may be stretched over the folded portion of fabric and adhere to the adhesion site past the folded portion of fabric to maintain the contracted state. Additionally or alternatively, a portion in the middle of the self-adhesive tape (e.g., not the longitudinal second end of the self-adhesive tape) may be adhered to the adhesion site. In one embodiment, the adhesion of the self-adhesive tape to the adhesion site may be broken by applying a pulling force to the self-adhesive tape or the sleeve 904. In another embodiment, the self-adhesive tape may be torn to release the opening.

According to one embodiment, as illustrated in FIG. 9C, the isolation gown 900 may include a perforated seam 915. In one embodiment, the perforated seam 915 may start at an opening of the garment body 905 of the isolation gown 900. For example, the perforated seam 915 may start at a neck opening or at a base of the garment body 905. The perforated seam 915 may run down the back of the garment body 905 or a portion of the back of the garment body 905. The perforations enable expansion of the garment body 905 of the isolation gown 900. In one embodiment, the isolation gown 900 may be torn open along the perforated seam 915 with less force than would be needed to tear open an unperforated isolation gown along the same location. A wearer may thus apply less force to either side of the perforated seam 915 to expand the garment body 905 for removal of the isolation gown 900. However, the perforated seam 915 may remain intact when force is not applied to the garment body 905. In one embodiment, the perforated seam 915 may end in a slit that runs a portion of the length of the garment body 905. In one embodiment, the perforated seam 915 may be located on the front of the garment body 905. In another embodiment, the perforated seam 915 may be located along a side of the garment body 905. The isolation gown 900 may include multiple perforated seams.

Figure 9F:
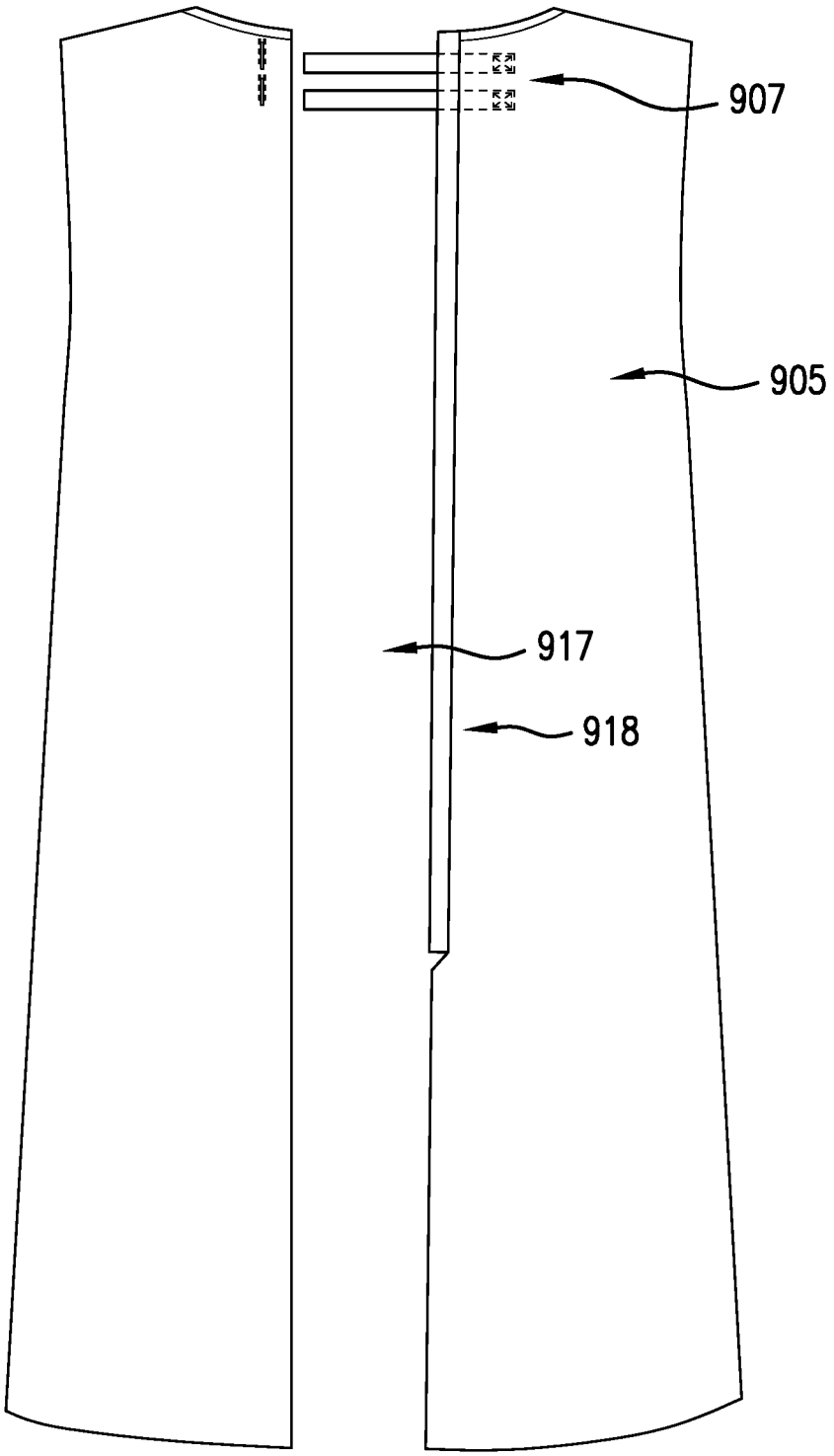
FIG. 9F is an illustration of an aspect of a medical gown, according to an exemplary embodiment of the present disclosure.

In one embodiment, as illustrated in FIG. 9C, the back of the garment body 905 may include an opening 917. The opening may extend from an opening of the garment body 905, e.g., the neck opening of the garment body 905, to approximately the midsection of the wearer. In another embodiment, the garment body 1005 may be closed above and/or below the opening 917. In one embodiment, the perforated seam 915 may begin where the opening 917 terminates. In another embodiment, the back of the garment body 905 may be fully closed below the opening 917. The opening may provide more flexibility in a range of motion of the upper body of the garment body 905 for a wearer. In one embodiment, the opening may be a full opening extending from the neck opening of the garment body 905 to the bottom of the garment body 905. In one embodiment, as illustrated in FIG. 9F, the back of the garment body 905 may include a placket 918, or an additional piece of fabric, attached to one side of the garment body 905. The placket 918 may provide additional fabric coverage when the garment body 905 includes the opening 917. In one embodiment, the self-adhesive tape may be adhered to the placket 918. The placket 918 may run along a portion of the length of the garment body 905. In another embodiment, the placket 918 may run along the full length of the garment body 905.

FIG. 10A through FIG. 10D provide illustrations of an isolation gown 1000, according to an exemplary embodiment of the present disclosure. A body covering portion of the isolation gown 1000, including a garment body 1005 and sleeves 1004, is configured to wrap about the torso of a wearer. In one embodiment, the medical gown 1000 is manufactured from a non-woven fabric, a woven fabric, a non-woven synthetic, or a woven synthetic. The fabric can be a disposable material and, optionally, can include a fluid resistant lining that prevents the passage of fluids, such as water and bodily fluids, through the garment body 1005 and/or the sleeves 1004. In an embodiment, a length of the isolation gown 1000 is configured to extend from a wearer's shoulders to below their knees.

In an embodiment, the fabric is a non-woven fabric configured to be tearable by a wearer. For example, the non-woven fabric may have a tensile strength of between four and ten pounds. Thus, if the wearer were to grasp opposing sides of a section of the non-woven fabric, and then pull with a force of between four and ten pounds, the fabric would tear.

In an embodiment, the sleeves 1004 extend distally from the garment body 1005 and are configured to receive arms of the wearer when the isolation gown 1000 is donned. As in FIG. 10A, the sleeves 1004 are illustrated as long sleeves, though it can be appreciated that any length sleeve can be used so long as required protection is provided. In an embodiment, the isolation gown 1000 may include one or more pockets.

Figure 10A:
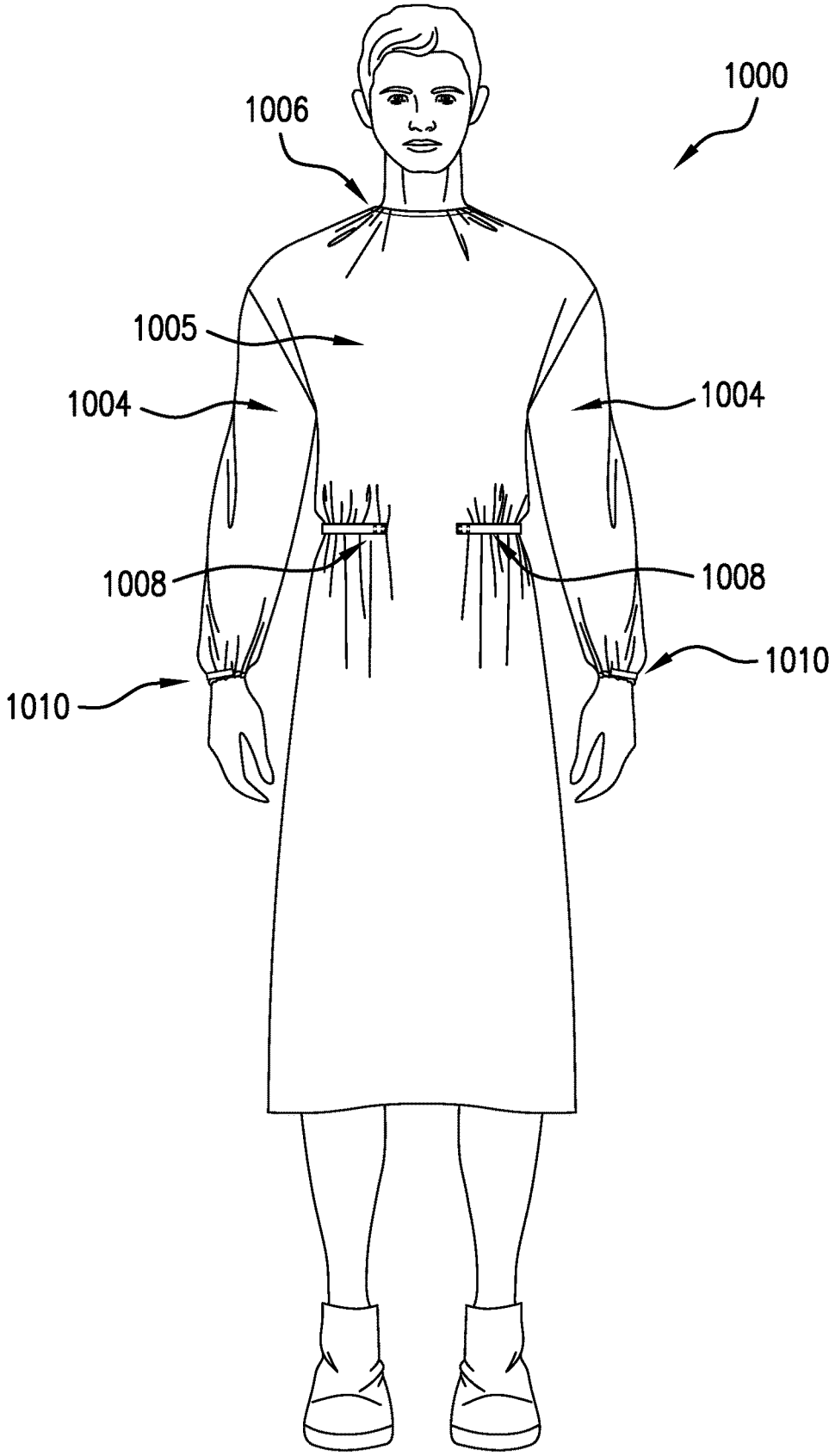
FIG. 10A is a stylized illustration of a wearer having donned a medical gown, according to an exemplary embodiment of the present disclosure.

In the illustrative embodiment of FIG. 10A, the garment body 1005 includes, at a lower end, a body opening through which the body of the wearer can be introduced. In an embodiment, the body opening can be configured with a slit that runs a portion of a length of the garment body 1005.

Figure 10C:
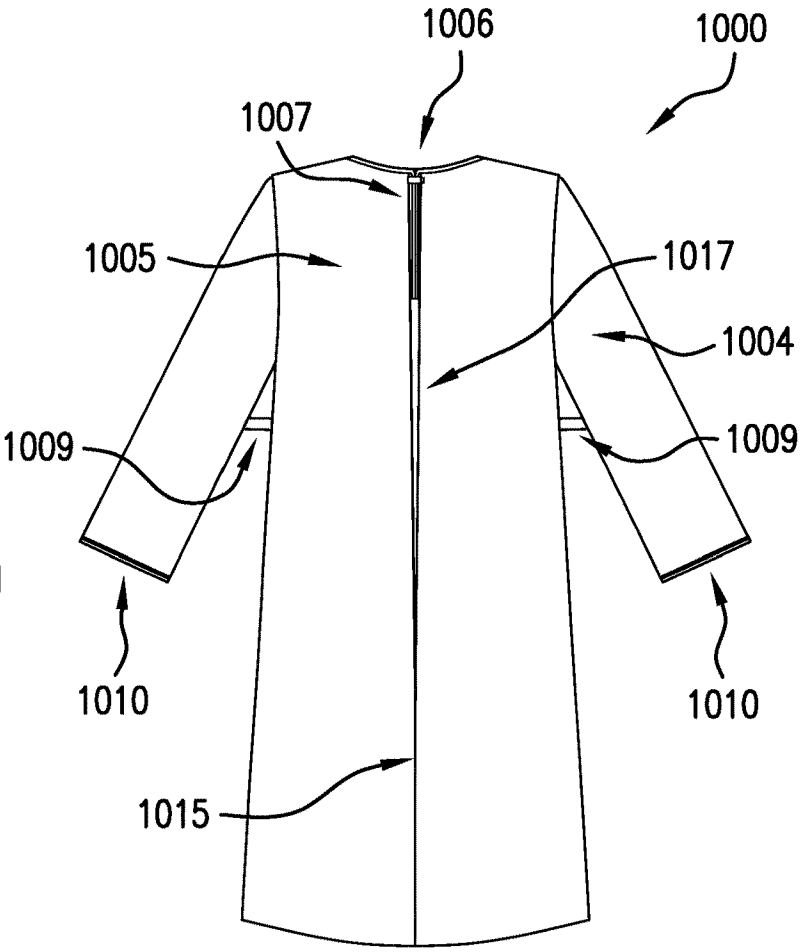
FIG. 10C is an illustration of a rear view of a medical gown, according to an exemplary embodiment of the present disclosure.
Figure 10B:
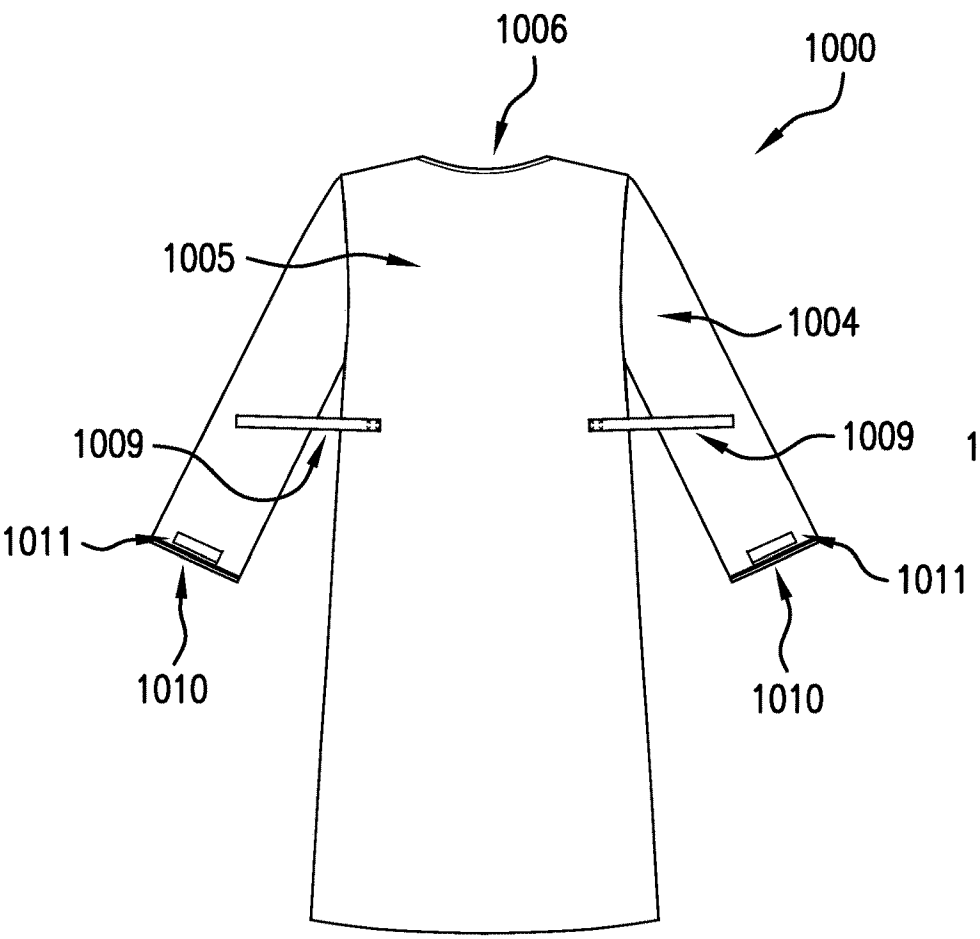
FIG. 10B is an illustration of a front view of a medical gown, according to an exemplary embodiment of the present disclosure.

In an embodiment, and with particular reference to FIG. 10B, the isolation gown 1000 is retained about the neck of the wearer by one or more restraining mechanisms 1006. The one or more restraining mechanisms 1006 may include an adjustable contracting mechanism having at least one actuatable portion 1007 that allows for adjusting the one or more restraining mechanisms 1006 between a contracted state that secures a neck opening of the isolation gown 1000 to the neck of the wearer and an expanded state wherein the neck opening of the isolation gown 1000 is large enough to allow the isolation gown 1000 to be lifted over the head of the wearer and disposed or slipped to the floor around the body of the wearer and disposed. In an embodiment, the adjustable contracting mechanism may be a drawstring mechanism, a hook and loop mechanism, a button mechanism, a buckle mechanism, an elastic mechanism, and the like. In another embodiment, the adjustable contracting mechanism may be integrated with a powered air-purifying respirator (PAPR) system, and the contracted state and the expanded state of the adjustable contracting mechanism may be controlled by an amount of fluid from the PAPR system and within the one or more restraining mechanisms 1006. In another embodiment, the adjustable contracting mechanism may include snap/press studs, safety pins, cuff links, brooches, zippers, metal hooks and eye, frog fasteners, toggle fasteners, snap hooks/clasps, grommets/eyelets, glass studs, cords and ropes, sliders, adhesives, clasps, squeeze buckles, and G-hooks, among others. In an example, the adjustable contracting mechanism may be a drawstring. The drawstring may include a cordlock in order to secure the neck opening in both of a contracted state and an expanded state. The drawstring may, alternatively, include imprints or depressions to allow for frictional securing of the drawstring within a hem of the neck opening in a contracted state and an expanded state. In another embodiment, the adjustable contracting mechanism may be a drawstring comprising elastic materials to allow the neck opening, without the aid of a locking mechanism, to be secured to the wearer in a contracted state and easily released from the wearer by expansion to an expanded state.

In an embodiment, the at least one actuatable portion 1007 of the adjustable contracting mechanism of the one or more restraining mechanisms 1006 may be positioned along a shoulder line of the wearer and proximate a glenohumeral joint of the wearer. In other embodiments, the at least one actuatable portion 1007 may be arranged at another position accessible to the wearer. For instance, the at least one actuatable portion 1007 may be arranged in front of the wearer so as to be visible and easily reached when the wearer wishes to doff the isolation gown 1000. In other embodiments, the at least one actuatable portion 1007 may be more than one actuatable portion.

Figure 10D:
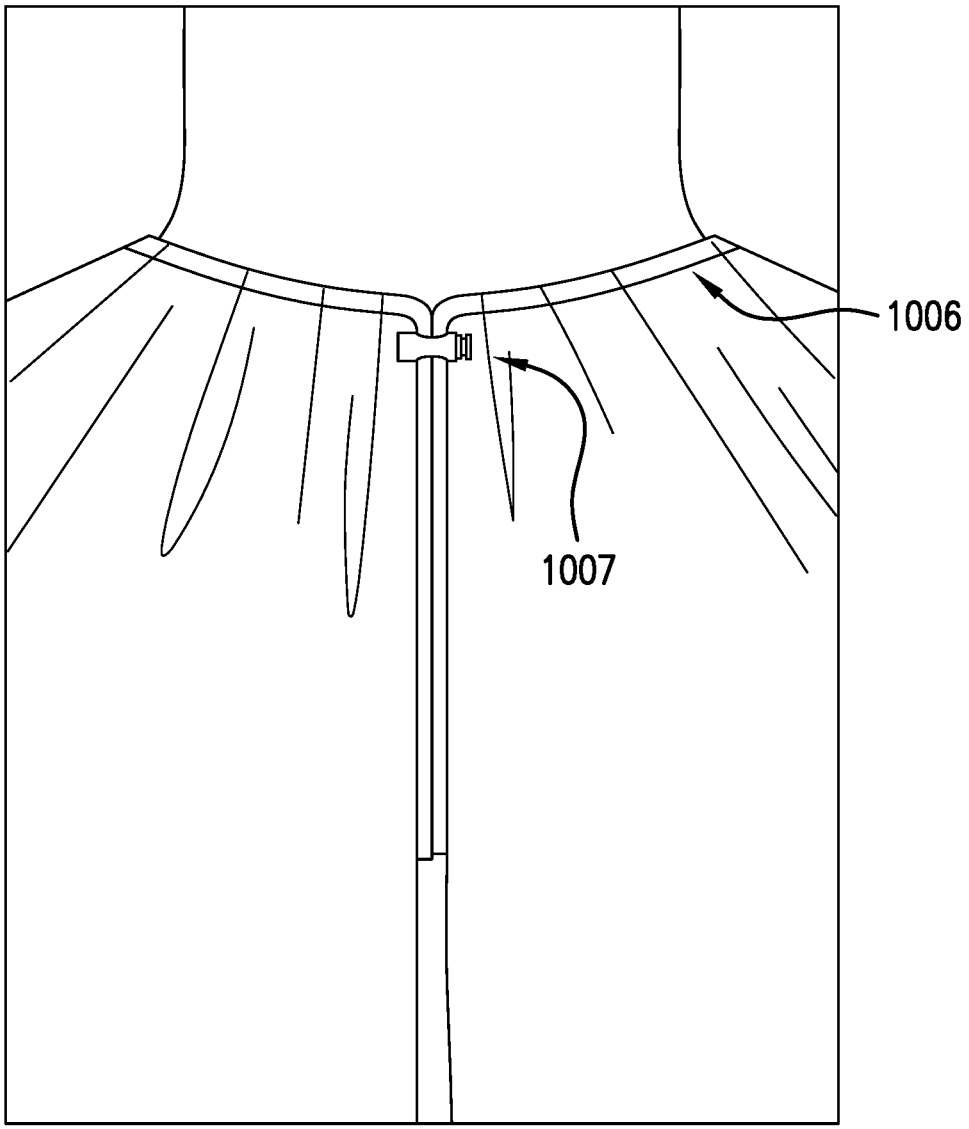
FIG. 10D is an illustration of an aspect of a medical gown, according to an exemplary embodiment of the present disclosure.

In another embodiment, as illustrated in FIG. 10C and FIG. 10D, the at least one actuatable portion 1007 of the adjustable contracting mechanism of the one or more restraining mechanisms 1006 may be positioned at the back of the garment body 1005. In one embodiment, the one or more restraining mechanisms 1006 may be a drawstring, and the at least one actuatable portion 1007 may be a cordlock. In one embodiment, as illustrated in FIG. 10D, a first end of the drawstring and a second end of the drawstring can be drawn through the barrel of the cordlock. The ends are not looped, and the length of each end through the cordlock can be adjusted separately. The separate ends of the drawstring enable portions of the neck opening to be contracted and/or expanded independently.

In an embodiment, the isolation gown 1000 is retained about a midsection of the wearer by one or more restraining mechanisms 1008. The one or more restraining mechanisms 1008 may include an adjustable contracting mechanism having at least one actuatable portion 1009 that allows for adjusting the one or more restraining mechanisms 1008 between a contracted state that secures the garment body 1005 of the isolation gown 1000 to the midsection of the wearer and an expanded state wherein an area of the garment body 1005 of the isolation gown 1000 is large enough to allow the isolation gown 1000 to be lifted over the head of the wearer or slipped to the floor around the body of the wearer. In an embodiment, the adjustable contracting mechanism may be a drawstring mechanism, a hook and loop mechanism, a button mechanism, a buckle mechanism, an elastic mechanism, and the like. In another embodiment, the adjustable contracting mechanism may include snap/press studs, safety pins, cuff links, brooches, zippers, metal hooks and eye, frog fasteners, toggle fasteners, snap hooks/clasps, grommets/eyelets, glass studs, cords and ropes, sliders, adhesives, clasps, squeeze buckles, and G-hooks, among others. In an example, the adjustable contracting mechanism may be a drawstring. The drawstring may include a cordlock in order to secure a midsection of the garment body in both of a contracted state and an expanded state. The drawstring may, alternatively, include imprints or depressions to allow for frictional securing of the drawstring within a hem of the midsection of the garment body in a contracted state and an expanded state. In another embodiment, the adjustable contracting mechanism may be a drawstring comprising elastic materials to allow the midsection of the garment body, without the aid of a locking mechanism, to be secured to the wearer in a contracted state and easily released from the wearer by expansion to an expanded state.

In an embodiment, the at least one actuatable portion 1009 of the adjustable contracting mechanism of the one or more restraining mechanisms 1008 may be positioned at a hip of the wearer. In other embodiments, the at least one actuatable portion 1009 may be arranged at another position accessible to the wearer. The position of the at least one actuatable portion 1009 as close to the hip ensures that the at least one actuatable portion 1009 is accessible without interfering with a task that is front of the wearer. Moreover, positioning the at least one actuatable portion 1009 as close to the hip allows the wearer to ensure, via proprioception and/or vision, that the expanded state of the one or more restraining mechanisms 1008 is sufficient to allow the isolation gown 1000 to be lifted over the shoulders and head of the wearer or to fall to the floor around the wearer.

In one embodiment, the at least one actuatable portion 1009 of the adjustable contracting mechanism of the one or more restraining mechanisms 1008 may include self-adhesive tape, as illustrated in FIG. 10B and FIG. 10C. A first end of the self-adhesive tape may be fixed to the garment body 1005 at a fixed point. In one embodiment, the fixed point may be on the inside of the garment body 1005. In another embodiment, the fixed point may be on the outside of the garment body 1005 or may be exposed to the outside of the garment body 1005, e.g., through a cutout. The first end of the self-adhesive tape may be fixed to the fixed point using an adhesive, stitching, stapling, etc. In one embodiment, the longitudinal second end of the self-adhesive tape may be threaded through an opening in the garment body 1005. The opening may be an incision or slit wherein the length of the opening may be approximately the width of the self-adhesive tape. The self-adhesive tape may be threaded from the inside of the garment body 1005 to the outside of the garment body 1005, or the side that is not in contact with the wearer, through the opening. To actuate the adjustable contracting mechanism of the one or more restraining mechanisms 1008, the self-adhesive tape may be folded over to adhere the longitudinal second end of the self-adhesive tape to the outside of the garment body 1005 at an adhesion site. Pressure may be applied to the second end of the self-adhesive tape on top of the adhesion site, e.g., by a digit of the wearer. The pressure may cause the self-adhesive tape to adhere to the adhesion site even when the pressure is removed. In one embodiment, the adhesion site may be located on the outside of the garment body 1005 on top of the fixed point on the inside of the garment body 1005. In another embodiment, the adhesion site may be located on top of another portion of the self-adhesive tape extending from the fixed point. The longitudinal second end of the self-adhesive tape may adhere to the first end or the portion of the self-adhesive tape through the fabric of the garment body 1005. In another embodiment, the self-adhesive tape may adhere directly to the fabric of the garment body 1005 at the adhesion site.

In one embodiment, the self-adhesive tape may be used to contract an opening or a dimension of the isolation gown to the contracted state. For example, a portion of fabric along a dimension of the opening may be folded to reduce the dimension and contract the opening. The self-adhesive tape may be adhered to the folded portion of fabric to maintain the contracted state. In one embodiment, the portion of fabric may be folded between the opening through which the self-adhesive tape is threaded through the garment body 1005 and the adhesion site. The self-adhesive tape may be stretched over the folded portion of fabric and adhere to the adhesion site past the folded portion of fabric to maintain the contracted state. Additionally or alternatively, a portion in the middle of the self-adhesive tape (e.g., not the longitudinal second end of the self-adhesive tape) may be adhered to the adhesion site to contract the opening. In one embodiment, the adhesion of the self-adhesive tape to the adhesion site can be broken by applying a pulling force to the self-adhesive tape or the opening. In another embodiment, the self-adhesive tape may be torn to release the opening.

In an embodiment, as in FIG. 10A through FIG. 10C, the at least one actuatable portion 1009 may be two actuatable portions that allow for improved control of the one or more restraining mechanisms 1008.

In an embodiment, the isolation gown 1000 is retained about arms of the wearer by one or more restraining mechanisms 1010. The one or more restraining mechanisms 1010 may include an adjustable contracting mechanism having at least one actuatable portion 1011 that allows for adjusting the one or more restraining mechanisms 1010 between a contracted state that secures the sleeves 1004 of the isolation gown 1000 to the arms of the wearer and an expanded state wherein an opening of a distal end of the sleeves 1004 of the isolation gown 1000 is large enough to allow the sleeves 1004 to slip over hands of the wearer. In an embodiment, the adjustable contracting mechanism may be a drawstring mechanism, a hook and loop mechanism, a button mechanism, a buckle mechanism, an elastic mechanism, and the like. In another embodiment, the adjustable contracting mechanism may include snap/press studs, safety pins, cuff links, brooches, zippers, metal hooks and eye, frog fasteners, toggle fasteners, snap hooks/clasps, grommets/eyelets, glass studs, cords and ropes, sliders, adhesives, clasps, squeeze buckles, and G-hooks, among others. In an example, the adjustable contracting mechanism may be a drawstring. The drawstring may include a cordlock in order to secure the sleeve opening in both of a contracted state and an expanded state. The drawstring may, alternatively, include imprints or depressions to allow for frictional securing of the drawstring within a hem of the sleeve opening in a contracted state and an expanded state. In another embodiment, the adjustable contracting mechanism may be a drawstring comprising elastic materials to allow the sleeve opening, without the aid of a locking mechanism, to be secured to the wearer in a contracted state and easily released from the wearer by expansion to an expanded state.

In an embodiment, the at least one actuatable portion 1011 of the adjustable contracting mechanism of the one or more restraining mechanisms 1010 may be positioned at wrists of the wearer. In other embodiments, the at least one actuatable portion 1011 may be arranged at another position accessible to the wearer. The position of the at least one actuatable portion 1011 as close to the wrists ensures that the one or more restraining mechanisms 1010 are secured to the arms of the wearer such that contamination via the sleeves 1004 is improbable.

In an embodiment, the at least one actuatable portion 1011 may be two actuatable portions that allow for improved control of the one or more restraining mechanisms 1010.

According to an embodiment, the sleeves 1004 may include, at a distal end, one or more openings.

According to an embodiment, each of the adjustable contracting mechanisms of the one or more restraining mechanisms 1006, 1008, 1010, may be a drawstring tape paper. The drawstring tape paper may have an actuatable portion that allows the drawstring tape paper to move from an expanded state to a contracted state, and vice versa.

In one embodiment, the at least one actuatable portion 1011 of the adjustable contracting mechanism of the one or more restraining mechanisms 1010 may include self-adhesive tape, as illustrated in FIG. 10B. A first end of the self-adhesive tape may be fixed to a sleeve 1004 at a fixed point wherein the fixed point may be on the inside of the sleeve 1004, or the side of the sleeve 1004 in contact with the wearer. In another embodiment, the fixed point may be on the outside of the sleeve 1004 or may be exposed to the outside of the sleeve 1004, e.g., through a cutout. The first end of the self-adhesive tape may be fixed to the fixed point using an adhesive, stitching, stapling, etc. In one embodiment, the longitudinal second end of the self-adhesive tape may be threaded through an opening in the sleeve 1004. The opening may be an incision or slit wherein the length of the opening is approximately the width of the self-adhesive tape. The self-adhesive tape may be threaded from the inside of the sleeve 1004 to the outside of the sleeve 1004 through the opening. To actuate the adjustable contracting mechanism of the one or more restraining mechanisms 1010, the self-adhesive tape may be folded over to adhere the longitudinal second end of the self-adhesive tape to the outside of the sleeve 1004 at an adhesion site. Pressure may be applied to the longitudinal second end of the self-adhesive tape on top of the adhesion site, e.g., by a digit of the wearer. The pressure may cause the self-adhesive tape to adhere to the adhesion site even when the pressure is removed. In one embodiment, the adhesion site may be located on the outside of the sleeve 1004 on top of the fixed point on the inside of the sleeve 1004. In another embodiment, the adhesion site may be located on top of another portion of the self-adhesive tape extending from the fixed point. The longitudinal second end of the self-adhesive tape may adhere to the first end or the portion of the self-adhesive tape through the fabric of the sleeve 1004. In another embodiment, the self-adhesive tape may adhere directly to the fabric of the sleeve 1004 at the adhesion site.

In one embodiment, the self-adhesive tape may be used to contract an opening or a dimension of the isolation gown to the contracted state. For example, a portion of fabric along a dimension of the opening may be folded to reduce the dimension and contract the opening. The self-adhesive tape may be adhered to the folded portion of fabric to maintain the contracted state. In one embodiment, the portion of fabric may be folded between the opening through which the self-adhesive tape is threaded and the adhesion site. The self-adhesive tape may be stretched over the folded portion of fabric and adhere to the adhesion site past the folded portion of fabric to maintain the contracted state. Additionally or alternatively, a portion in the middle of the self-adhesive tape (e.g., not the longitudinal second end of the self-adhesive tape) may be adhered to the adhesion site. In one embodiment, the adhesion of the self-adhesive tape to the adhesion site may be broken by applying a pulling force to the self-adhesive tape or the sleeve 1004. In another embodiment, the self-adhesive tape may be torn to release the opening.

According to one embodiment, as illustrated in FIG. 10C, the isolation gown 1000 may include a perforated seam 1015. In one embodiment, the perforated seam 1015 may start at an opening of the garment body 1005 of the isolation gown 1000. For example, the perforated seam 1015 may start at a neck opening or at a base of the garment body 1005. The perforated seam 1015 may run down the back of the garment body 1005 or a portion of the back of the garment body 1005. The perforations enable expansion of the garment body 1005 of the isolation gown 1000. In one embodiment, the isolation gown 1000 can be torn open along the perforated seam 1015 with less force than would be needed to tear open an unperforated isolation gown along the same location. A wearer may thus apply less force to either side of the perforated seam 1015 to expand the garment body 1005 for removal of the isolation gown 1000. However, the perforated seam 1015 may remain intact when force is not applied to the garment body 1005. In one embodiment, the perforated seam 1015 may end in a slit that runs a portion of the length of the garment body 1005. In another embodiment, the perforated seam 1015 may end in a closed portion of the garment body 1005. In one embodiment, the perforated seam 1015 may be located on the front of the garment body 1005. In another embodiment, the perforated seam 1015 may be located along a side of the garment body 1005. In one embodiment, the isolation gown 1000 may include multiple perforated seams.

In one embodiment, as illustrated in FIG. 10C, the back of the garment body 1005 may include an opening 1017. The opening 1017 may extend from an opening of the garment body 1005, e.g., the neck opening of the garment body 1005, to approximately the midsection of the wearer. In another embodiment, the garment body 1005 may be closed above and/or below the opening 1017. In one embodiment, the perforated seam 1015 may begin where the opening 1017 terminates. In another embodiment, the back of the garment body 1005 may be fully closed below the opening 1017. The opening may provide more flexibility in a range of motion of the upper body of the garment body 1005 for a wearer. In one embodiment, the opening may be a full opening extending from the neck opening of the garment body 1005 to the bottom of the garment body 1005.

FIG. 11A through FIG. 11D provide illustrations of an isolation gown 1100, according to an exemplary embodiment of the present disclosure. A body covering portion of the isolation gown 1100, including a garment body 1105 and sleeves 1104, is configured to wrap about the torso of a wearer. In one embodiment, the medical gown 1100 is manufactured from a non-woven fabric, a woven fabric, a non-woven synthetic, or a woven synthetic. The fabric can be a disposable material and, optionally, can include a fluid resistant lining that prevents the passage of fluids, such as water and bodily fluids, through the garment body 1105 and/or the sleeves 1104. In an embodiment, a length of the isolation gown 1100 is configured to extend from a wearer's shoulders to below their knees.

In an embodiment, the fabric is a non-woven fabric configured to be tearable by a wearer. For example, the non-woven fabric may have a tensile strength of between four and ten pounds. Thus, if the wearer were to grasp opposing sides of a section of the non-woven fabric, and then pull with a force of between four and ten pounds, the fabric would tear.

In an embodiment, the sleeves 1104 extend distally from the garment body 1105 and are configured to receive arms of the wearer when the isolation gown 1100 is donned. As in FIG. 11A, the sleeves 1104 are illustrated as long sleeves, though it can be appreciated that any length sleeve can be used so long as required protection is provided. In an embodiment, the isolation gown 1100 may include one or more pockets.

Figure 11B:
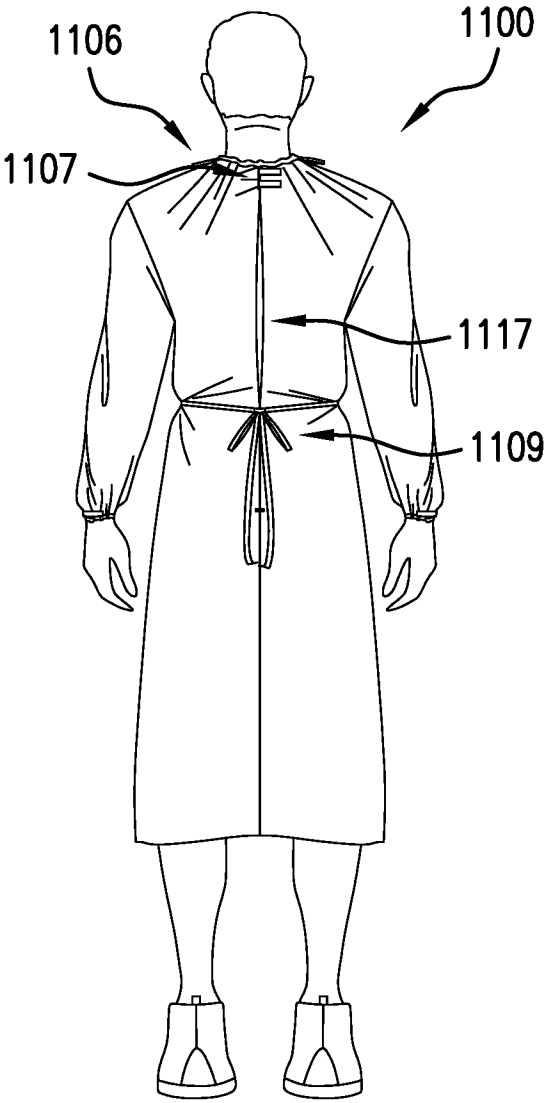
FIG. 11B is a rear view of a stylized illustration of a wearer having donned a medical gown, according to an exemplary embodiment of the present disclosure.
Figure 11A:
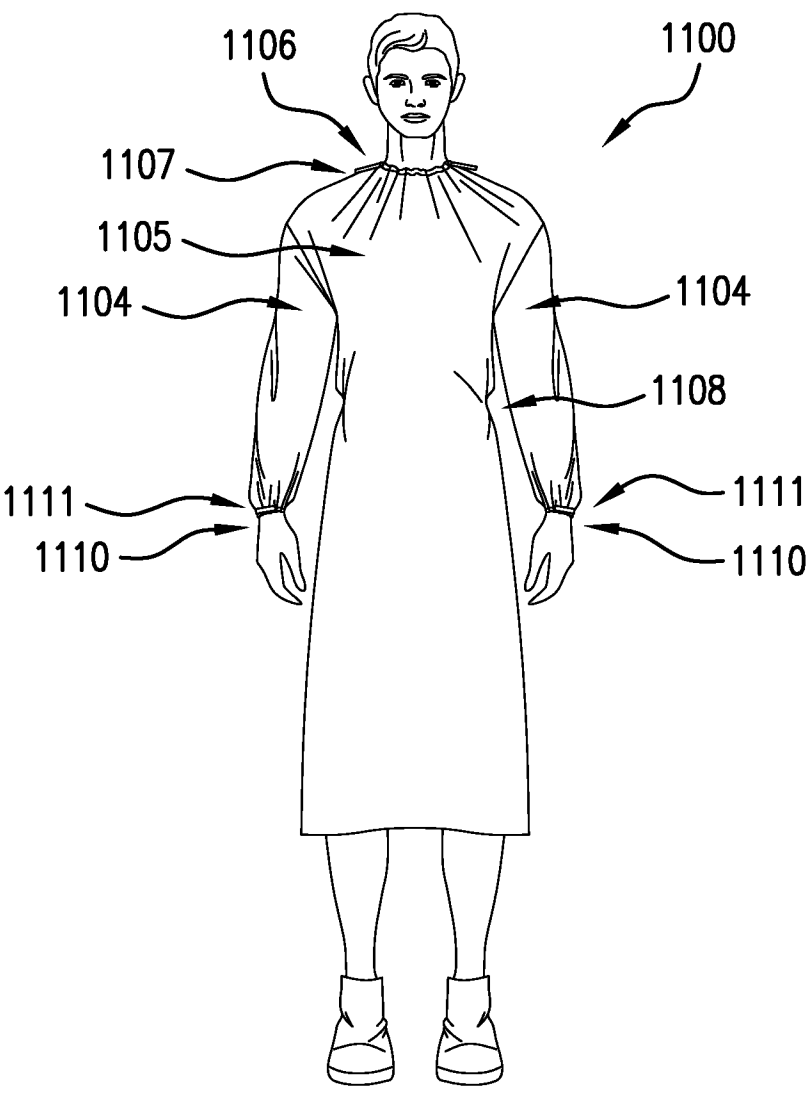
FIG. 11A is a stylized illustration of a wearer having donned a medical gown, according to an exemplary embodiment of the present disclosure.

In the illustrative embodiment of FIG. 11A, the garment body 1105 includes, at a lower end, a body opening through which the body of the wearer can be introduced. In an embodiment, the body opening can be configured with a slit that runs a portion of a length of the garment body 1105.

In an embodiment, and with particular reference to FIG. 11B, the isolation gown 1100 is retained about the neck of the wearer by one or more restraining mechanisms 1106. The one or more restraining mechanisms 1106 may include an adjustable contracting mechanism having at least one actuatable portion 1107 that allows for adjusting the one or more restraining mechanisms 1106 between a contracted state that secures a neck opening of the isolation gown 1100 to the neck of the wearer and an expanded state wherein the neck opening of the isolation gown 1100 is large enough to allow the isolation gown 1100 to be lifted over the head of the wearer and disposed or slipped to the floor around the body of the wearer and disposed. In an embodiment, the adjustable contracting mechanism may be a drawstring mechanism, a hook and loop mechanism, a button mechanism, a buckle mechanism, an elastic mechanism, and the like. In another embodiment, the adjustable contracting mechanism may be integrated with a powered air-purifying respirator (PAPR) system, and the contracted state and the expanded state of the adjustable contracting mechanism may be controlled by an amount of fluid from the PAPR system and within the one or more restraining mechanisms 1106. In another embodiment, the adjustable contracting mechanism may include snap/press studs, safety pins, cuff links, brooches, zippers, metal hooks and eye, frog fasteners, toggle fasteners, snap hooks/clasps, grommets/eyelets, glass studs, cords and ropes, sliders, adhesives, clasps, squeeze buckles, and G-hooks, among others. In an example, the adjustable contracting mechanism may be a drawstring. The drawstring may include a cordlock in order to secure the neck opening in both of a contracted state and an expanded state. The drawstring may, alternatively, include imprints or depressions to allow for frictional securing of the drawstring within a hem of the neck opening in a contracted state and an expanded state. In another embodiment, the adjustable contracting mechanism may be a drawstring comprising elastic materials to allow the neck opening, without the aid of a locking mechanism, to be secured to the wearer in a contracted state and easily released from the wearer by expansion to an expanded state.

Figure 11D:
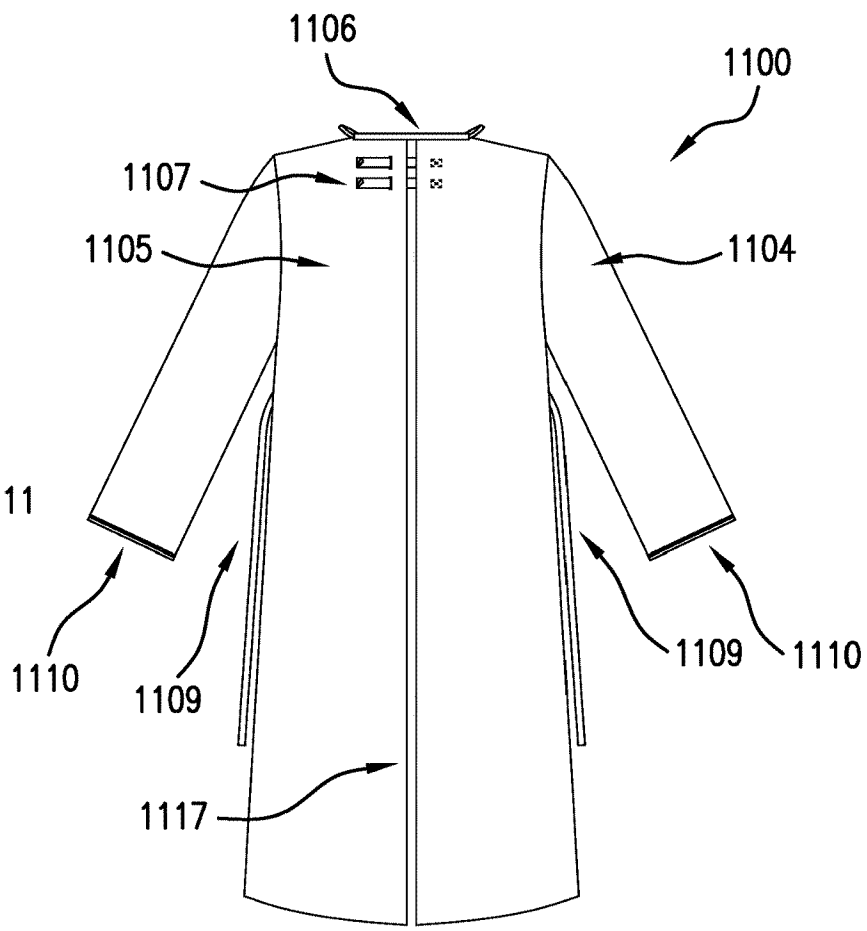
FIG. 11D is an illustration of a rear view of a medical gown, according to an exemplary embodiment of the present disclosure.

In one embodiment, the at least one actuatable portion 1107 of the adjustable contracting mechanism of the one or more restraining mechanisms 1106 may include self-adhesive tape, as illustrated in FIG. 11B and FIG. 11D. A first end of the self-adhesive tape may be fixed to the garment body 1105 at a fixed point wherein the fixed point may be on the inside of the garment body 1105, or the side of the garment body 1105 in contact with the wearer. In another embodiment, the fixed point may be on the outside of the garment body 1005 or may be exposed to the outside of the garment body 1005, e.g., through a cutout. The first end of the self-adhesive tape may be fixed to the fixed point using an adhesive, stitching, stapling, etc. In one embodiment, the longitudinal second end of the self-adhesive tape may be threaded through an opening in the garment body 1105. The opening may be an incision or slit wherein the length of the opening may be approximately the width of the self-adhesive tape. The self-adhesive tape may be threaded from the inside of the garment body 1105 to the outside of the garment body 1105, or the side that is not in contact with the wearer, through the opening. To actuate the adjustable contracting mechanism of the one or more restraining mechanisms 1106, the self-adhesive tape may be folded over to adhere the second end of the self-adhesive tape to the outside of the garment body 1105 at an adhesion site. Pressure may be applied to the second end of the self-adhesive tape on top of the adhesion site, e.g., by a digit of the wearer. The pressure may cause the self-adhesive tape to adhere to the adhesion site even when the pressure is removed. In one embodiment, the adhesion site may be located on the outside of the garment body 1005 on top of the fixed point on the inside of the garment body 1005. In another embodiment, the adhesion site may be located on top of another portion of the self-adhesive tape extending from the fixed point. The longitudinal second end of the self-adhesive tape may adhere to the first end or the portion of the self-adhesive tape through the fabric of the garment body 1105. In another embodiment, the self-adhesive tape may adhere directly to the fabric of the garment body 1105 at the adhesion site.

In one embodiment, the self-adhesive tape may be used to attach two pieces of fabric together. For example, the garment body 1105 may have an opening 1117 along the back of the garment body 1105, as shown in FIG. 11D. The opening may be a partial opening or a full opening. The self-adhesive tape may be used to secure a first side of the full opening 1117 to a second side of the full opening 1117. In one embodiment, the self-adhesive tape may be used to expand or contract the neck opening. For example, a portion in the middle of the self-adhesive tape (e.g., not at the longitudinal second end of the self-adhesive tape) may be adhered to the adhesion site. Adhering a portion in the middle of the self-adhesive tape to the adhesion site may shorten the distance between the first side of the opening and the second side of the opening, thus contracting the neck opening. In one embodiment, the adhesion of the self-adhesive tape to the adhesion site may be broken by applying a pulling force to the self-adhesive tape or the garment body 1105. In another embodiment, the self-adhesive tape may be torn to release the opening.

According to the example illustrated in FIG. 11B and FIG. 11D, the neck opening may include, in addition to the self-adhesive tape, additional adjustable contracting mechanisms. For example, as illustrated in FIG. 11A, the at least one actuatable portion 1107 may include two actuatable portions 1107 on opposing sides of the neck opening. The two actuatable portions 1107 may be actuatable portions of two drawstrings as adjustable contracting mechanisms. In one embodiment, each half of the neck opening can include a channel for a drawstring, wherein the channels do not intersect. Each actuatable portion may be used to adjust a portion of the neck opening (e.g., half of the neck opening) between a contracted state and an expanded state. In one embodiment, the two actuatable portions 1107 may be located approximately at each shoulder of the wearer, as depicted in FIG. 11A.

The isolation gown 1100 having two or more actuatable portions may provide more flexibility to the wearer in adjusting portions of the neck opening between a contracted state and an expanded state. In addition, shortening the span of each adjustable contracting mechanism may improve the gripping or holding ability of each adjustable contracting mechanism to maintain a contracted state of a portion of the neck opening. In one embodiment, the at least one actuatable portion 1107 may include more than two actuatable portions.

In an embodiment, the at least one actuatable portion 1107 of the adjustable contracting mechanism of the one or more restraining mechanisms 1106 may be positioned along a shoulder line of the wearer and proximate a glenohumeral joint of the wearer. In other embodiments, the at least one actuatable portion 1107 may be arranged at another position accessible to the wearer. For instance, the at least one actuatable portion 1107 may be arranged in front of the wearer so as to be visible and easily reached when the wearer wishes to doff the isolation gown 1100.

In an embodiment, the isolation gown 1100 is retained about a midsection of the wearer by one or more restraining mechanisms 1108. The one or more restraining mechanisms 1108 may include an adjustable contracting mechanism having at least one actuatable portion 1109 that allows for adjusting the one or more restraining mechanisms 1108 between a contracted state that secures the garment body 1105 of the isolation gown 1100 to the midsection of the wearer and an expanded state wherein an area of the garment body 1105 of the isolation gown 1100 is large enough to allow the isolation gown 1100 to be lifted over the head of the wearer or slipped to the floor around the body of the wearer. In an embodiment, the adjustable contracting mechanism may be a drawstring mechanism, a hook and loop mechanism, a button mechanism, a buckle mechanism, an elastic mechanism, and the like. In another embodiment, the adjustable contracting mechanism may include snap/press studs, safety pins, cuff links, brooches, zippers, metal hooks and eye, frog fasteners, toggle fasteners, snap hooks/clasps, grommets/eyelets, glass studs, cords and ropes, sliders, adhesives, clasps, squeeze buckles, and G-hooks, among others. In an example, the adjustable contracting mechanism may be a drawstring. The drawstring may include a cordlock in order to secure a midsection of the garment body in both of a contracted state and an expanded state. The drawstring may, alternatively, include imprints or depressions to allow for frictional securing of the drawstring within a hem of the midsection of the garment body in a contracted state and an expanded state. In another embodiment, the adjustable contracting mechanism may be a drawstring comprising elastic materials to allow the midsection of the garment body, without the aid of a locking mechanism, to be secured to the wearer in a contracted state and easily released from the wearer by expansion to an expanded state.

In an embodiment, the at least one actuatable portion 1109 of the adjustable contracting mechanism of the one or more restraining mechanisms 1108 may be positioned at a hip of the wearer. In other embodiments, the at least one actuatable portion 1109 may be arranged at another position accessible to the wearer. The position of the at least one actuatable portion 1109 as close to the hip ensures that the at least one actuatable portion 1109 is accessible without interfering with a task that is front of the wearer. Moreover, positioning the at least one actuatable portion 1109 as close to the hip allows the wearer to ensure, via proprioception and/or vision, that the expanded state of the one or more restraining mechanisms 1108 is sufficient to allow the isolation gown 1100 to be lifted over the shoulders and head of the wearer or to fall to the floor around the wearer.

Figure 11C:
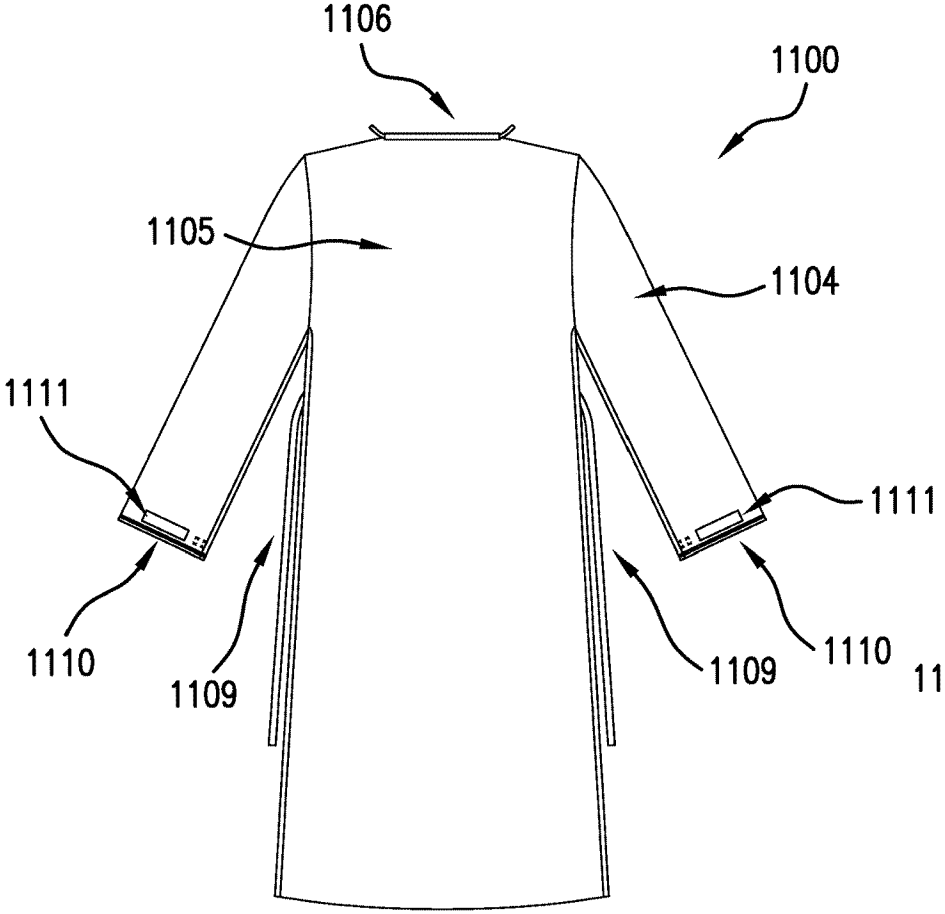
FIG. 11C is an illustration of a front view of a medical gown, according to an exemplary embodiment of the present disclosure.

In one embodiment, as illustrated in FIG. 11B, the at least one actuatable portion 1109 may be at least one paper tie wherein the at least one paper tie may be fastened into a knot or similar mechanism to contract the garment body 1105. A first end of the at least one paper tie may be fixed to the garment body 1105 at a fixed point. The at least one paper tie may be wrapped circumferentially around a portion of the midsection of the wearer and secured by tying a longitudinal second end of the at least one paper tie. In one embodiment, as illustrated in FIG. 11C and FIG. 11D, the at least one actuatable portion 1109 may include two paper ties, each fixed to opposing sides of the garment body 1105. The longitudinal second end of the first paper tie and the longitudinal second end of the second paper tie may be tied together in a knot to retain the isolation gown 1100 about the midsection of the wearer, as illustrated in FIG. 11B. The untied length of the first paper tie between the fixed point of the first paper tie and the knot and the untied length of the second paper tie between the fixed point of the second paper tie and the knot may be adjusted to adjust a dimension (e.g., a circumference) of the midsection of the garment body 1105. In one embodiment, the knot may be located at the back of the garment body. In one embodiment, the first paper tie and/or the second paper tie may be wrapped circumferentially around the midsection of the wearer at least once. In one embodiment, the at least one paper tie may be drawstring tape paper. In one embodiment, the at least one paper tie may be torn to release the midsection of the garment body 1105 from a contracted state to an expanded state.

In an embodiment, the at least one actuatable portion 1109 may be two actuatable portions that allow for improved control of the one or more restraining mechanisms 1108.

In an embodiment, the isolation gown 1100 is retained about arms of the wearer by one or more restraining mechanisms 1110. The one or more restraining mechanisms 1110 may include an adjustable contracting mechanism having at least one actuatable portion 1111 that allows for adjusting the one or more restraining mechanisms 1110 between a contracted state that secures the sleeves 1104 of the isolation gown 1100 to the arms of the wearer and an expanded state wherein an opening of a distal end of the sleeves 1104 of the isolation gown 1100 is large enough to allow the sleeves 1104 to slip over hands of the wearer. In an embodiment, the adjustable contracting mechanism may be a drawstring mechanism, a hook and loop mechanism, a button mechanism, a buckle mechanism, an elastic mechanism, and the like. In another embodiment, the adjustable contracting mechanism may include snap/press studs, safety pins, cuff links, brooches, zippers, metal hooks and eye, frog fasteners, toggle fasteners, snap hooks/clasps, grommets/eyelets, glass studs, cords and ropes, sliders, adhesives, clasps, squeeze buckles, and G-hooks, among others. In an example, the adjustable contracting mechanism may be a drawstring. The drawstring may include a cordlock in order to secure the sleeve opening in both of a contracted state and an expanded state. The drawstring may, alternatively, include imprints or depressions to allow for frictional securing of the drawstring within a hem of the sleeve opening in a contracted state and an expanded state. In another embodiment, the adjustable contracting mechanism may be a drawstring comprising elastic materials to allow the sleeve opening, without the aid of a locking mechanism, to be secured to the wearer in a contracted state and easily released from the wearer by expansion to an expanded state.

In an embodiment, the at least one actuatable portion 1111 of the adjustable contracting mechanism of the one or more restraining mechanisms 1110 may be positioned at wrists of the wearer. In other embodiments, the at least one actuatable portion 1111 may be arranged at another position accessible to the wearer. The position of the at least one actuatable portion 1111 as close to the wrists ensures that the one or more restraining mechanisms 1110 are secured to the arms of the wearer such that contamination via the sleeves 1104 is improbable.

In an embodiment, the at least one actuatable portion 1111 may be two actuatable portions that allow for improved control of the one or more restraining mechanisms 1110.

According to an embodiment, the sleeves 1104 may include, at a distal end, one or more openings.

According to an embodiment, each of the adjustable contracting mechanisms of the one or more restraining mechanisms 1106, 1108, 1110, may be a drawstring tape paper. The drawstring tape paper may have an actuatable portion that allows the drawstring tape paper to move from an expanded state to a contracted state, and vice versa.

In one embodiment, the at least one actuatable portion 1111 of the adjustable contracting mechanism of the one or more restraining mechanisms 1110 may include self-adhesive tape, as illustrated in FIG. 11C. A first end of the self-adhesive tape may be fixed to a sleeve 1104 of the isolation gown 1100 at a fixed point wherein the fixed point may be on the inside of the sleeve 1104, or the side of the sleeve 1104 in contact with the wearer. In another embodiment, the fixed point may be on the outside of the sleeve 1104 or may be exposed to the outside of the sleeve 1104, e.g., through a cutout. The first end of the self-adhesive tape may be fixed to the fixed point using an adhesive, stitching, stapling, etc. In one embodiment, the longitudinal second end of the self-adhesive tape may be threaded through an opening in the sleeve 1104. The opening may be an incision or slit wherein the length of the opening is approximately the width of the self-adhesive tape. The self-adhesive tape may be threaded from the inside of the sleeve 1104 to the outside of the sleeve 1104 through the opening. To actuate the adjustable contracting mechanism of the one or more restraining mechanisms 1110, the self-adhesive tape may be folded over to adhere the longitudinal second end of the self-adhesive tape to the outside of the sleeve 1104 at an adhesion site. Pressure may be applied to the longitudinal second end of the self-adhesive tape on top of the adhesion site, e.g., by a digit of the wearer. The pressure may cause the self-adhesive tape to adhere to the adhesion site even when the pressure is removed. In one embodiment, the adhesion site may be located on the outside of the sleeve 1104 on top of the fixed point on the inside of the sleeve 1104. In another embodiment, the adhesion site may be located on top of another portion of the self-adhesive tape extending from the fixed point. The longitudinal second end of the self-adhesive tape may adhere to the first end or the portion of the self-adhesive tape through the fabric of the sleeve 1104. In another embodiment, the self-adhesive tape may adhere directly to the fabric of the sleeve 1104 at the adhesion site.

In one embodiment, the self-adhesive tape may be used to contract an opening or a dimension of the isolation gown to the contracted state. For example, a portion of fabric along a dimension of the opening may be folded to reduce the dimension and contract the opening. The self-adhesive tape may be adhered to the folded portion of fabric to maintain the contracted state. In one embodiment, the portion of fabric may be folded between the opening through which the self-adhesive tape is threaded and the adhesion site. The self-adhesive tape may be stretched over the folded portion of fabric and adhere to the adhesion site past the folded portion of fabric to maintain the contracted state. Additionally or alternatively, a portion in the middle of the self-adhesive tape (e.g., not the longitudinal second end of the self-adhesive tape) may be adhered to the adhesion site. In one embodiment, the adhesion of the self-adhesive tape to the adhesion site may be broken by applying a pulling force to the self-adhesive tape or the sleeve 1104. In another embodiment, the self-adhesive tape may be torn to release the opening.

FIG. 12A through 12E provide illustrations of an isolation gown 1200, according to an exemplary embodiment of the present disclosure. A body covering portion of the isolation gown 1200, including a garment body 1205 and sleeves 1204, is configured to wrap about the torso of a wearer. In one embodiment, the medical gown 1200 is manufactured from a non-woven fabric, a woven fabric, a non-woven synthetic, or a woven synthetic. The fabric can be a disposable material and, optionally, can include a fluid resistant lining that prevents the passage of fluids, such as water and bodily fluids, through the garment body 1205 and/or the sleeves 1204. In an embodiment, a length of the isolation gown 1200 is configured to extend from a wearer's shoulders to below their knees.

In an embodiment, the fabric is a non-woven fabric configured to be tearable by a wearer. For example, the non-woven fabric may have a tensile strength of between four and ten pounds. Thus, if the wearer were to grasp opposing sides of a section of the non-woven fabric, and then pull with a force of between four and ten pounds, the fabric would tear.

In an embodiment, the sleeves 1204 extend distally from the garment body 1205 and are configured to receive arms of the wearer when the isolation gown 1200 is donned. As in FIG. 12A, the sleeves 1204 are illustrated as long sleeves, though it can be appreciated that any length sleeve can be used so long as required protection is provided. In an embodiment, the isolation gown 1200 may include one or more pockets.

Figure 12A:
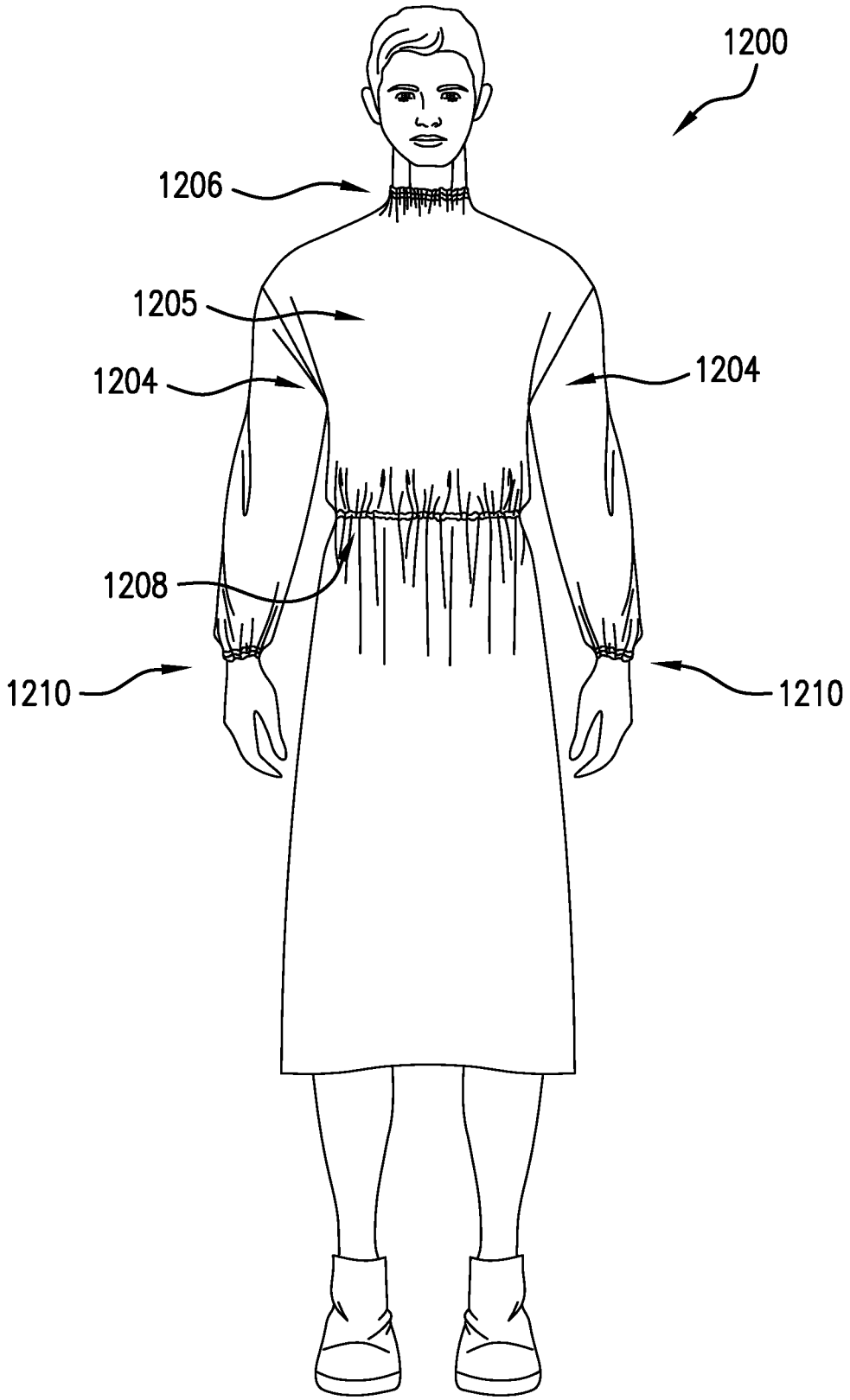
FIG. 12A is a stylized illustration of a wearer having donned a medical gown, according to an exemplary embodiment of the present disclosure.

In the illustrative embodiment of FIG. 12A, the garment body 1205 includes, at a lower end, a body opening through which the body of the wearer can be introduced. In an embodiment, the body opening can be configured with a slit that runs a portion of a length of the garment body 1205.

Figure 12C:
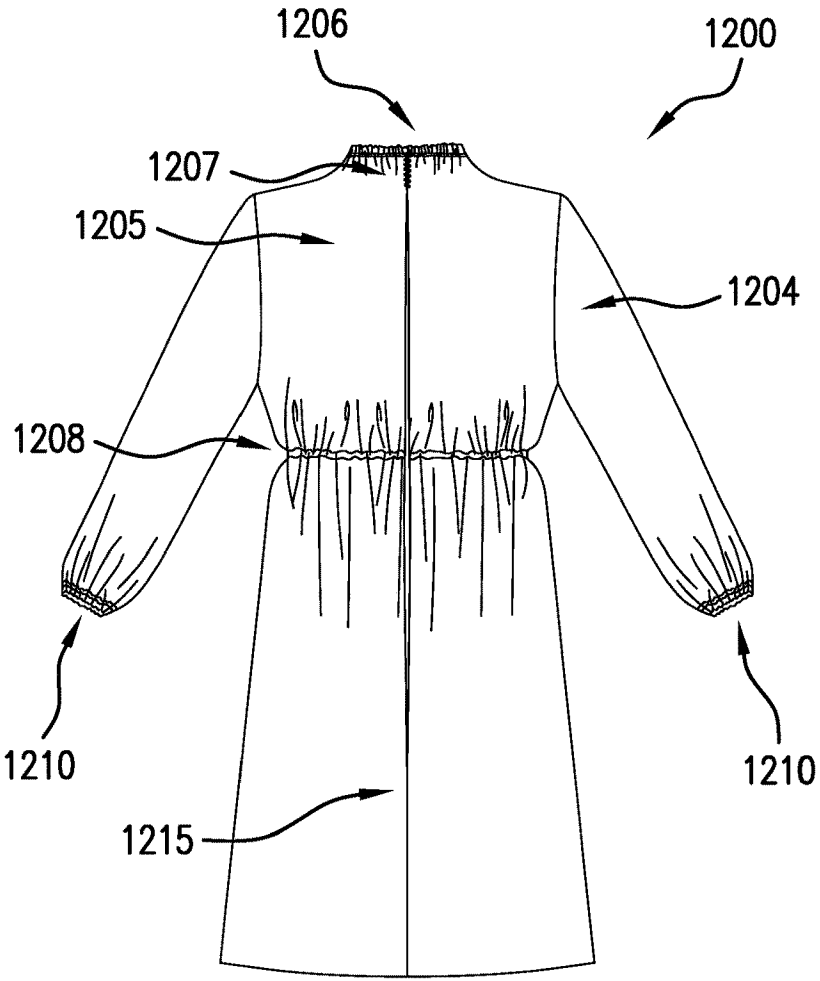
FIG. 12C is an illustration of a rear view of a medical gown, according to an exemplary embodiment of the present disclosure.
Figure 12B:
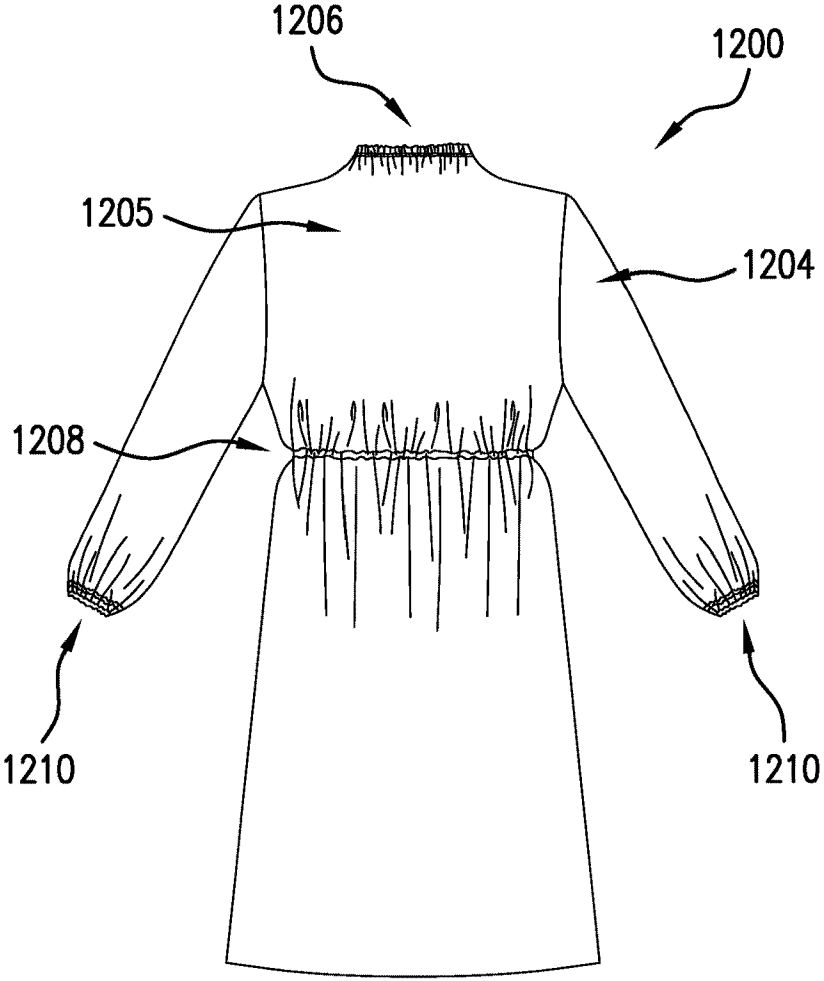
FIG. 12B is an illustration of a front view of a medical gown, according to an exemplary embodiment of the present disclosure.

In an embodiment, and with particular reference to FIG. 12B, the isolation gown 1200 is retained about the neck of the wearer by one or more restraining mechanisms 1206. The one or more restraining mechanisms 1206 may include an adjustable contracting mechanism having at least one actuatable portion 1207 that allows for adjusting the one or more restraining mechanisms 1206 between a contracted state that secures a neck opening of the isolation gown 1200 to the neck of the wearer and an expanded state wherein the neck opening of the isolation gown 1200 is large enough to allow the isolation gown 1200 to be lifted over the head of the wearer and disposed or slipped to the floor around the body of the wearer and disposed. In an embodiment, the adjustable contracting mechanism may be a drawstring mechanism, a hook and loop mechanism, a button mechanism, a buckle mechanism, an elastic mechanism, and the like. In another embodiment, the adjustable contracting mechanism may be integrated with a powered air-purifying respirator (PAPR) system, and the contracted state and the expanded state of the adjustable contracting mechanism may be controlled by an amount of fluid from the PAPR system and within the one or more restraining mechanisms 1206. In another embodiment, the adjustable contracting mechanism may include snap/press studs, safety pins, cuff links, brooches, zippers, metal hooks and eye, frog fasteners, toggle fasteners, snap hooks/clasps, grommets/eyelets, glass studs, cords and ropes, sliders, adhesives, clasps, squeeze buckles, and G-hooks, among others. In an example, the adjustable contracting mechanism may be a drawstring. The drawstring may include a cordlock in order to secure the neck opening in both of a contracted state and an expanded state. The drawstring may, alternatively, include imprints or depressions to allow for frictional securing of the drawstring within a hem of the neck opening in a contracted state and an expanded state.

In one embodiment, as illustrated in FIG. 12A, the adjustable contracting mechanism may be a drawstring comprising elastic materials to allow the neck opening to be secured to the wearer in a contracted state and easily released from the wearer by expansion to an expanded state. A direct pulling force may be applied directly to the elastic drawstring to release the neck opening to the expanded state. An indirect pulling force may also be applied to the garment body 1205, e.g., to the shoulders of the garment body 1205, to the arms of the garment body 1205. The indirect pulling force may result in a pulling force applied to the elastic drawstring to release the neck opening to the expanded state. In one embodiment, the elastic drawstring may be secured to the wearer in the contracted state without a locking mechanism or an actuatable portion.

Figure 12D:
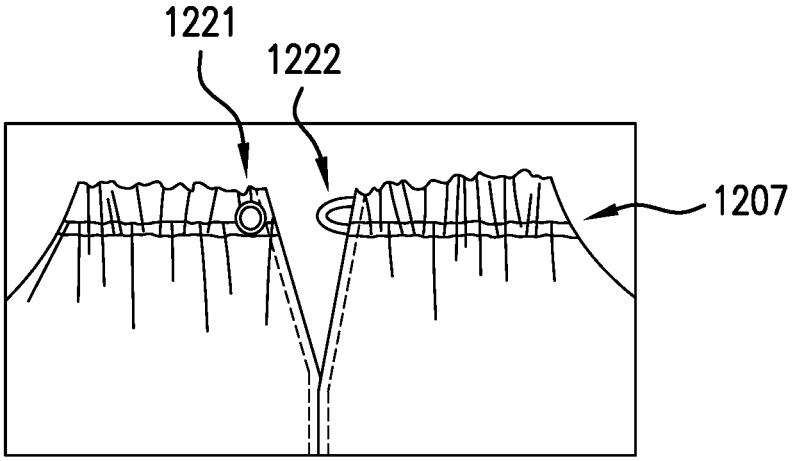
FIG. 12D is an illustration of an aspect of a medical gown, according to an exemplary embodiment of the present disclosure.
Figure 12E:
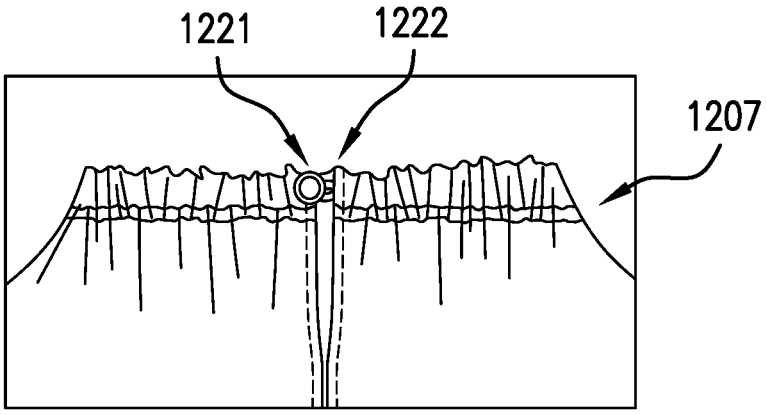
FIG. 12E is an illustration of an aspect of a medical gown neck opening, according to an exemplary embodiment of the present disclosure.

In one embodiment, the neck opening may be an open circle rather than an enclosed circle, as illustrated in FIG. 12D. The elastic drawstring may not be a closed circle or loop but rather may start at a first end of the neck opening and end at a second end of the neck opening. The elastic drawstring may be attached to the first end of the neck opening and the second end of the neck opening via stitching, staples, an adhesive, etc. In another embodiment, the first end of the neck opening may be in contact with the second end of the neck opening, with a perforated seam between the first end and the second end. According to the example embodiment illustrated in FIG. 12D, the actuatable portion 1207 may be a ball and loop mechanism to attach the first end of the neck opening to the second end of the neck opening. The actuatable portion 1207 may include a ball 1221 attached to a first end of the neck opening. A loop 1222 may be attached to a second end of the neck opening. The loop 1222 can be fitted around the ball 1221 to contract the neck opening by bringing the first end of the neck opening and the second end of the neck opening together as illustrated in FIG. 12E. In one embodiment, the loop 1222 may be made of an elastic material. In one embodiment, a dimension of the loop 1222 may be larger than a dimension of the ball 1221 when the loop 1222 is in an expanded state, and the dimension of the loop 1222 may be smaller than the dimension of the ball 1221 when the loop 1222 is in a resting state or a contracted state. External force, e.g., stretching, can be applied to enlarge the loop 1222 to the expanded state so that the ball 1221 can fit through the loop 1222.

In an embodiment, the at least one actuatable portion 1207 of the adjustable contracting mechanism of the one or more restraining mechanisms 1206 may be positioned along a shoulder line of the wearer and proximate a glenohumeral joint of the wearer. In other embodiments, the at least one actuatable portion 1207 may be arranged at another position accessible to the wearer. For instance, the at least one actuatable portion 1207 may be arranged in front of the wearer so as to be visible and easily reached when the wearer wishes to doff the isolation gown 1200.

In an embodiment, the isolation gown 1200 is retained about a midsection of the wearer by one or more restraining mechanisms 1208. The one or more restraining mechanisms 1208 may include an adjustable contracting mechanism having at least one actuatable portion that allows for adjusting the one or more restraining mechanisms 1208 between a contracted state that secures the garment body 1205 of the isolation gown 1200 to the midsection of the wearer and an expanded state wherein an area of the garment body 1205 of the isolation gown 1200 is large enough to allow the isolation gown 1200 to be lifted over the head of the wearer or slipped to the floor around the body of the wearer. In an embodiment, the adjustable contracting mechanism may be a drawstring mechanism, a hook and loop mechanism, a button mechanism, a buckle mechanism, an elastic mechanism, and the like. In another embodiment, the adjustable contracting mechanism may include snap/press studs, safety pins, cuff links, brooches, zippers, metal hooks and eye, frog fasteners, toggle fasteners, snap hooks/clasps, grommets/eyelets, glass studs, cords and ropes, sliders, adhesives, clasps, squeeze buckles, and G-hooks, among others. In an example, the adjustable contracting mechanism may be a drawstring. The drawstring may include a cordlock in order to secure a midsection of the garment body in both of a contracted state and an expanded state. The drawstring may, alternatively, include imprints or depressions to allow for frictional securing of the drawstring within a hem of the midsection of the garment body in a contracted state and an expanded state.

In another embodiment, as illustrated in FIG. 12A, the adjustable contracting mechanism may be a drawstring comprising elastic materials to allow the midsection of the garment body, without the aid of a locking mechanism, to be secured to the wearer in a contracted state and easily released from the wearer by expansion to an expanded state. In one embodiment, the elastic drawstring may not wrap fully around the garment body 1205. For example, only the front half of the garment body may be secured at the midsection by an elastic drawstring. The elastic drawstring may be actuated by applying a pulling force to the elastic drawstring to expand the drawstring.

In an embodiment, the at least one actuatable portion of the adjustable contracting mechanism of the one or more restraining mechanisms 1208 may be positioned at a hip of the wearer. In other embodiments, the at least one actuatable portion may be arranged at another position accessible to the wearer. The position of the at least one actuatable portion as close to the hip ensures that the at least one actuatable portion is accessible without interfering with a task that is front of the wearer. Moreover, positioning the at least one actuatable portion as close to the hip allows the wearer to ensure, via proprioception and/or vision, that the expanded state of the one or more restraining mechanisms 1208 is sufficient to allow the isolation gown 1200 to be lifted over the shoulders and head of the wearer or to fall to the floor around the wearer.

In an embodiment, the at least one actuatable portion may be two actuatable portions that allow for improved control of the one or more restraining mechanisms 1208.

In an embodiment, the isolation gown 1200 is retained about arms of the wearer by one or more restraining mechanisms 1210. The one or more restraining mechanisms 1210 may include an adjustable contracting mechanism having at least one actuatable portion that allows for adjusting the one or more restraining mechanisms 1210 between a contracted state that secures the sleeves 1204 of the isolation gown 1200 to the arms of the wearer and an expanded state wherein an opening of a distal end of the sleeves 1204 of the isolation gown 1200 is large enough to allow the sleeves 1204 to slip over hands of the wearer. In an embodiment, the adjustable contracting mechanism may be a drawstring mechanism, a hook and loop mechanism, a button mechanism, a buckle mechanism, an elastic mechanism, and the like. In another embodiment, the adjustable contracting mechanism may include snap/press studs, safety pins, cuff links, brooches, zippers, metal hooks and eye, frog fasteners, toggle fasteners, snap hooks/clasps, grommets/eyelets, glass studs, cords and ropes, sliders, adhesives, clasps, squeeze buckles, and G-hooks, among others. In an example, the adjustable contracting mechanism may be a drawstring. The drawstring may include a cordlock in order to secure the sleeve opening in both of a contracted state and an expanded state. The drawstring may, alternatively, include imprints or depressions to allow for frictional securing of the drawstring within a hem of the sleeve opening in a contracted state and an expanded state.

In another embodiment, as illustrated in FIG. 12A through FIG. 12C, the adjustable contracting mechanism may be a drawstring comprising elastic materials to allow the sleeve opening, without the aid of a locking mechanism, to be secured to the wearer in a contracted state and easily released from the wearer by expansion to an expanded state. The elastic drawstring may be actuated by applying a pulling force to the elastic drawstring.

In an embodiment, the at least one actuatable portion of the adjustable contracting mechanism of the one or more restraining mechanisms 1210 may be positioned at wrists of the wearer. In other embodiments, the at least one actuatable portion may be arranged at another position accessible to the wearer. The position of the at least one actuatable portion as close to the wrists ensures that the one or more restraining mechanisms 1210 are secured to the arms of the wearer such that contamination via the sleeves 1204 is improbable.

According to an embodiment, the sleeves 1204 may include, at a distal end, one or more openings.

According to one embodiment, as illustrated in FIG. 12C, the isolation gown 1200 can include a perforated seam 1215. In one embodiment, the perforated seam 1215 can start at an opening of the garment body 1205 of the isolation gown 1200. The perforated seam 1215 can run down the back of the garment body 1205 or a portion of the back of the garment body 1205. In one embodiment, the perforated seam 1215 can be located on the front of the garment body 1205. In another embodiment, the perforated seam 1215 can be located along a side of the garment body 1205. The isolation gown 1200 can include multiple perforated seams. The perforations enable expansion of the garment body 1205 of the isolation gown 1200. In one embodiment, the isolation gown 1200 can be torn open along the perforated seam 1215 with less force than would be needed for an unperforated isolation gown. A wearer can thus apply less force to either side of the perforated seam 1215 to remove the isolation gown 1200, e.g., by the top-down method or the bottom-up method. However, the perforated seam 1215 remains intact when force is not applied to the garment body 1205. In one embodiment, the perforated seam 1215 can end in a slit that runs a portion of the length of the garment body 1205.

In one embodiment, the back of the garment body 1205 may include an opening. The opening may extend from the neck opening of the garment body 1205 to approximately the midsection of the wearer. In one embodiment, the perforated seam 1215 can begin where the opening terminates. In another embodiment, the back of the garment body 1205 may be fully closed below the opening. The opening may provide more flexibility in a range of motion of the upper body of the garment body 1205 for a wearer. In one embodiment, the opening may be a full opening extending from the neck opening of the garment body 1205 to the bottom of the garment body 1205.

Figure 13:
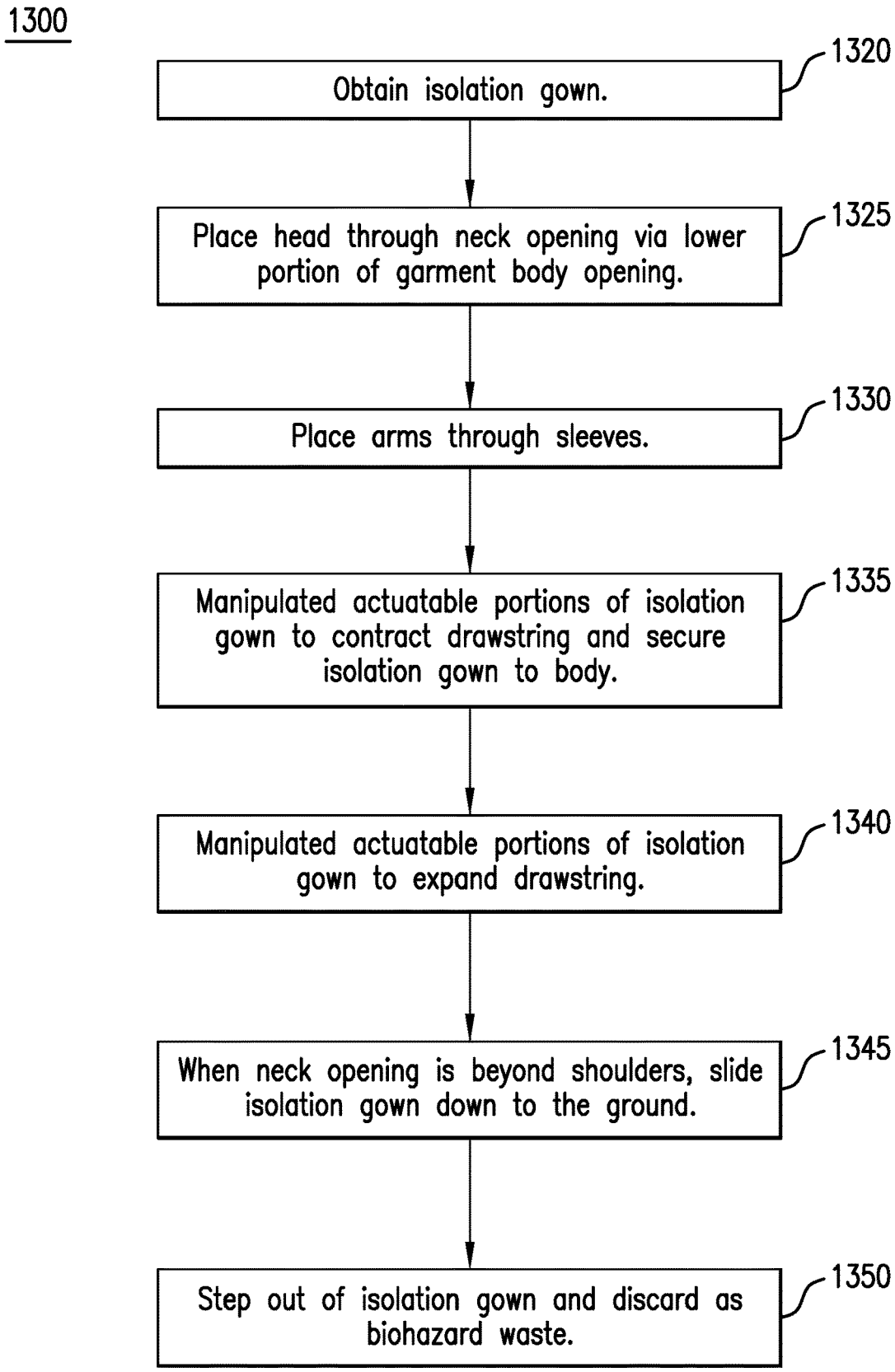
FIG. 13 is a flow diagram of donning and doffing a medical gown, according to an exemplary embodiment of the present disclosure.

Turning now to FIG. 13, an exemplary method 1300 for donning and doffing an isolation gown, in accordance with embodiments of the invention, will be described.

At step 1320 of method 1300, a wearer obtains an isolation gown, as configured herein. As described above, a garment body of the isolation gown includes a body opening and a neck opening. Further, the isolation gown includes one or more restraining mechanisms integrated with the isolation gown and configured to be contractible and or expandable via at least one actuatable portion.

In an embodiment, the isolation gown is preconfigured with the one or more restraining mechanisms in an expanded state. In such an embodiment, the wearer will pass their head through the body opening and the neck opening at step 1325 of method 1300. Subsequently, or concurrently, the wearer may place their arms through the sleeves at step 1330 of method 1300.

Having fit their body to the isolation gown, the wearer may then manipulate the at least one actuatable portion of the one or more restraining mechanisms to secure the isolation gown to the body of the wearer. For instance, an actuatable portion corresponding to the neck opening may be arranged at a glenohumeral joint of the wearer and may be actuated to secure the garment body to the neck of the wearer. Similarly, actuatable portions at the midsection of the wearer and at the wrists of the wearer may be actuated in order to secure the isolation gown to the body of the wearer. At this stage, the isolation gown is secured to the body of the wearer, each of the one or more restraining mechanisms are in a contracted state, and the wearer may provide care to a patient.

After providing care to the patient, the wearer may wish to doff the isolation gown. Accordingly, the wearer may actuate each of the actuatable portions of the one or more restraining mechanisms such that they are moved to an expanded state at step 1340 of method 1300. In other words, the one or more restraining mechanisms may be actuated such that the neck opening, in an example, is larger than a width of the shoulders. In this way, the isolation gown may be slide down the body of the wearer and to the ground at step 1345 of method 1300. In another example, not explicitly described in FIG. 13, the expanded state of the neck opening, at step 1340 of method 1300, is larger than the head of the wearer but smaller than a width of the shoulders of the wearer. This allows for the isolation gown to be lifted over a head of the wearer at step 1345 of method 1300.

Assuming, the expanded state of the neck opening allows the wearer to slip the gown over the shoulders and to the ground, the wearer, at step 1350 of method 1300, may step out of the isolation gown, and the isolation gown may be placed into a biohazard waste receptacle.

Certain features that are described in this specification in the context of separate embodiments can also be implemented in combination in a single embodiment. Conversely, various features that are described in the context of a single embodiment can also be implemented in multiple embodiments separately or in any suitable sub-combination. Moreover, although features may be described above as acting in certain combinations and even initially claimed as such, one or more features from a claimed combination can in some cases be excised from the combination, and the claimed combination may be directed to a sub-combination or variation of a sub-combination.

Particular embodiments of the subject matter have been described. Other embodiments are within the scope of the following claims. For example, the actions recited in the claims can be performed in a different order and still achieve desirable results. As one example, the processes depicted in the accompanying figures do not necessarily require the particular order shown, or sequential order, to achieve desirable results. In some cases, multitasking and parallel processing may be advantageous.

Obviously, numerous modifications and variations are possible in light of the above teachings. It is therefore to be understood that within the scope of the appended claims, the invention may be practiced otherwise than as specifically described herein.

Thus, the foregoing discussion discloses and describes merely exemplary embodiments of the present invention. As will be understood by those skilled in the art, the present invention may be embodied in other specific forms without departing from the spirit or essential characteristics thereof. Accordingly, the disclosure of the present invention is intended to be illustrative, but not limiting of the scope of the invention, as well as other claims. The disclosure, including any readily discernible variants of the teachings herein, defines, in part, the scope of the foregoing claim terminology such that no inventive subject matter is dedicated to the public.

The invention claimed is:

1. An isolation gown, comprising:

a garment body including a shoulder portion, a neck opening and a body opening;

sleeves extending distally from the garment body, each of the sleeves having sleeve openings;

one or more neck restraints configured to contract the neck opening;

one or more sleeve opening restraints configured to contract the sleeve openings; and one or more midsection restraints configured to contract the garment body at a predetermined point, wherein the one or more neck restraints include an actuatable portion configured to contract the one or more neck restraints and fix the neck opening at a contracted neck circumference position, wherein the contracted neck circumference is smaller than a circumference of the body opening, wherein the actuatable portion is further configured to loosen the one or more neck restraints to fix the neck opening at an expanded neck circumference position, and wherein the expanded neck circumference is larger than the contracted neck circumference, wherein the shoulder portion is located between the neck opening and sleeves, and wherein in each of the contracted neck circumference position and the expanded neck circumference position, the actuatable portion is positioned along a shoulder line of the shoulder portion.

2. The isolation gown of claim 1, wherein the garment body includes a turtleneck connecting the garment body to the neck opening.

3. The isolation gown of claim 1, wherein the one or more neck restraints, the one or more sleeve opening restraints, and/or the one or more midsection restraints includes a drawstring.

4. The isolation gown of claim 3, wherein the drawstring is elastic.

5. The isolation gown of claim 1, wherein the one or more neck restraints, the one or more sleeve opening restraints, and/or the one or more midsection restraints includes drawstring tape paper.

6. The isolation gown of claim 1, wherein the actuatable portion includes an exposed portion of the one or more neck restraints.

7. The isolation gown of claim 1, wherein the actuatable portion includes self-adhesive tape or a ball and loop mechanism.

8. The isolation gown of claim 1, wherein the garment body includes a backside perforation that extends from the neck opening to the body opening and bisects the neck restraints.

9. The isolation gown of claim 1, wherein the expanded neck circumference is approximately the circumference of the body opening.

10. The isolation gown of claim 1, wherein the one or more sleeve opening restraints include an actuatable sleeve opening portion configured to contract the one or more sleeve opening restraints and fix a circumference of the sleeve openings at a contracted sleeve opening circumference.

11. The isolation gown of claim 1, wherein the one or more midsection restraints include an actuatable midsection portion configured to contract the one or more midsection restraints and fix the garment body at a contracted midsection circumference, wherein the contracted midsection circumference is smaller than the circumference of the body opening.

12. The isolation gown of claim 1, wherein the garment body includes a lengthwise perforated seam.

13. The isolation gown of claim 1, wherein the garment body includes a lengthwise slit.

14. An isolation gown, comprising:

a garment body including a shoulder portion, a neck opening and a body opening;

sleeves extending distally from the garment body, each having sleeve openings;

one or more neck restraints configured to contract the neck opening;

one or more sleeve opening restraints configured to contract the sleeve openings; and one or more midsection restraints configured to contract the garment body at a predetermined point, wherein the one or more neck restraints include an actuatable neck portion configured to contract the one or more neck restraints and fix the neck opening at a contracted neck circumference position, wherein the contracted neck circumference is smaller than a circumference of the body opening, wherein the actuatable neck portion is further configured to loosen the one or more neck restraints to fix the neck opening at an expanded neck circumference position, wherein the expanded neck circumference is larger than the contracted neck circumference, wherein the one or more sleeve opening restraints include an actuatable sleeve opening portion configured to contract the one or more sleeve opening restraints and fix a circumference of the sleeve openings at a contracted sleeve circumference, wherein the one or more midsection restraints include an actuatable midsection portion to contract the one or more midsection restraints and fix the garment body at a contracted midsection circumference, wherein the contracted midsection circumference is smaller than the circumference of the body opening, wherein the shoulder portion is located between the neck opening and sleeves, and wherein in each of the contracted neck circumference position and the expanded neck circumference position, the actuatable portion is positioned along a shoulder line of the shoulder portion.

15. The isolation gown of claim 14, wherein the garment body includes a turtleneck connecting the garment body to the neck opening.

16. The isolation gown of claim 14, wherein the one or more neck restraints, the one or more sleeve opening restraints, and/or the one or more midsection restraints includes a drawstring.

17. The isolation gown of claim 16, wherein the drawstring is elastic.

18. The isolation gown of claim 16, wherein the actuatable neck portion, the actuatable sleeve opening portion, and/or the actuatable midsection portion includes an exposed portion of the drawstring.

19. The isolation gown of claim 14, wherein the actuatable neck portion, the actuatable sleeve opening portion, and/or the actuatable midsection portion includes self-adhesive tape.

20. The isolation gown of claim 14, wherein the garment body includes a backside perforation that extends from the neck opening to the body opening and bisects the neck restraints.

* * * * *